US005415548A

United States Patent [19]

Adams

[11] Patent Number: 5,415,548

[45] Date of Patent: May 16, 1995

[54] SYSTEM AND METHOD FOR SIMULATING TARGETS FOR TESTING MISSILES AND OTHER TARGET DRIVEN DEVICES

[75] Inventor: Robert A. Adams, Sykesville, Md.

[73] Assignee: Westinghouse Electric Corp., Pittsburgh, Pa.

[21] Appl. No.: 22,260

[22] Filed: Feb. 18, 1993

[51] Int. Cl.[6] ..... F41A 33/00

[52] U.S. Cl. ..... 434/12; 434/14; 348/121; 273/348; 345/114; 364/578; 395/135

[58] Field of Search ..... 434/11, 12, 14, 20, 434/27, 38, 47, 69, 307; 273/348, 351, 378, 85 G, 434, DIG. 28; 345/113, 114, 201; 358/181, 183; 395/135; 364/578; 342/169; 348/25, 61, 121–124, 117–119

[56] References Cited

U.S. PATENT DOCUMENTS

| | | | |
|---|---|---|---|
| 4,191,956 | 3/1980 | Groothuis | 345/201 |
| 4,200,869 | 4/1980 | Murayama et al. | 345/201 |
| 4,439,760 | 3/1984 | Fleming | 345/201 |
| 4,585,418 | 4/1986 | Stickel | 434/20 |
| 4,641,255 | 2/1987 | Hohmann | 434/20 X |
| 4,910,687 | 3/1990 | Butler et al. | 345/191 |
| 5,001,469 | 3/1991 | Pappas et al. | 345/201 X |
| 5,047,782 | 9/1991 | Lew et al. . | |
| 5,061,930 | 10/1991 | Nathanson et al. . | |
| 5,089,811 | 2/1992 | Liach | 345/113 X |
| 5,090,909 | 2/1992 | Kellar et al. | 345/113 X |
| 5,125,671 | 6/1992 | Ueda et al. | 345/114 X |
| 5,150,458 | 9/1992 | Masuzaki et al. | 345/113 X |
| 5,224,860 | 7/1993 | Waldman et al. | 434/22 X |
| 5,241,371 | 8/1993 | Fukushima et al. | 358/183 X |

OTHER PUBLICATIONS

Chapter 3, Multibus II Architecture Specification Handbook, Revision 3.

*Primary Examiner*—Richard J. Apley
*Assistant Examiner*—Joe H. Cheng
*Attorney, Agent, or Firm*—Christopher O. Edwards

[57] ABSTRACT

In an improved system and method for simulating targets in which a target is moved across a background, background information and target information are stored in separate memories. Selected target information is supplied to selected background to create the simulation. The target memory contains two buffers which enables one frame of target information to be updated as a preceding frame is transmitted.

12 Claims, 50 Drawing Sheets 69
68

64
P
A
L

67a
S R
H E
— G
F T

67b
S R
H E
— G
F T
66a
C O U N T E R
66b
C O U N T E R
66c
C O U N T E R 76
75

79a
79b
LATCH
LATCH
SHIFT REG
SHIFT REG
78a
78b 73
74
LATCH 77
72
SEQUENCER
FLIP FLOP
70

71
OSC

FF LLOPP
COMPARATOR
MUX
SR HEG FT
LATCH
82a
82b
83
84a
84b
84c
85
86
87a
87b
88a
88b
89a
89b
107a
107b

FF LLOPP
COMPARATOR
MUX
SR HEG FT
LATCH
90a
90b
91
92a
92b
92c
93a
93b
94a
94b
95a
95b
108a
108b

SYSTEM AND METHOD FOR SIMULATING TARGETS FOR TESTING MISSILES AND OTHER TARGET DRIVEN DEVICES

BACKGROUND OF THE INVENTION

1. Field of the Invention

The invention relates to a system and method for simulating signals which a missile may receive to indicate the presence and position of a target.

2. Description of the Prior Art

Advanced missiles and other devices contain electronic systems for sensing the presence and position of targets and generating data in response thereto. The sensor data is received by a processor which performs an analysis to guide the missile and other tasks. The art has routinely tested missiles and other such devices to assure that they properly respond to target information which they receive from the sensors. It is desirable for both production and development testing to provide a means for inputting simulated sensor data into the missile processor. This will allow the processor to be tested without a working sensor and will allow specific features of the processor to be stressed without consideration for any sensor limitations. It is necessary that the means of producing these simulated targets be at the same time both as flexible and as realistic as possible.

For realism it is necessary to be able to vary the size, intensity, rate oil movement, and number of targets and to present these against a realistic background. The data must also be properly formatted to accurately represent how the data will be presented by the sensor to the processor.

The art has developed test boards which provide a means of buffering, formatting and transmitting target data to the missile processor. These test boards can be interfaced to a separate computer. Software running in the computer will control user input commands to either download preprocessed data or specify target parameters for the creation of real time targets. The test board will provide dual data buffers which allow target data to be written to one buffer while the other is transmitting. Typically, the total amount of data held in a buffer is a single frame. When a complete frame is transmitted the order is reversed. This will allow continuous transmission and updating of target data.

In the system of the prior art, when attempting to create real time targets with a realistic background it is not always possible to completely update a frame in the time it took to transmit the frame. This meant that a given frame had to be transmitted multiple times, reducing the realism of the generated pattern. The prior art had two limitations which the improved system corrects:

1) as the target is moved the background data must be rewritten over its original position; and 2) for the missile field of view to scan, the entire background and target must be rewritten.

SUMMARY OF THE INVENTION

I provide an improved method and apparatus for simulating targets for testing missiles and for providing to missiles other target information which they receive from the sensors. I prefer to interface my test board to a single board computer (SBC) in a Multibus II chassis. One of the main concerns in this design was to simplify the task of the SBC in the creation of targets in real time.

As in the prior art I use two target buffers which allows one buffer to transmit while the other one is being loaded by the SBC for the next frame. However, it also use a separate background buffer which allows background scenes to be written before transmission starts. Target data is then overlaid on the background scene in the hardware as the board is transmitting. This frees the SBC from having to update background data as a target moves within the field of view. I also provide an offset control register for specifying coordinates of one corner of the current field of view. By updating this register it is possible for the current field of view to scan across the background buffer without additional updates to the buffer. The background can also be updated during transmission if desired by writing to the regions just outside the current field of view which will lie within the next frame's field of view. The field of view can then be moved by changing the offsets.

I use a target pointer RAM to simulate the unique sampling pattern produced by the missile sensor head. The missile being tested usually will employ two circular arrays of infrared detectors and a rotating prism which produces a rosette pattern in a circular field of view. The pointer RAM will be loaded with a set of pointers into the Target Buffers which will produce the correct sequence when transmitting. This allows targets to be written to the Target Buffers as two dimensional targets without reference to the sensor heads sampling pattern.

I also provide a resolution control register which controls the size of the buffer needed to hold a field of view. As the resolution is reduced, fewer elements are needed to hold a target of a given size. This makes it possible for the SBC to be able to update large targets in a single frame. A large target is one to which the missile is getting very close. The target and background buffers have separately controllable resolutions to allow the target buffer to change without having to update the background. The background buffer can be loaded with a number of fields of view dependent on the selected resolution.

I prefer to generate timing signals for transmitting targets and synchronizing the buffer controllers with a programmable sequencer.

I prefer to provided a control register which controls if a target is being transmitted, which target buffer is being transmitted, if background data is to be included, and the resolutions to use with each buffer. I further provide double buffering of the offset and control register to allow the SBC to load the value for the next time frame before it is needed. A signal from the board timing generator will clock data to the second buffer at the end off a frame. I also provide a means for software to generate a signal, softmark, which can be used to clock the double buffered data at the beginning of the first frame to initiate transmission.

I also prefer to provide a status register which allows the SBC to read the current control bits at the output of the second buffer and any error bits.

Other details, objects and advantages of the invention will become apparent from a detailed description of the present preferred embodiment thereof which is shown in the accompanying drawings.

BRIEF DESCRIPTION OF THE FIGURES

FIGS. 2 thru 18 have the following corresponding subfigures:

DESCRIPTION OF THE PREFERRED EMBODIMENTS

Data supplied as missiles and other devices being tested consists of information about the background and target being observed as well as data about the position of the sensor head which is observing the target and background. While in service these devices are likely to encounter targets which vary in size, position and temperature as well as to see variations in background. To better test such equipment, it is preferable to provide dynamic real time targets which move and change in a variety of backgrounds.

Test data has traditionally been supplied as a series of frames containing background and target information. For a stream of data which shows a target moving across a background, only a small portion of adjacent frames are different. Thus, if frames are transmitted serially through the test device a large amount of repetitious information is being processed. To improve processing time I provide a method and apparatus which separates the background data from the target data, transmits this information through my target generator separately and then combines the data just before such information is transmitted to the test device. Hence, targets can be moved across a background scene without having to continually rewrite the background to the target's previous location. Because the target data is handled separately from the background data I can provide separate resolution controls and offset controls for them.

Figure 1:
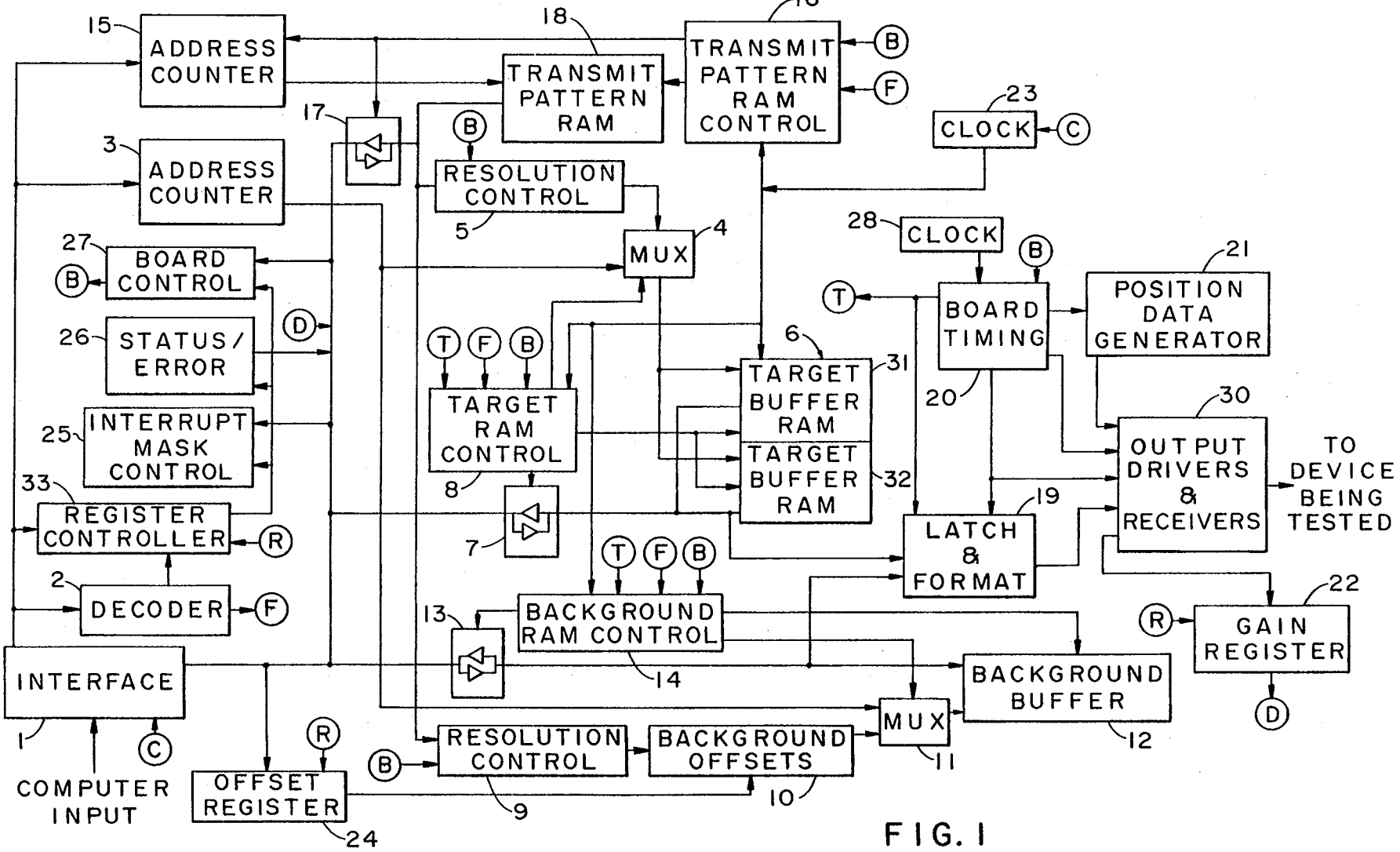
FIG. 1 is a functional block diagram of a present preferred embodiment of my target generator.

Referring to FIG. 1, I provide an interface 1 for connection to a single board computer (SBC) (not shown) through an iLBX bus interface 1. Application software running on the SBC will control aspects of real time target creation and provide a user interface for debugging and integration. A function decoder 2 monitors the upper address bits to determine if the board is being selected and decode iLBX control signals for read/-write functions. It will further decode the address to select one of the data buffers or registers. If one of the data buffers is selected, the lower address bits are latched in either the target and background address latching counter 3 or the transmit pattern control address latching counter 15. If a register is selected the address is further decoded by register controller 33 to select one of the registers 22, 24–27. ILBX control signals are transmitted to each of the controllers 8, 14, and 16 as indicated by the circled letter "F". Circled letters B, C, D, R and T indicate the other common connections. Transceivers 7, 13 and 17 are connected to the controllers 8, 14, 16 and 18. The data bus connects the interface i to one of the registers 22, 24–27, background buffer RAM i2 and target buffer RAM 6 which has two 64K×24 buffer sections 31 and 32. The two target buffers provide space for the computer to create targets. A target buffer is a two dimensional RAM array containing a single field of view (the area that the missile "sees" at one point in time). Using two target buffers will allow the computer to be updating one array while the board is transmitting targets from the other. The array which is transmitting can be switched at the end of each frame. One frame is the time to scan the entire field of view. The board can therefore be made to "ping-pong" between buffers on successive frames.

In this application the missile seeker head is provided for sensing two colors, medium and long wave infrared individual sensors are sampled and the results converted by a 12 bit analog-to-digital converter. Therefore, to simulate this, each element in the Target Buffer consists of two 12 bit words, one for each color.

The Target Buffer RAM areas are configured as two dimensional arrays by treating address bits 0–7 as the column address and address bits 8–15 as the row address. Address bit 16 selects between the two target buffers.

The arrays are large enough to allow 7.5 times the angular resolution of a signal detector for greater precision in defining point targets. A minimum point target would be at least 8 array elements in diameter to represent the signal level as the target moved across the IR sensing element. Larger targets (size being an angular measurement) would of course fill more elements in the array.

Resolution control PAC 5 and 9 allow control of target resolution. The resolution is controllable through software, preferably to a half or a quarter of the maximum resolution. This will allow reducing the total number of elements making up a target as the target becomes larger. That occurs when the missile gets closer to the target, the target therefore filling a larger portion of the field of view. The reduced resolution allows the computer to be able to continue updating the target each frame.

The resolution can be changed while the board is transmitting. A new resolution becomes valid at the beginning of the next frame after the value was loaded.

Background information is stored in background buffer RAM 12 which preferably is 128K×24.

The Background Buffer is large enough to hold two fields of view at the maximum resolution. Multiplexers 4 and 11 are used to select the address to the the target; background buffers 6, 12 from either the address counter or the transmit pattern ram 18 through resolution control 5, 9. Separate resolution control 9 allows the field of view to be adjusted to 32 fields of view at minimum resolution. An offset register 24 can be loaded with an x and y offset into the array. This allows the creation of a moving background scene without having to update this entire field of view.

There is only one Background Buffer which, when used, would be loaded with a scene before transmission is initiated. If a scene is desired which is larger than the Background Buffer then it is only necessary to update the portion that is new each frame. Changes to the offset register 24 will become valid at the beginning of the next frame after a new offset was loaded.

Software can control if background data will be used or not. If inclusion of the background is not selected then only the contents of the Target Buffer will be transmitted. If background data is selected then background data will be transmitted at each location where the contents of the target buffer RAM is zero, or where no target is present.

The IR sensor array which is being simulated by my system consists of two circular arrays of 16 detectors. A rotating prism causes the detectors to scan a circular field of view. The detectors are sampled a number of times as they scan a field of view and then digitized data is transmitted as two serial streams, one for each color. The sequencing of the sampling mechanism traces out a rosette pattern which must be duplicated by the target generator.

The target buffer RAM allows targets to be created in a two dimensional array. When transmitting targets, the board will read data from the Target Buffer in the correct sequence to simulate the sensor assembly. I provide a target pointer control RAM 15 and associated control 16. The target pointer control RAM will hold an array of pointers into the Target Buffer RAM which will be used to produce a sequence simulating the sensor assembly movement. This pattern is loaded by the computer once before transmission begins.

Target and background information are combined in latch and data formatter 19. The combined target data, timing signals and output driver 30 transmit position data generator 2. Gain data is received 30 and latched in gain register 22.

I prefer to provide a timing circuit 20 to transmit a synchronization signal indicated by circled "T" to the target buffer RAM control 8 and background RAM control 14 to control the flow of target data to the formatting circuit 19 during target generation.

All communication to my system by the computer are across the interface 1. All transfers are handled as long words, 32 bits wide. All RAM and registers are on long word boundaries. I prefer to use a Multibus II iLBX interface available from Intel. The Multibus II iLBX interface is a general purpose bus for local communication between the computer and interface boards. The bus consists of 32 bits of data, 26 bits of address and control lines. The control lines and protocol support four functional cycles. An arbitration cycle allows control of the bus to pass to a secondary master. The transfer cycle supports reading and writing between bus agents, byte, word or long word transfers are supported. An exception cycle can be used to indicate transfer or protocol errors. System control provides a mechanism to initiate a system wide reset. For more detail about the iLBX interface see Intel's "Multibus II Architecture Specification Handbook" chapter 3.

The external computer is the bus master so it initiates all reads and writes across the bus. There will be no other masters on the bus so no arbitration is needed.

The iLBX interface 1 is controlled by two programable logic devices or PALS. The iLBX Control PAL decodes the board address and detects a read or write cycle. The Function Control Pal further decodes the address to determine the section of the board to read from or write to. iLBX data and address are buffered to internal busses for access by the various RAM/Register controllers. Wait states can be inserted during a read or write, if needed, when the board is also accessing a specified RAM array for transmission to the missile processor. A dip switch selects whether the iLBX clock is provided by the test board or the SBC.

The heart of the board is a set of controllers 8, 14, 16 and 33 which control access to the various RAM arrays and the control/status registers. Each controller is a state machine implemented in a PAL.

The RAM controllers 8, 14 and 16 handle passing data between the RAM arrays and the internal LBX data bus. They also pass data to formatting circuitry for serial transmission to the missile processor.

The register controller 33 provides read or write access between the various registers and the internal LBX data bus.

There are two clocks used on the board. A 48 MHz clock 23 is divided down to provide the 24 MHz board clock. This clock is further divided to produce a 12 MHz LBX clock which may be used as the iLBX interface clock as mentioned above. A 20 MHz clock 28 is used by a programmable sequencer to provide systems clocks and internal synchronizing signals for reading, formatting, and transmitting data.

A number of registers are provided to control the various functions of the board and to monitor its status. A board control register 27 is used to control transmit and self-test functions of my system. A status/error register 26 will give information about the status of the system. The interrupt mask register is a 32 bit, read/-write register which will select which interrupt conditions are active. The offset register 24 preferably is also a 32 bit, read/write register. It holds the values of x any y offsets into the background buffer to be used to move the field of view across a background scene. A reset signal is provided to cause a software reset of the board control register 27 and associated buffer and board timing 20. The gain register 32 will return the last gain data in the lower 16 bits of this 32 bit register. Finally, a softmark signal is produced by writing to a particular address and is used to clock the double buffer of the board control register 27. This will initiate transmission if the board control register is appropriately set. Reading the softmark address will return the value of the status register and reset the error bits.

Figure 2:
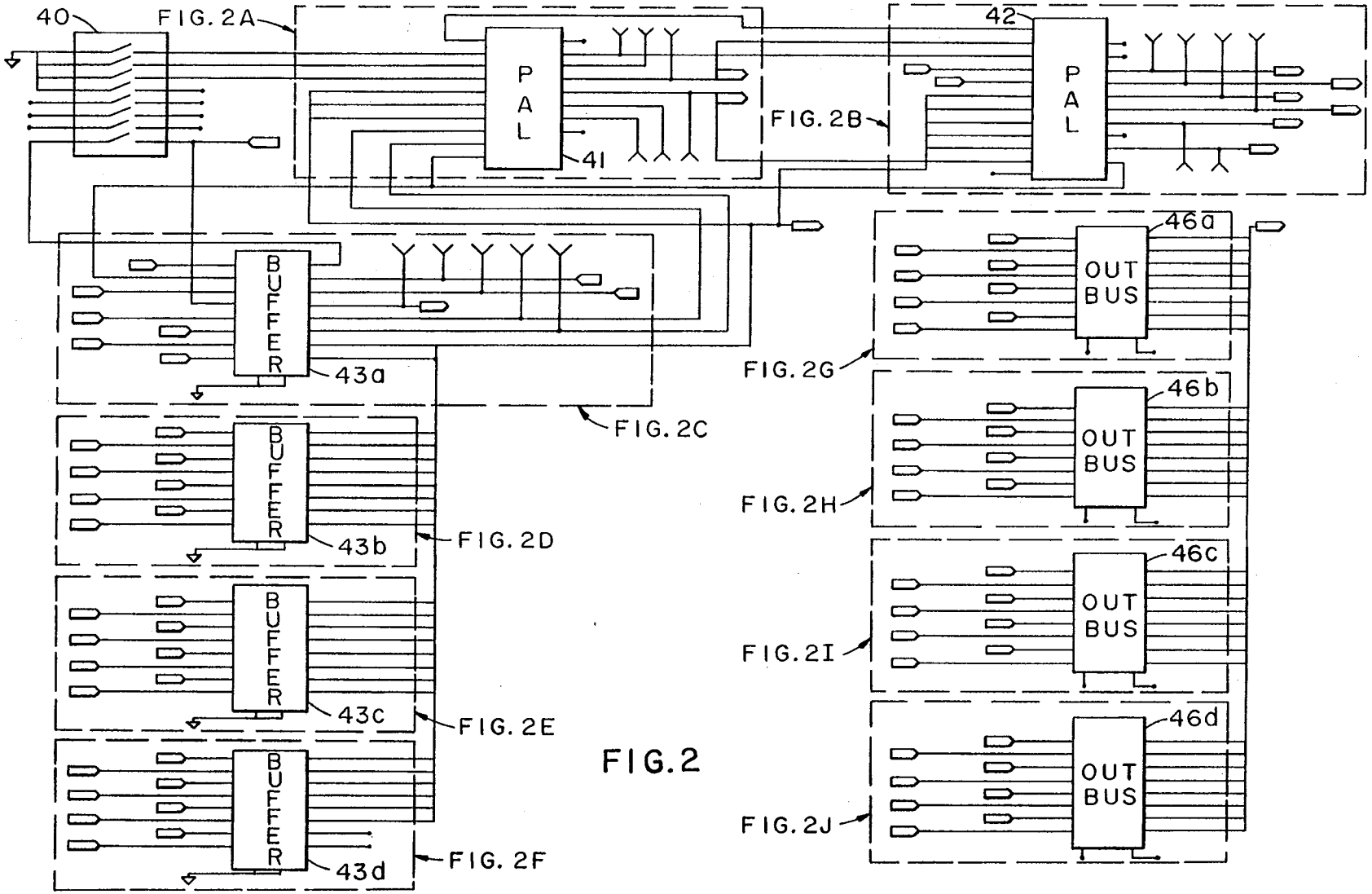
FIG. 2 is a circuit diagram of a present preferred interface and function control board used in the present preferred embodiment of my target generator.
Figure 3:
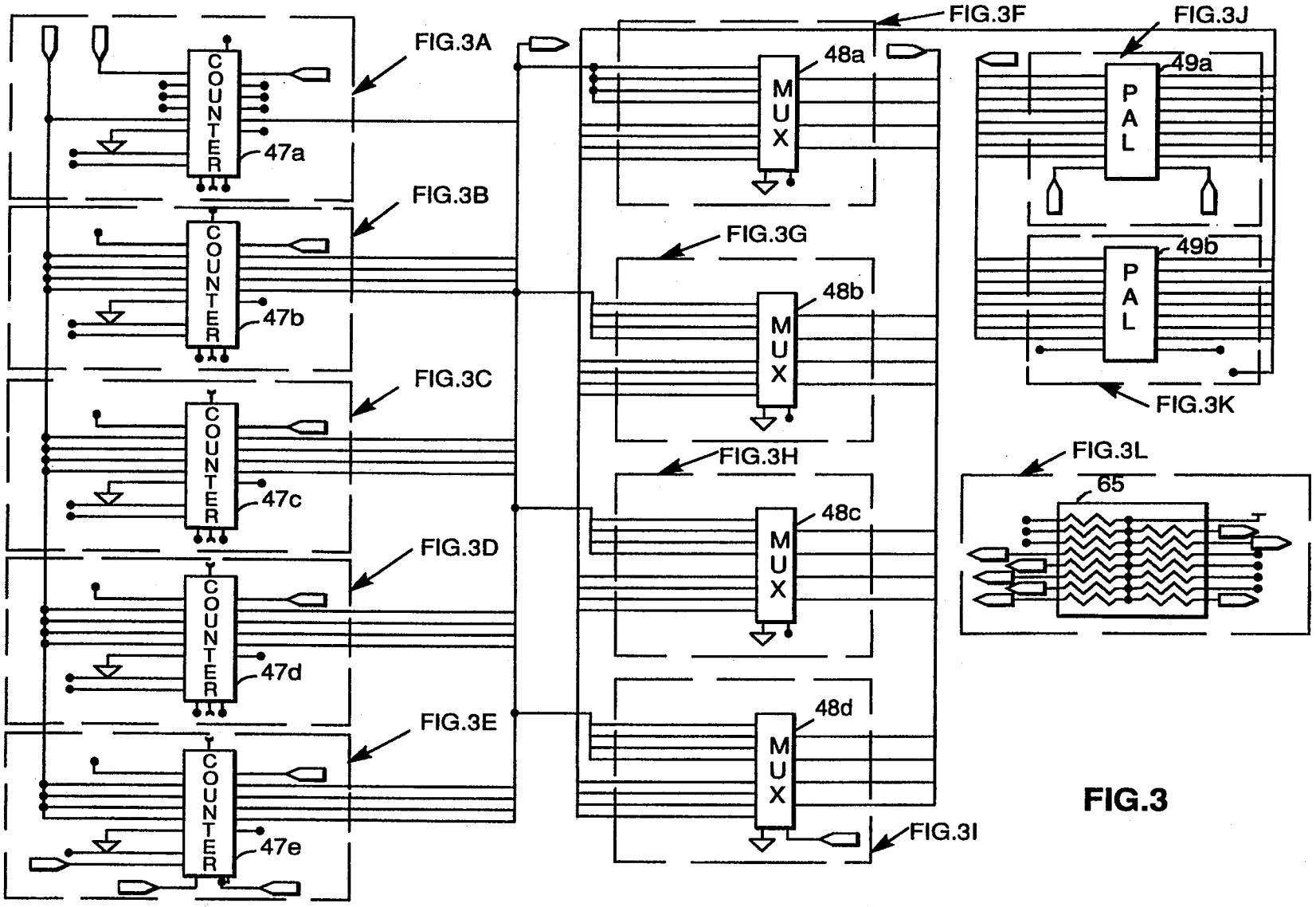
FIG. 3 is a circuit diagram for my present preferred target and background address register and counter and my preferred target RAM resolution control.
Figure 4:
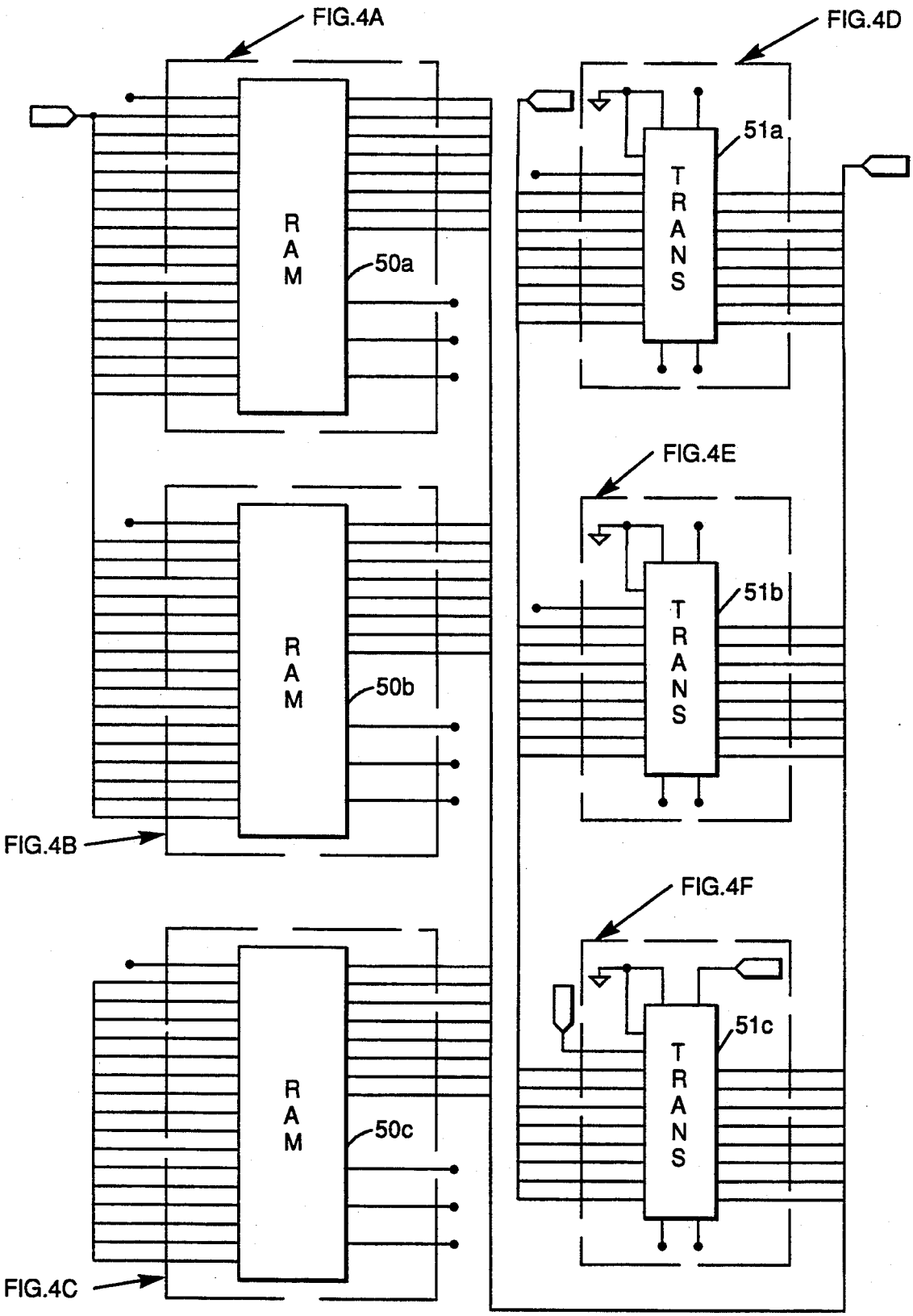
FIG. 4 is a circuit diagram of the present preferred target buffer memory.
Figure 5:
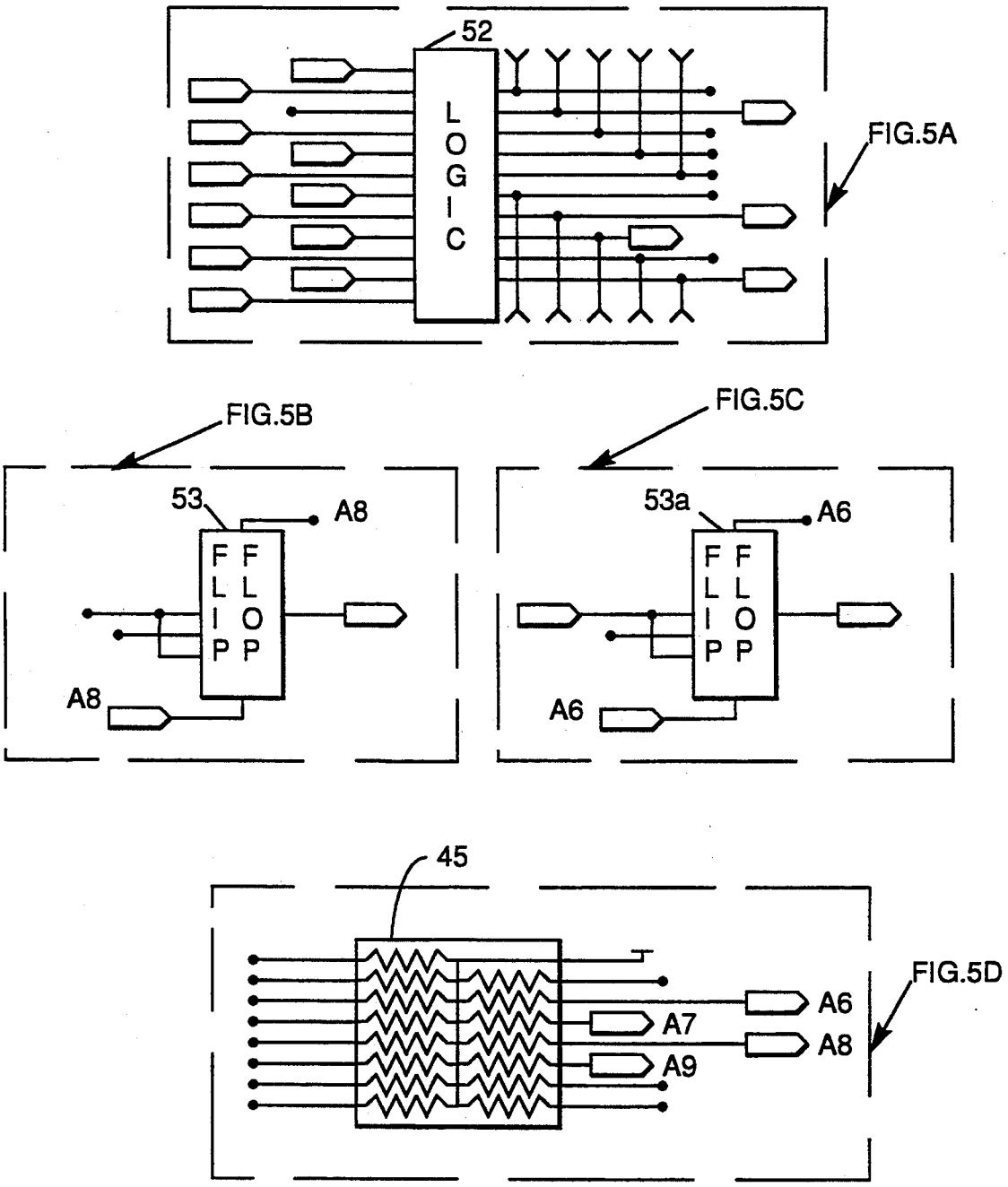
FIG. 5 is a circuit diagram showing my present preferred target buffer memory control.
Figure 6:
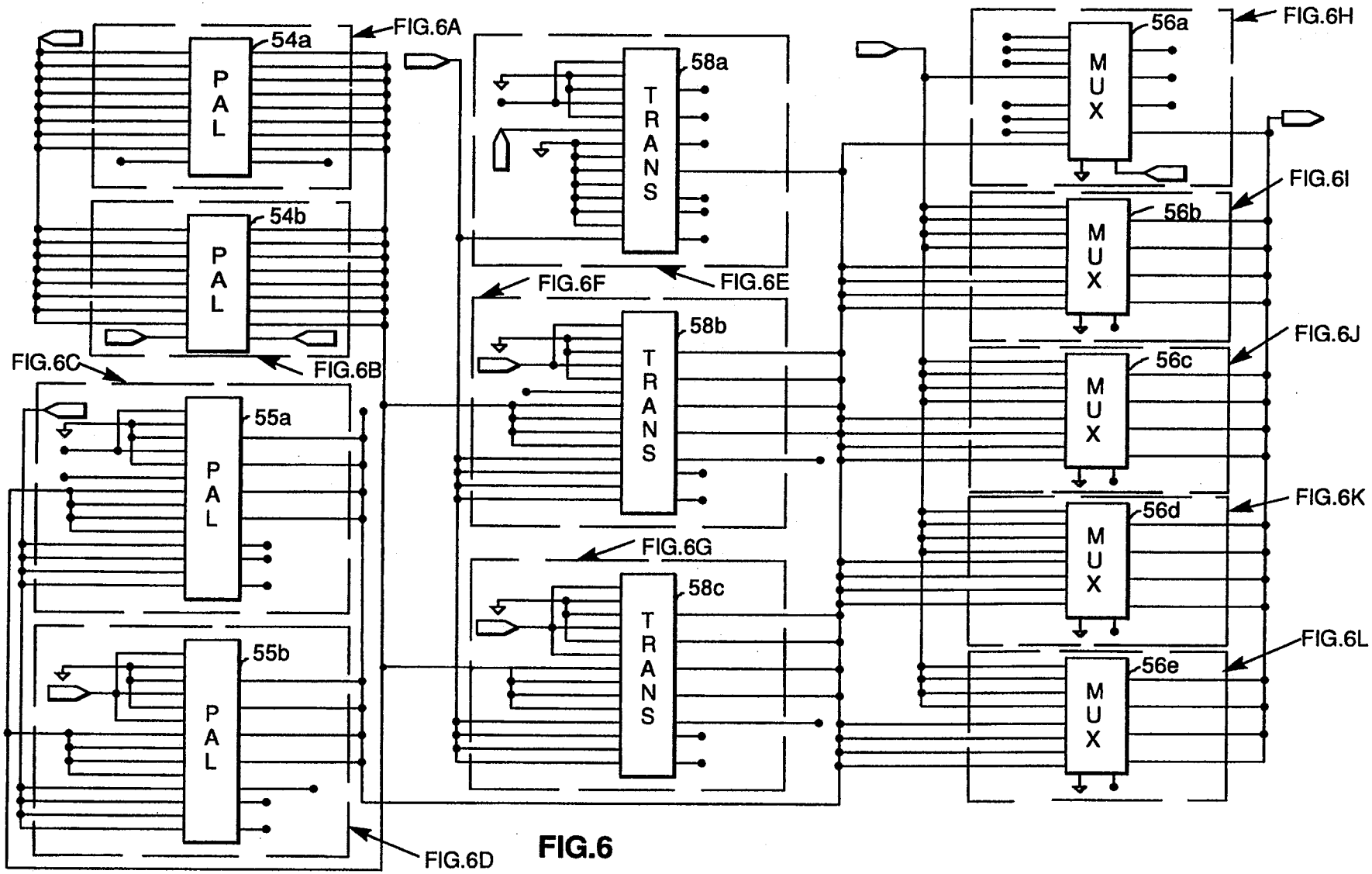
FIG. 6 is a circuit diagram of my present preferred background resolution control, background offset control and background address mux.
Figure 7:
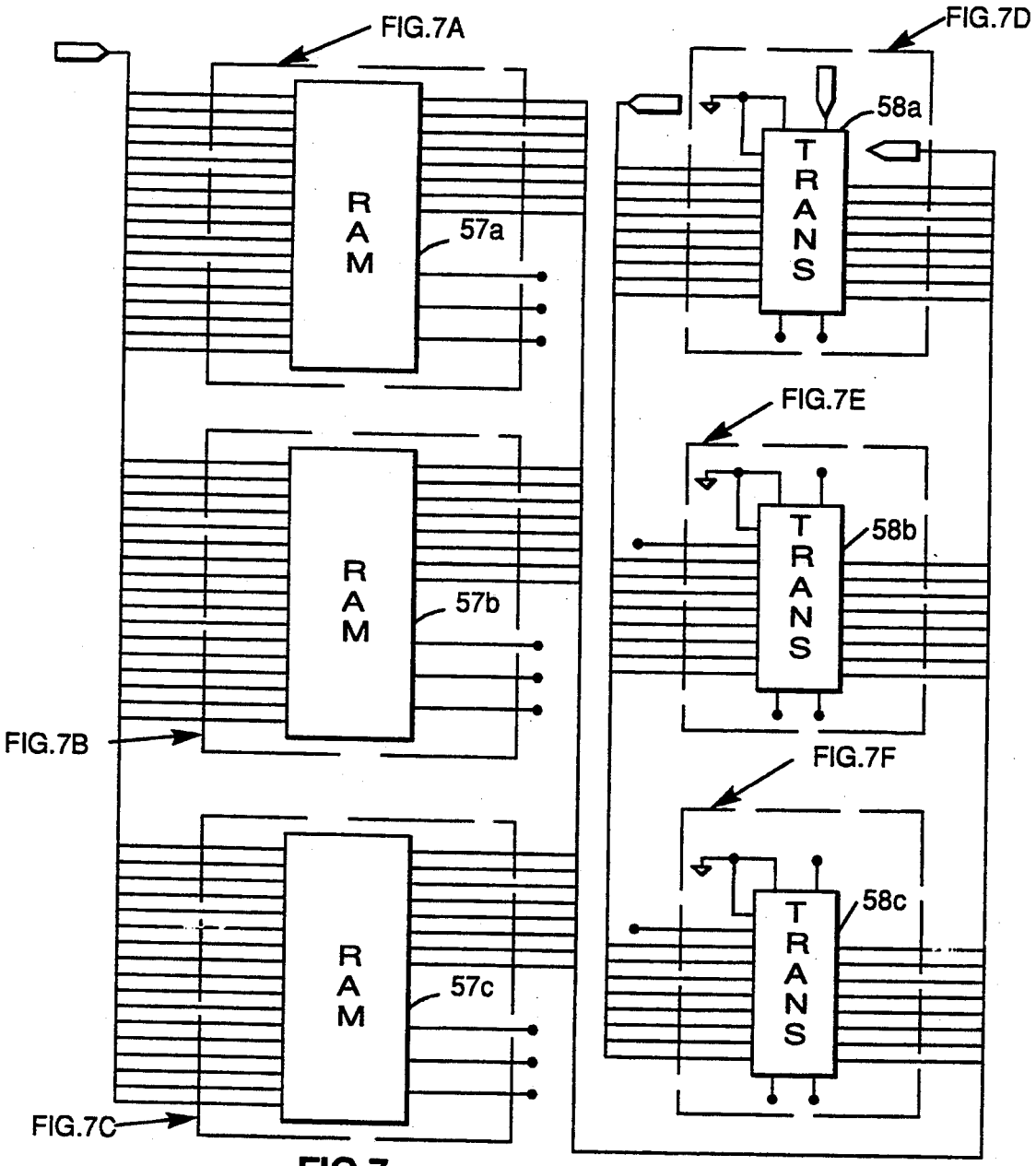
FIG. 7 is a circuit diagram of a present preferred background buffer RAM.
Figure 8:
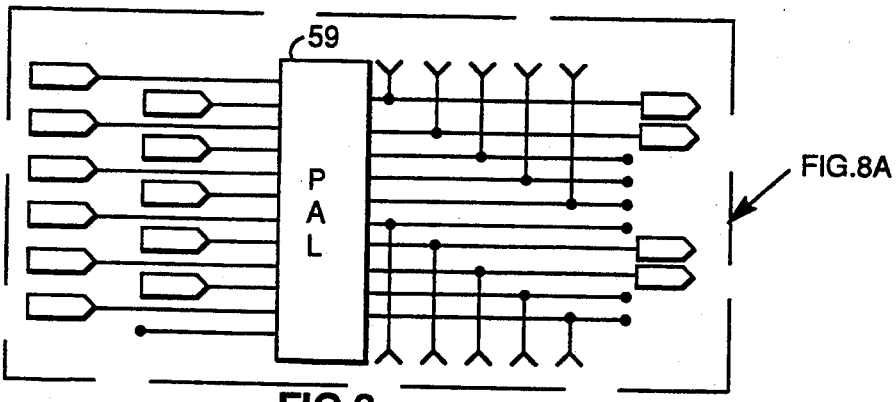
FIG. 8 is a circuit diagram showing my present preferred background buffer RAM control.
Figure 9:
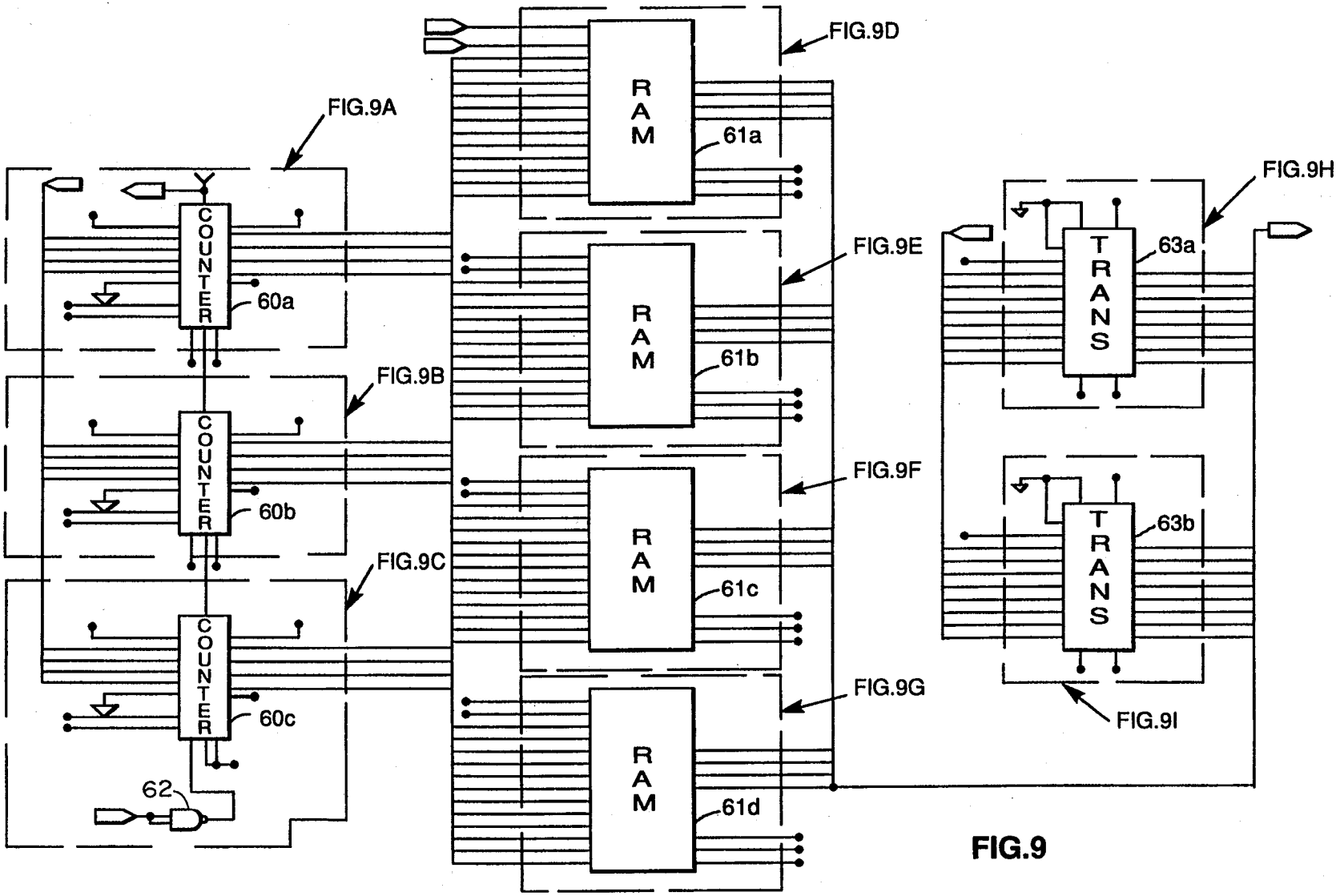
FIG. 9 is a circuit diagram of my present preferred target pattern ram address counter and data transceiver.
Figures 10, 10A, 11, 11A, 11B, 11C, 11D, 11E:
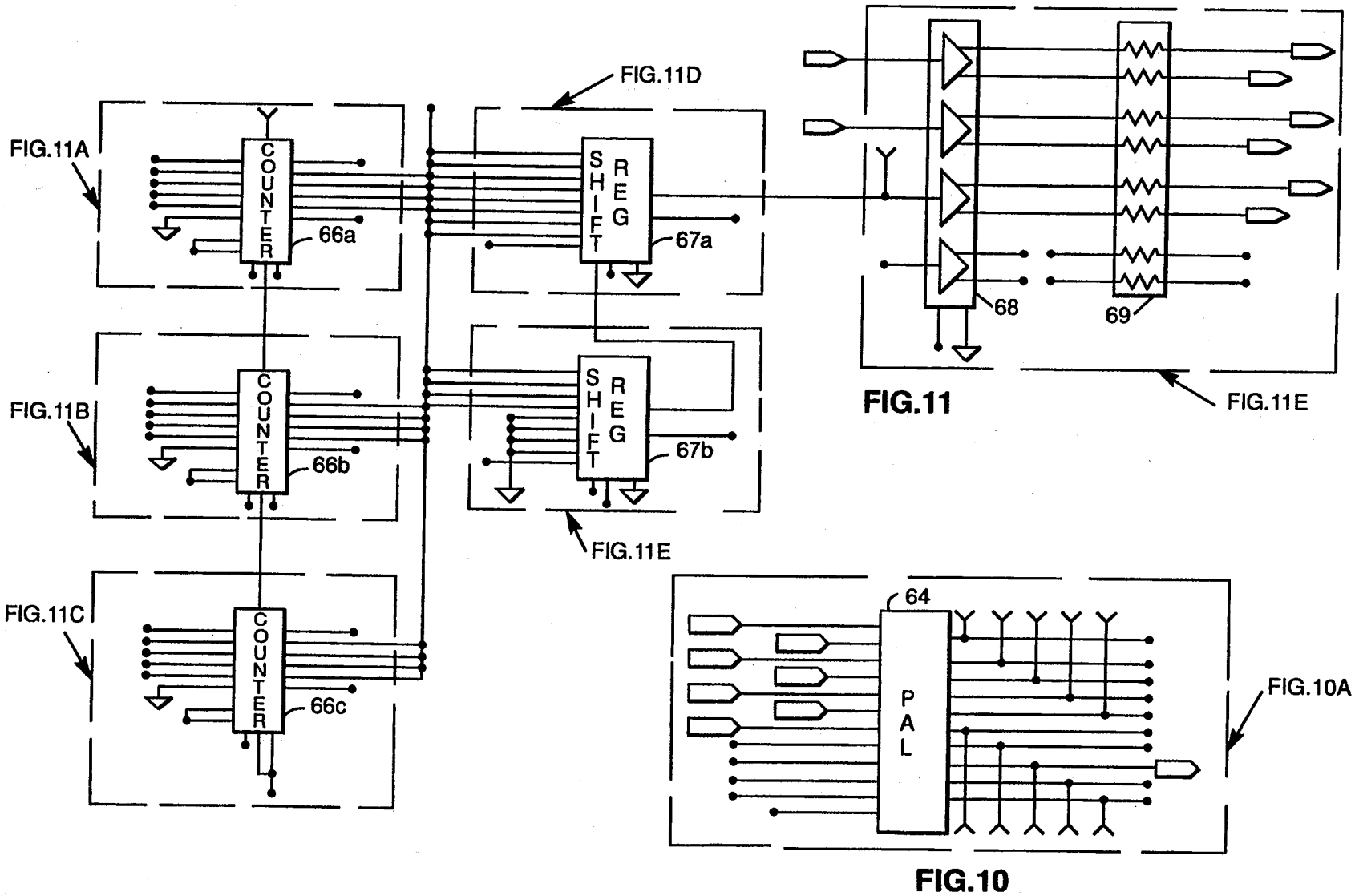
FIG. 10 is a circuit diagram showing my present preferred transmit pattern control RAM control.
FIG. 11 is a circuit diagram of a present preferred position data generator.
FIG. 10A is the circuit diagram of FIG. 10 on which data flow is shown.
FIGS. 11A thru 11F are circuit diagrams of selected portions of FIG. 11 marked in dotted lines on FIG. 11 which show data flow within those portions.
Figures 12, 12A, 12B, 13, 13A, 13B:
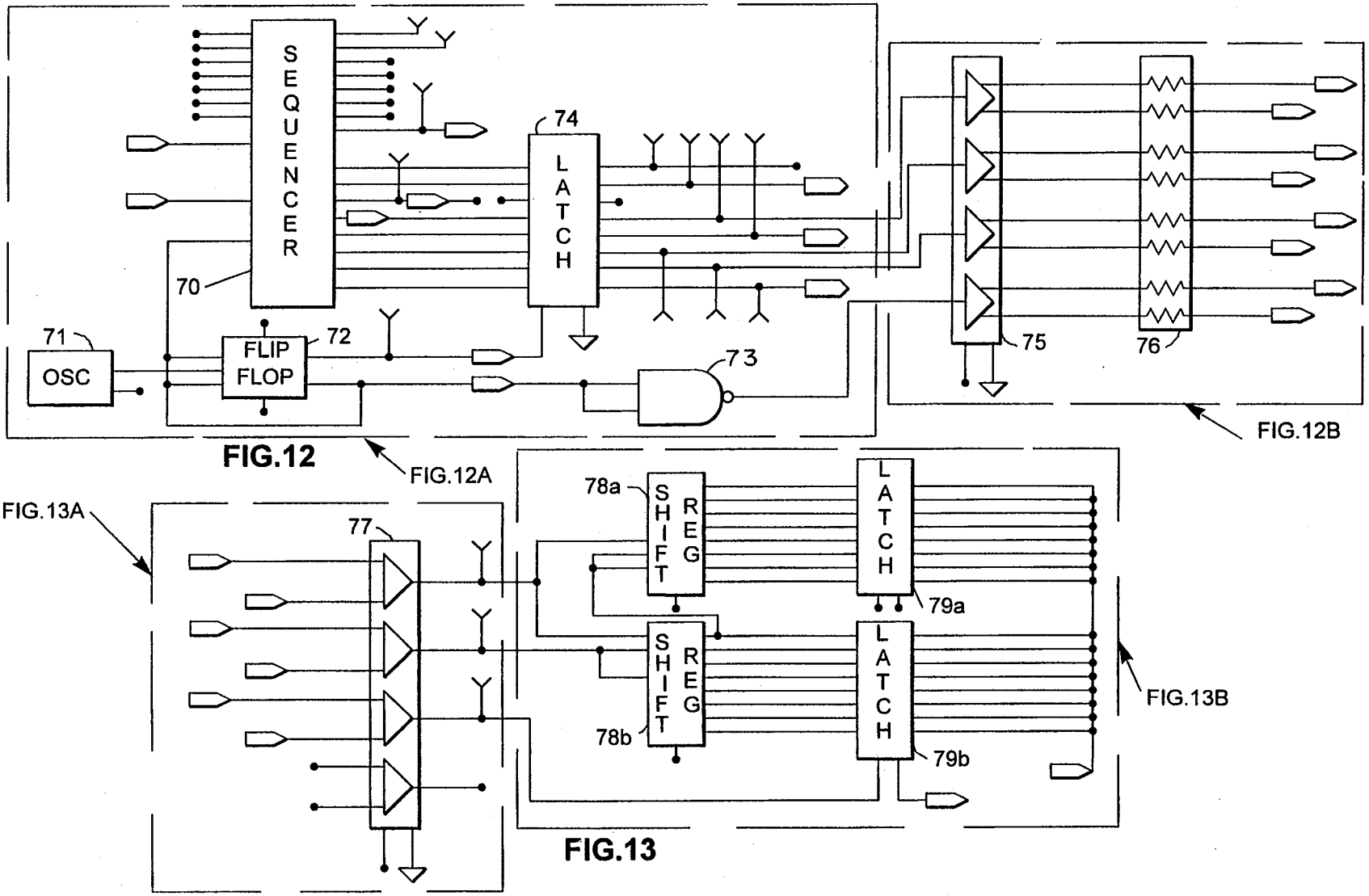
FIG. 12 is a circuit diagram of a present preferred timing circuit.
FIG. 13 is a circuit diagram of a present preferred gain data register.
FIGS. 12A and 12B are circuit diagrams of selected portions of FIG. 12 marked in dotted lines on FIG. 12 which show data flow within those portions.
FIGS. 13A and 13B are circuit diagrams of selected portions of FIG. 13 marked in dotted lines on FIG. 13 which show data flow within those portions.
Figure 14:
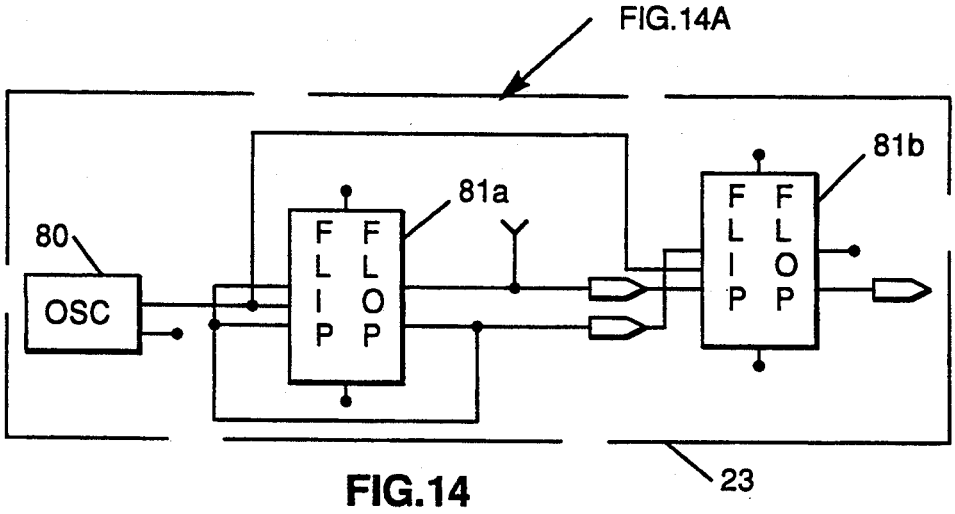
FIG. 14 is a circuit diagram of a present preferred clock divider.
Figure 18:
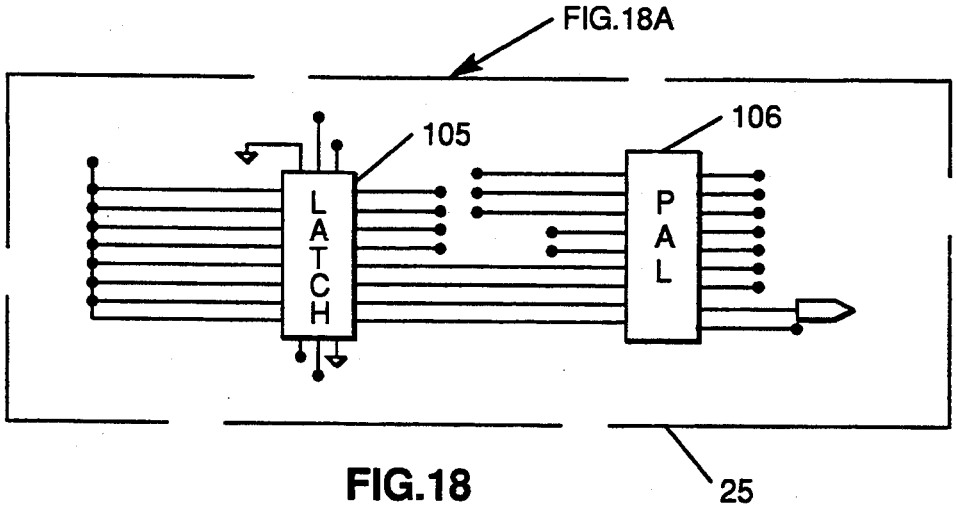
FIG. 18 is a circuit diagram of my present preferred interrupt mask register and interrupt control.
Figures 15, 15A, 15B, 15C, 15D, 15E, 15F, 15G, 15H, 15I, 15J, 15K:
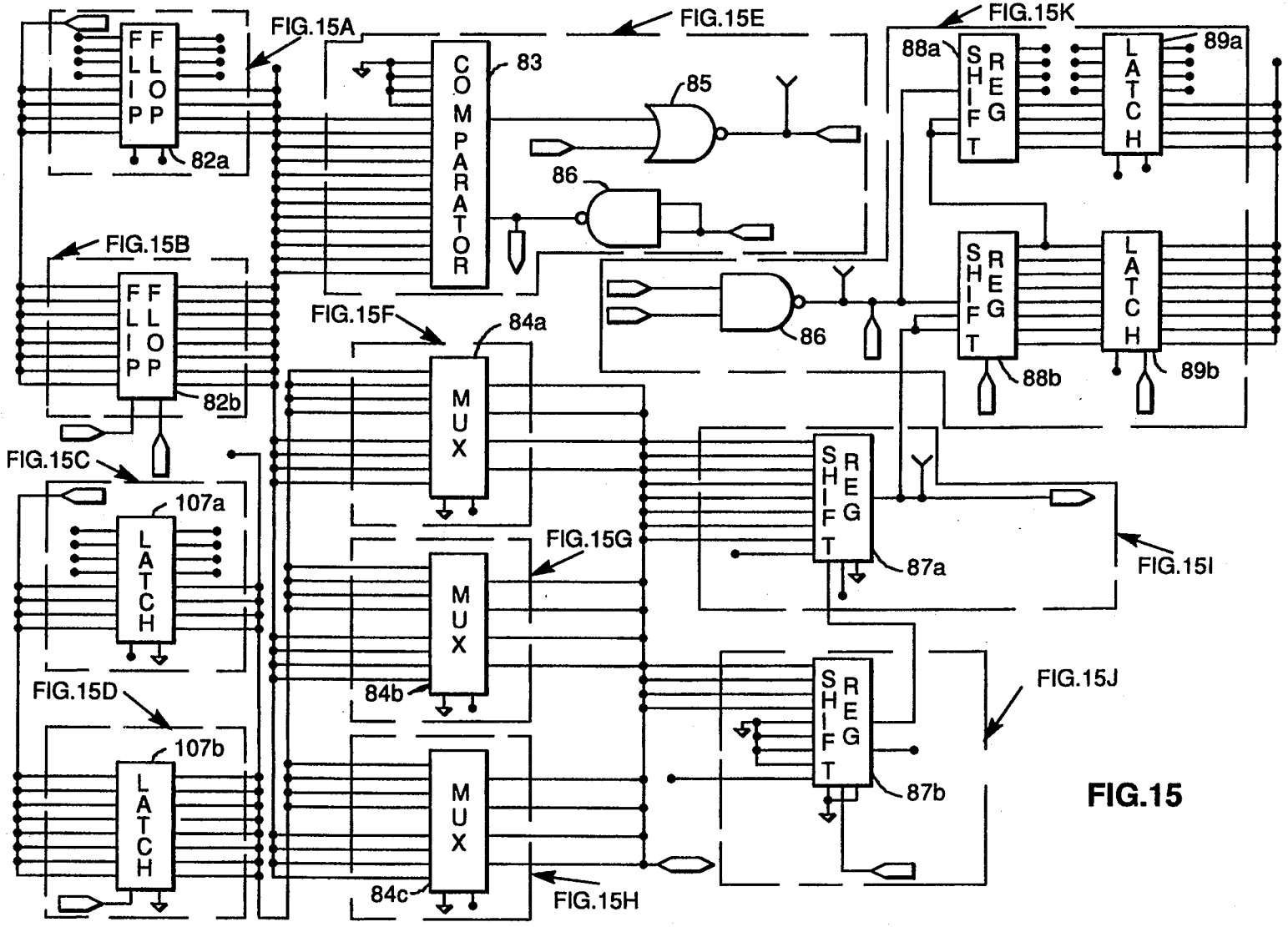
FIG. 15 is a circuit diagram of a present preferred latch and format circuit which combines the target data and background data for medium wave target formats.
FIGS. 15A thru 15K are circuit diagrams of selected portions of FIG. 15 marked in dotted lines on FIG. 15 which show data flow within those portions.
Figures 16, 16A, 16B, 16C, 16D, 16E, 16F, 16G, 16H, 16I, 16J, 16K:
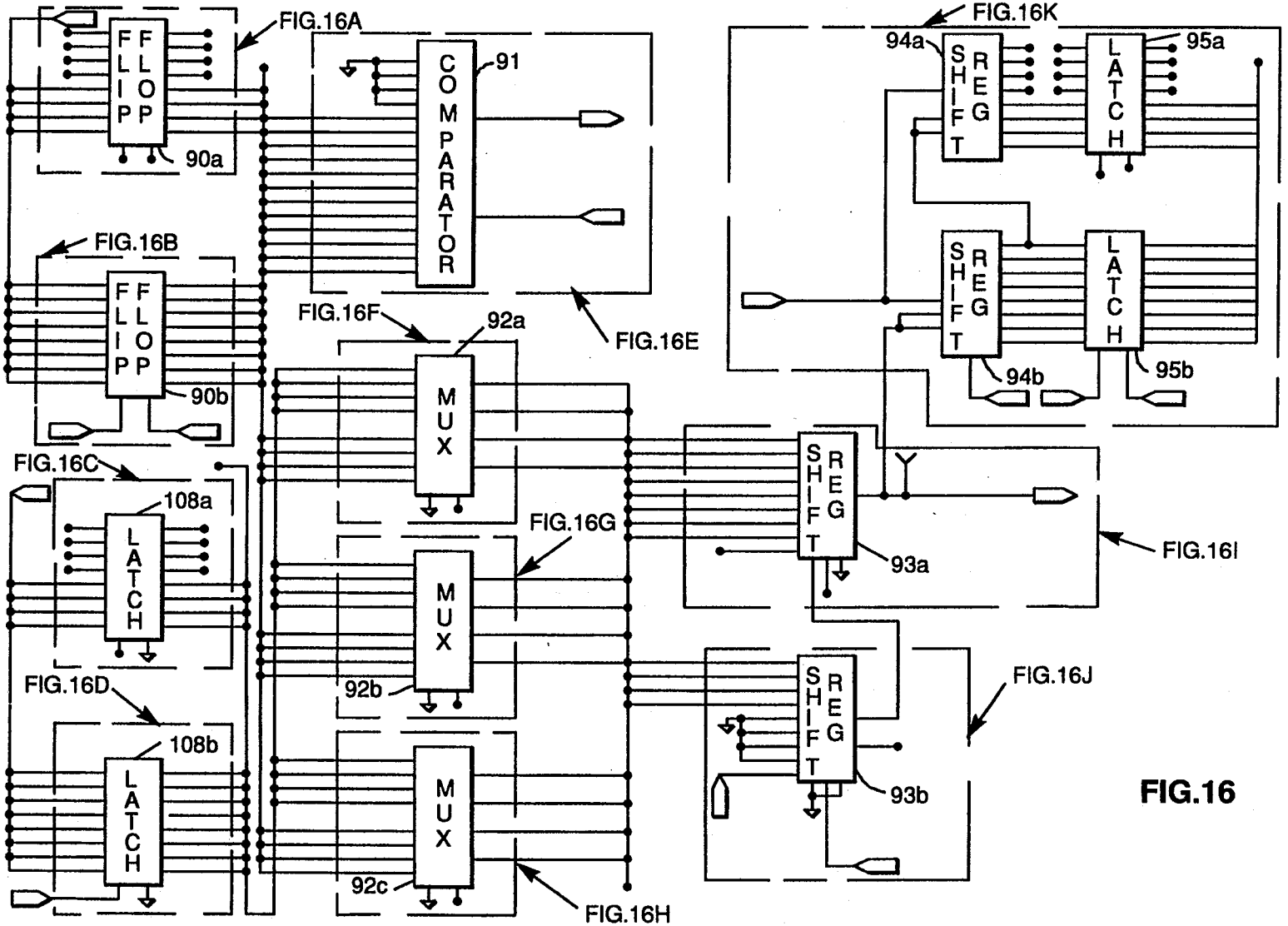
FIG. 16 is a circuit diagram similar to FIG. 15 for use with longwave target formats.
FIGS. 16A thru 16K are circuit diagrams of selected portions of FIG. 16 marked in dotted lines on FIG. 16 which show data flow within those portions.
Figure 17:
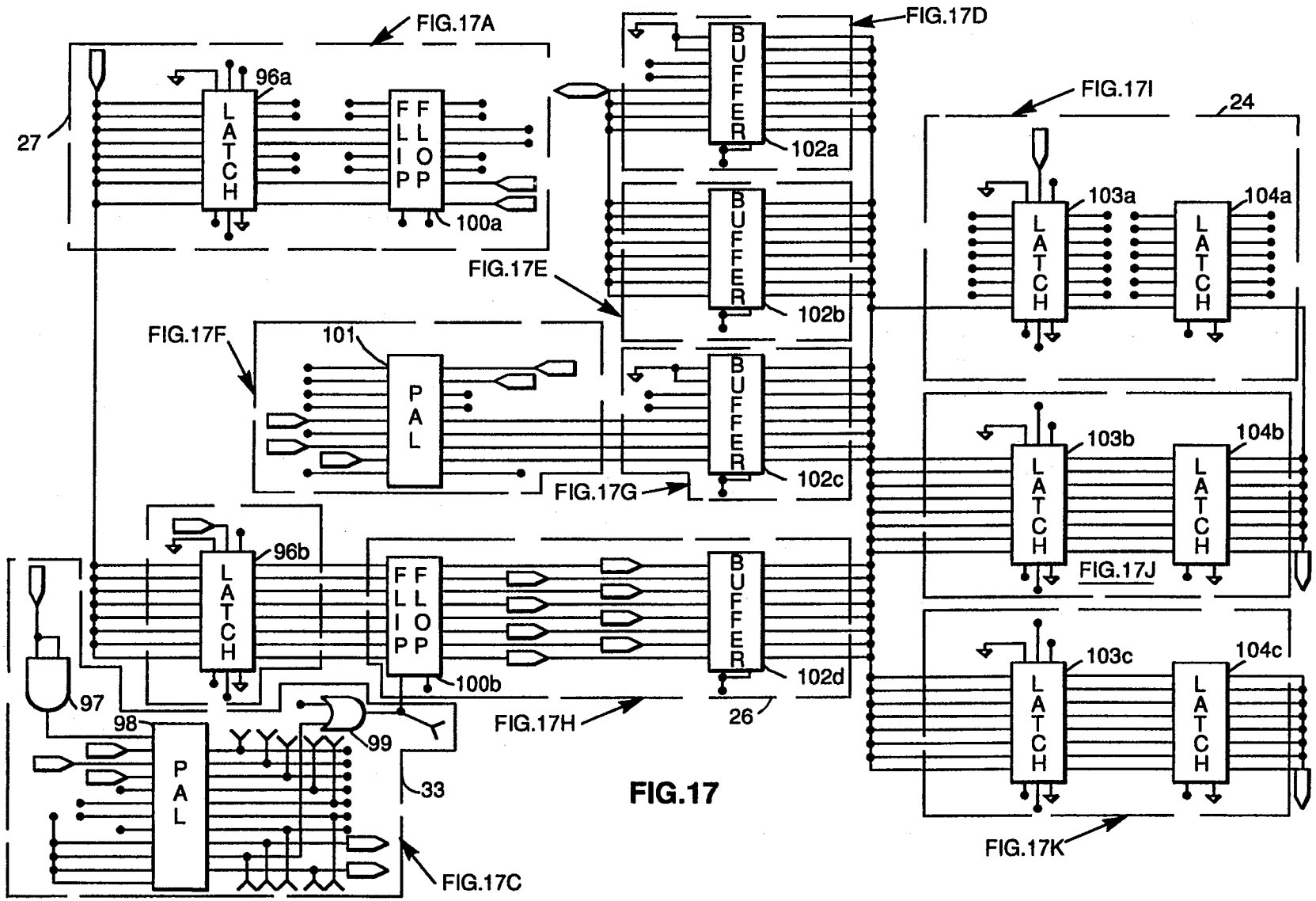
FIG. 17 is a circuit diagram for my present preferred board control register, status register, offset register and register control.
Figure 2A:
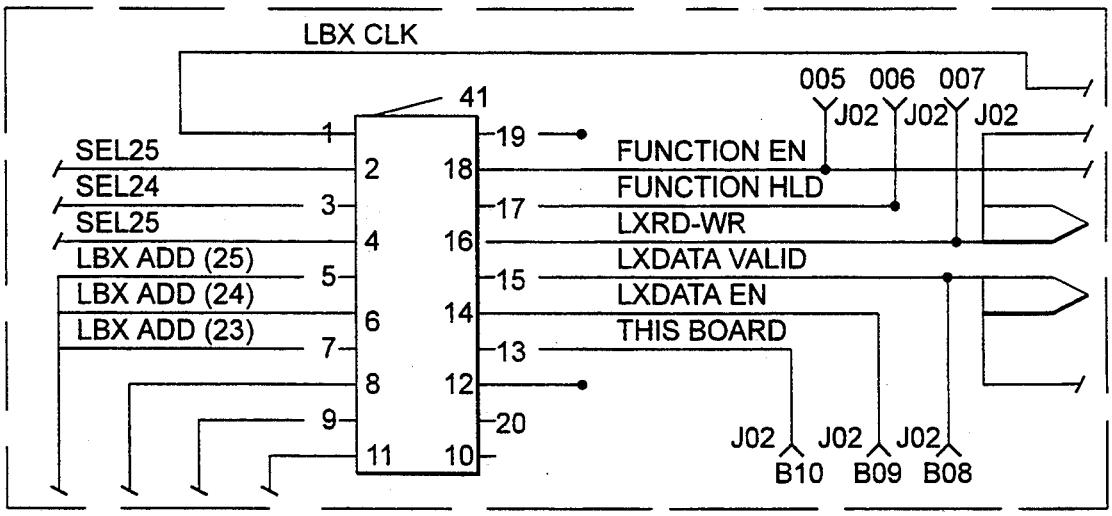
FIGS. 2A thru 2J are circuit diagrams of selected portions of FIG. 2 marked in dotted lines on FIG. 2 which show data flow within those portions.
Figure 2B:
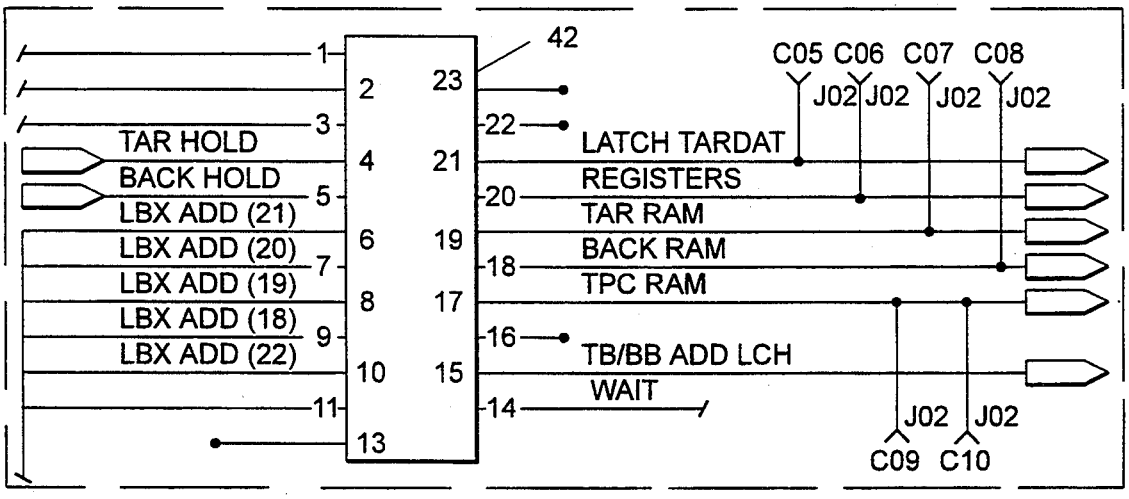
Figure 2C:
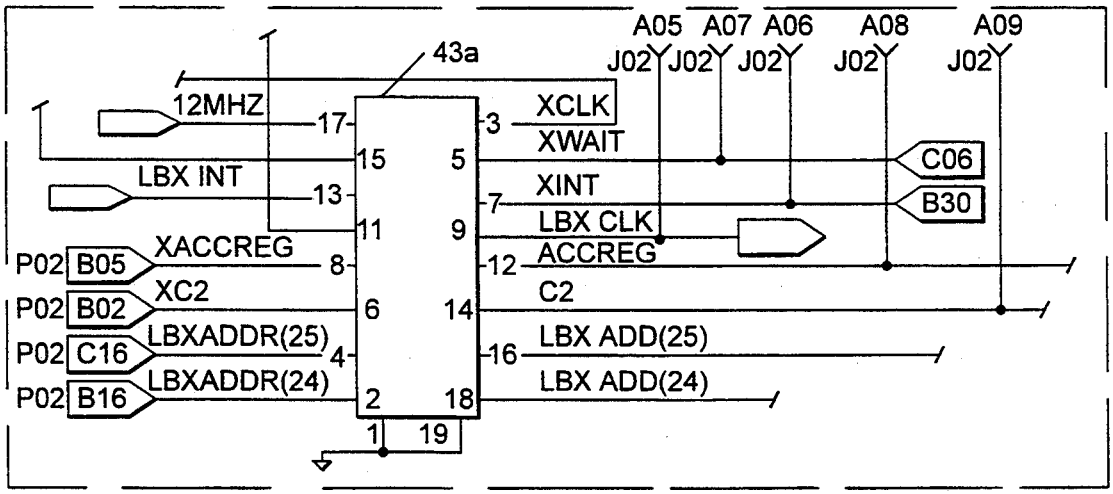
Figure 2D:
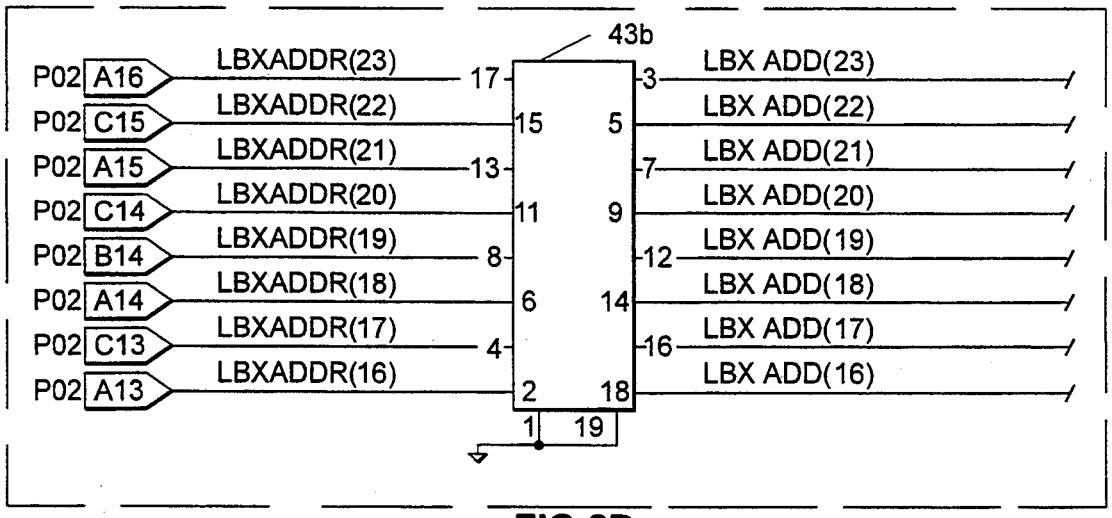
Figure 2E:
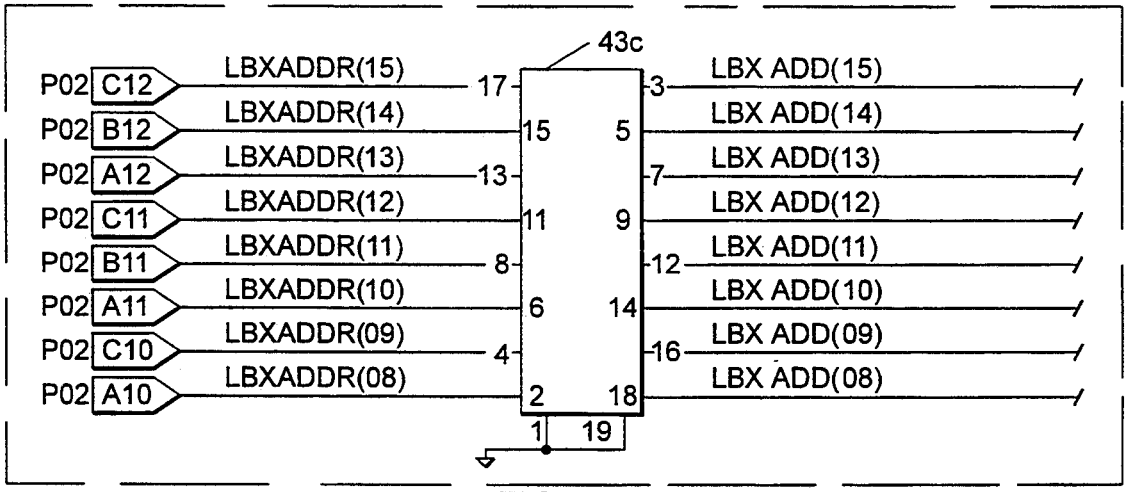
Figure 2F:
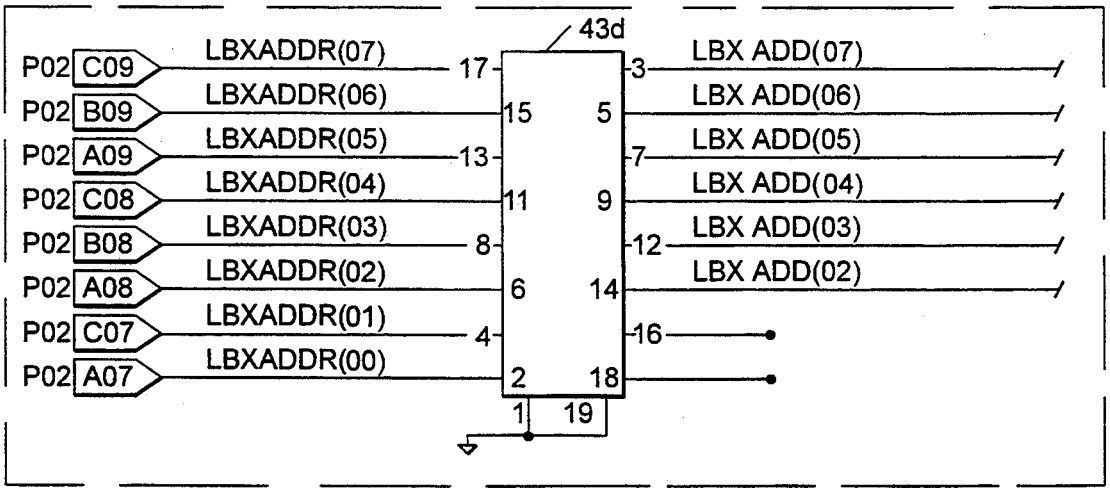
Figure 2G:
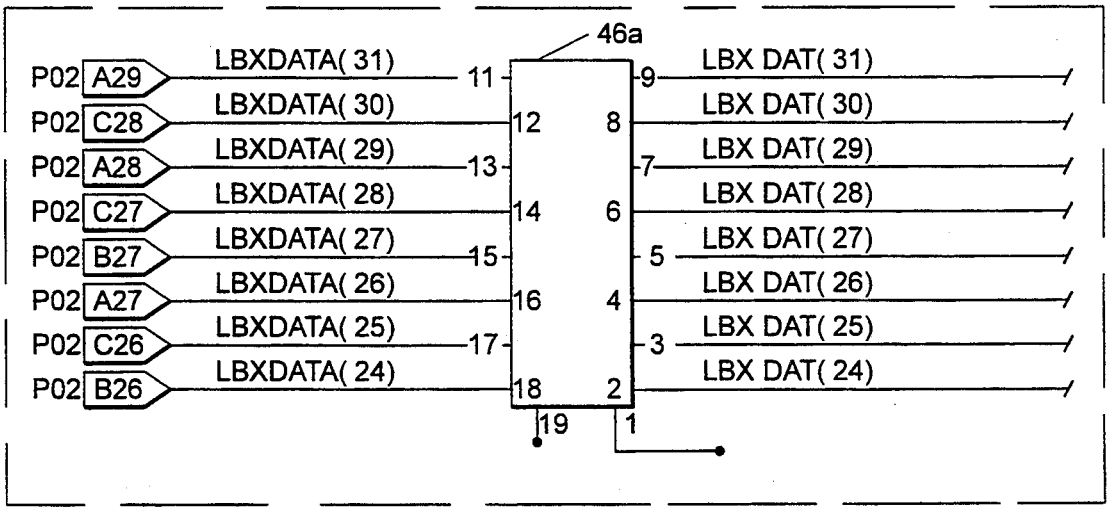
Figure 2H:
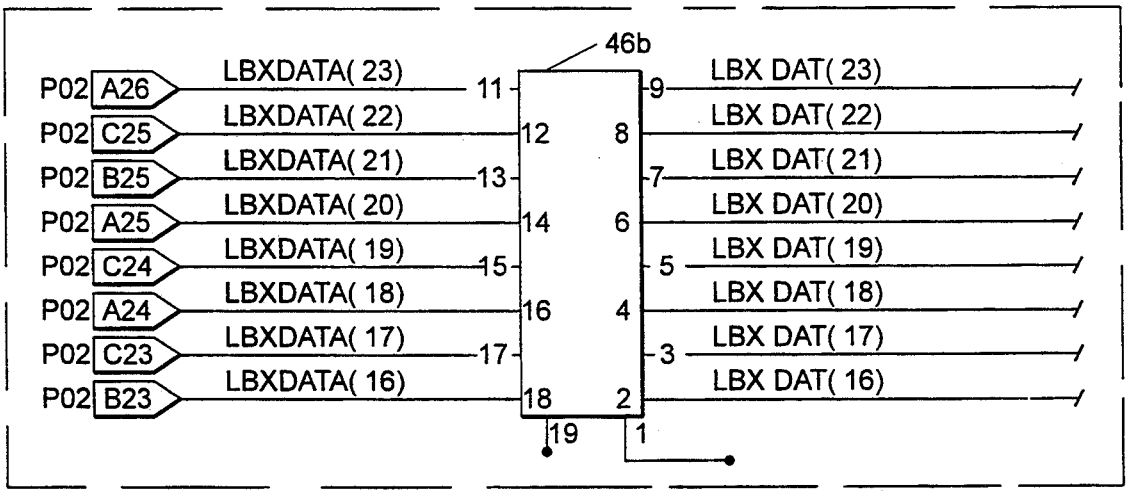
Figure 2I:
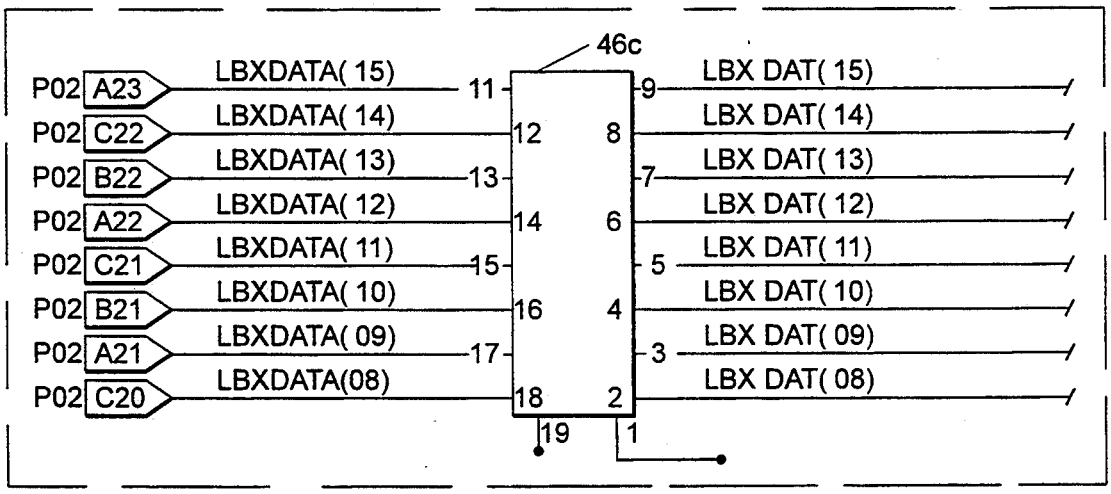
Figure 2J:
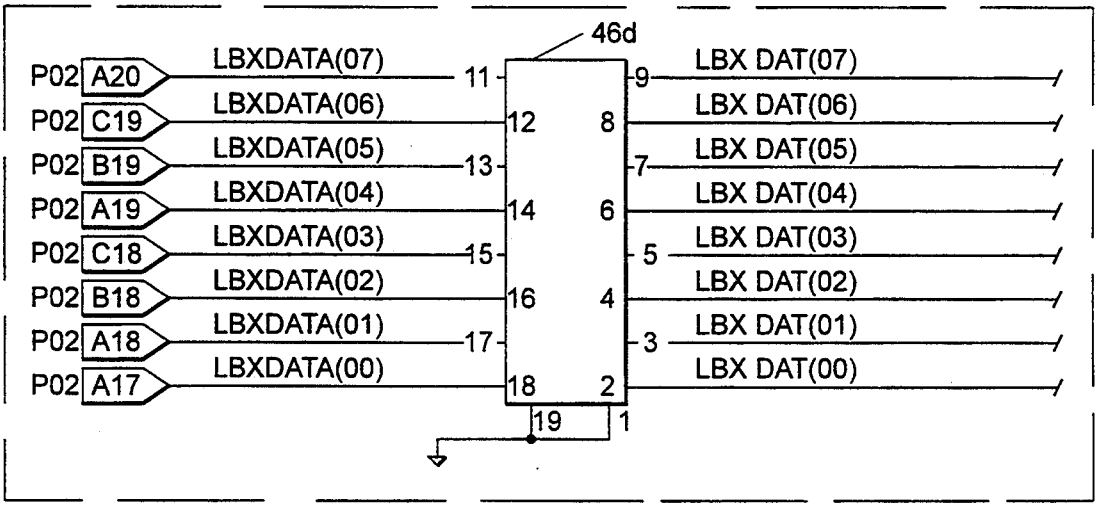
Figure 3A:
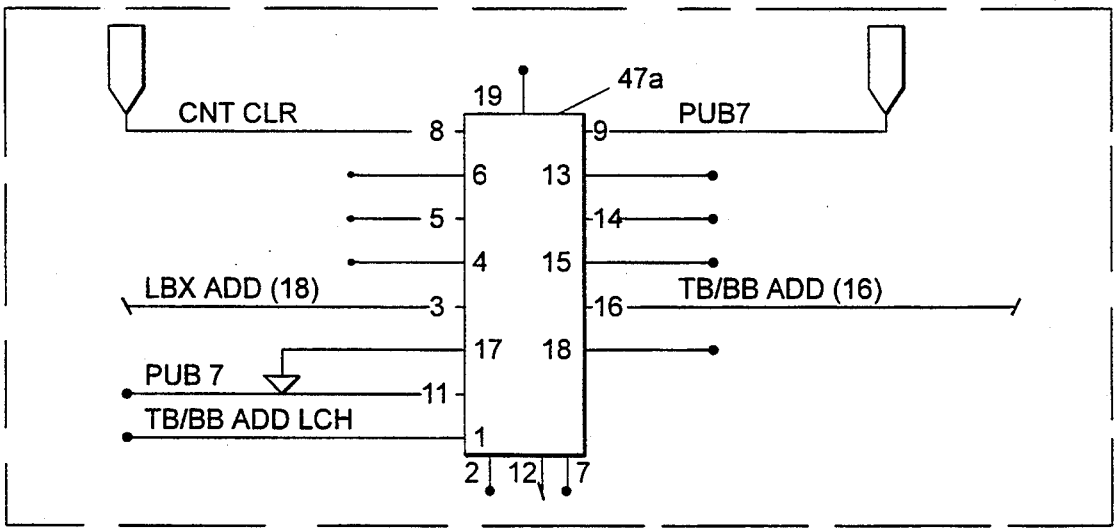
FIGS. 3A thru 3L are circuit diagrams of selected portions of FIG. 3 marked in dotted lines on FIG. 3 which show data flow within those portions.
Figure 3B:
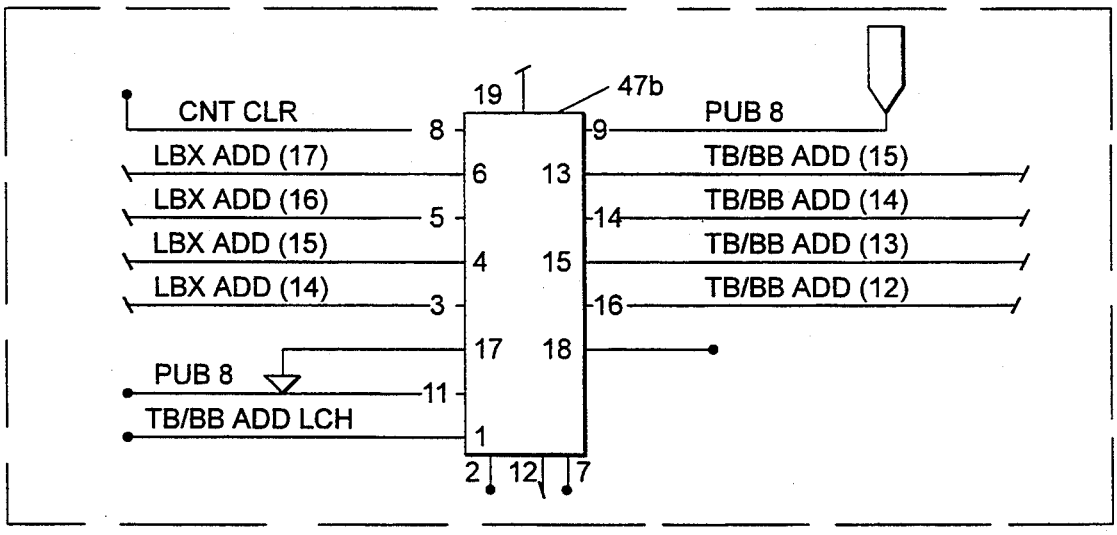
Figure 3C:
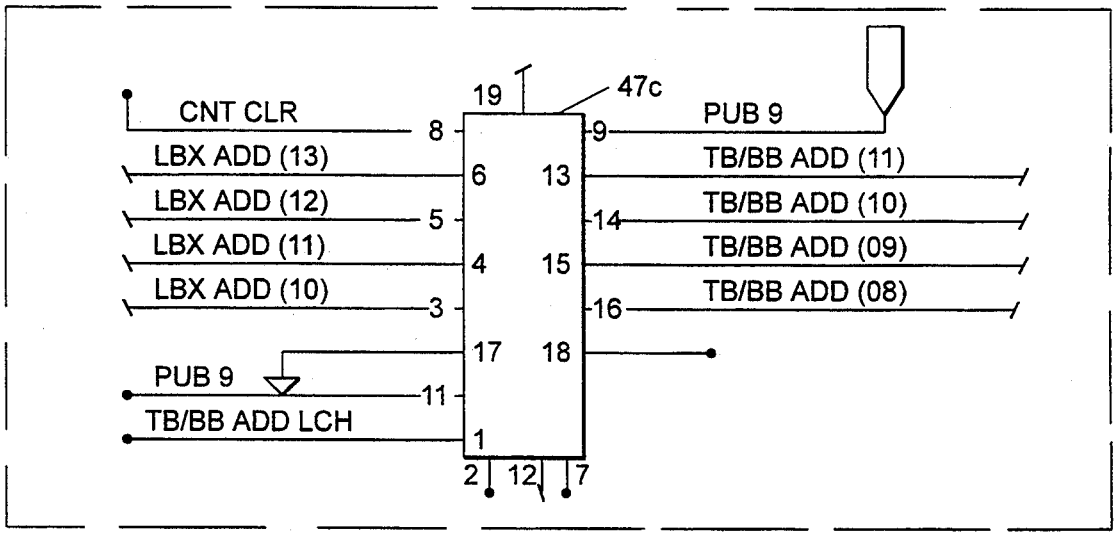
Figure 3D:
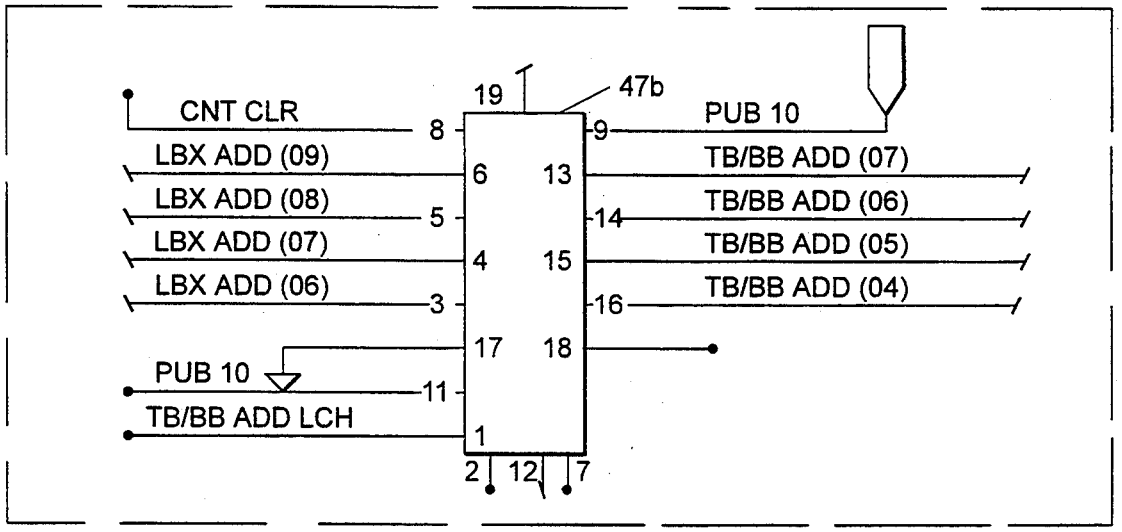
Figure 3E:
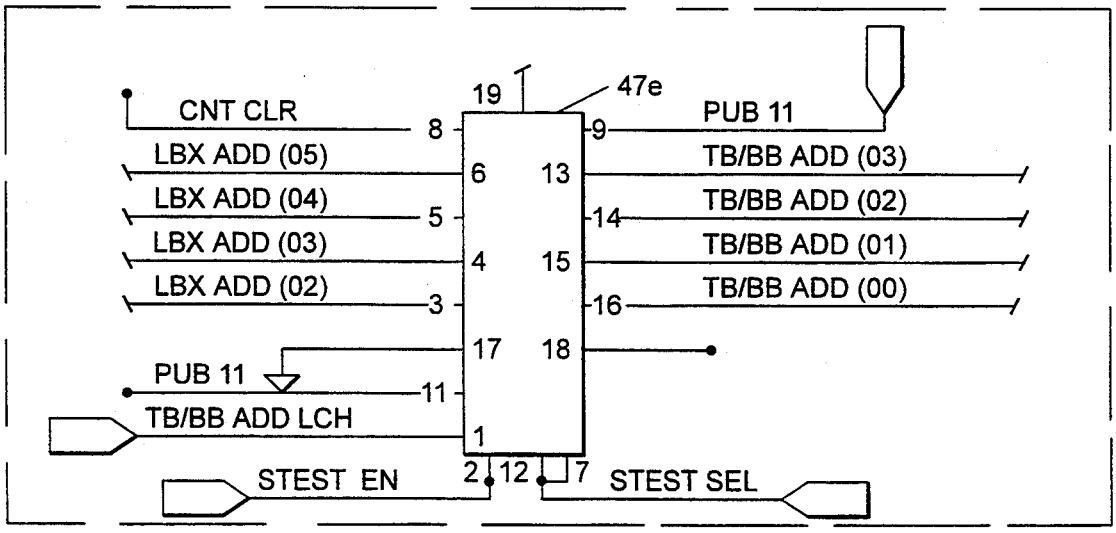
Figure 3F:
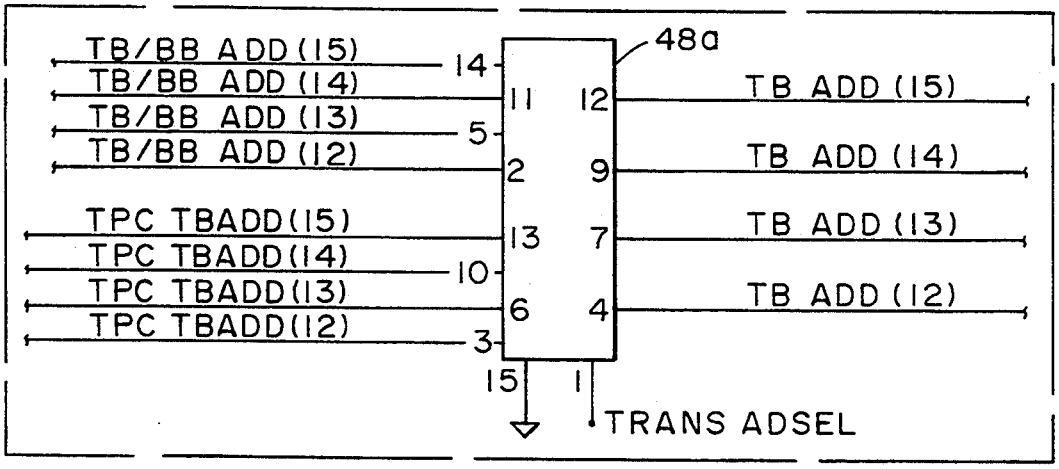
Figure 3G:
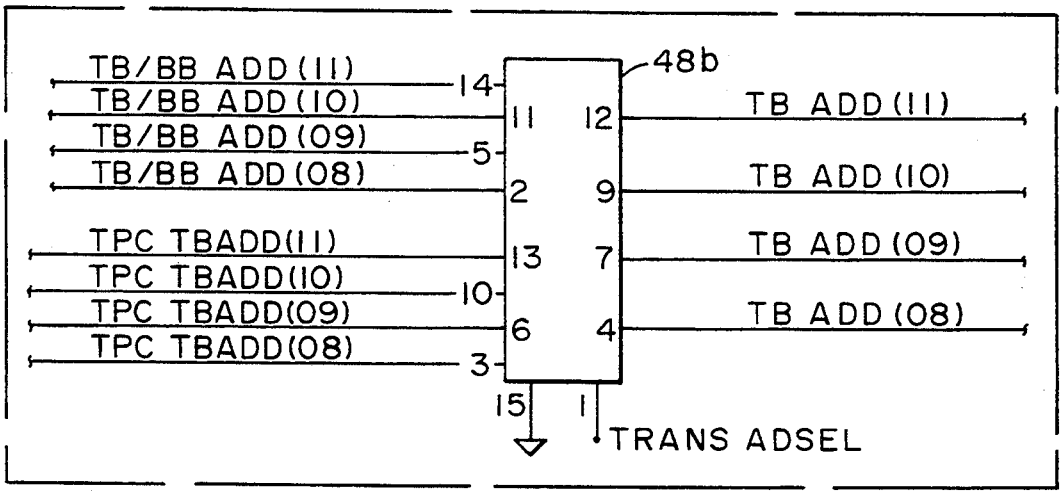
Figure 3H:
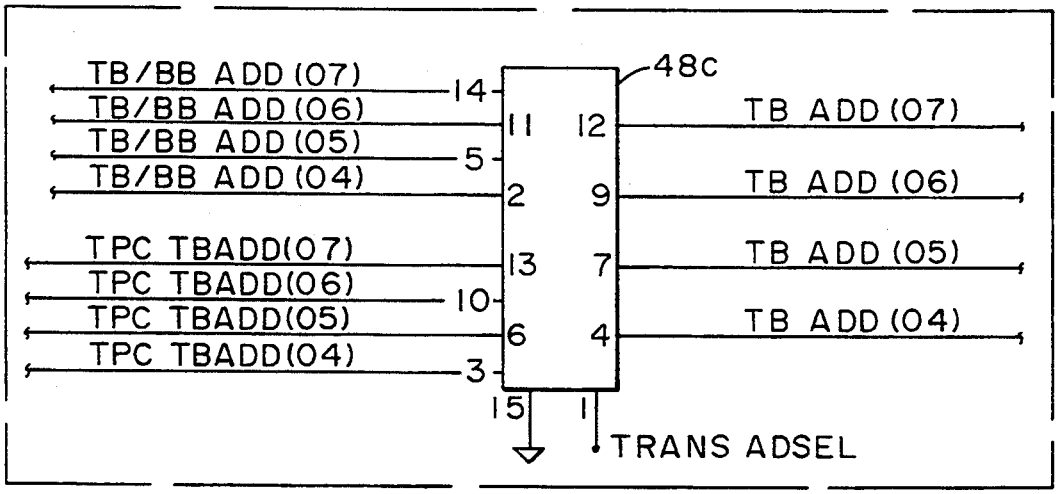
Figure 3I:
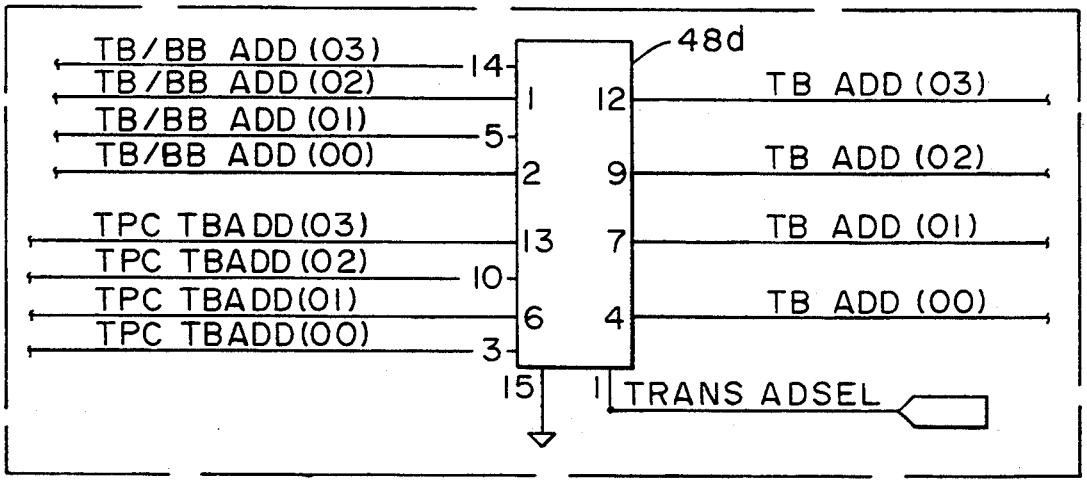
Figure 3J:
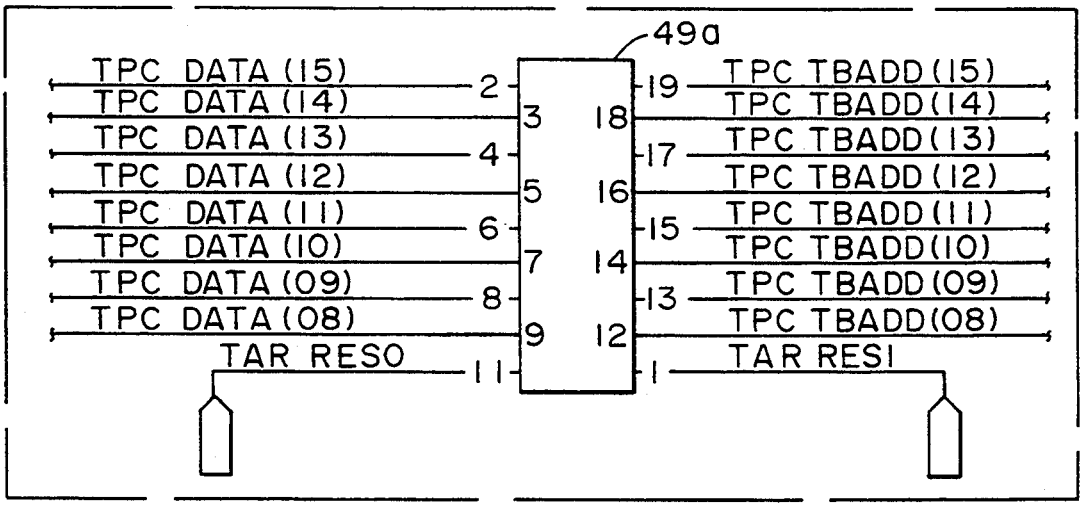
Figure 3K:
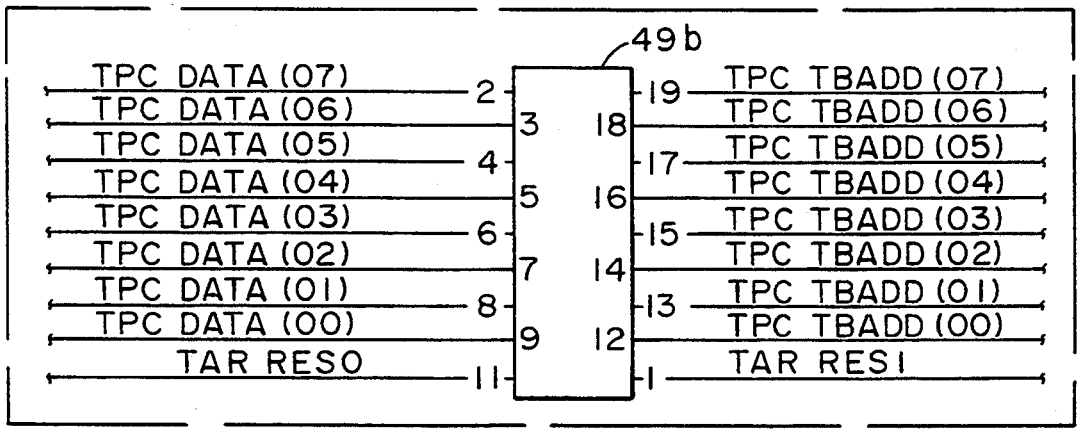
Figure 3L:
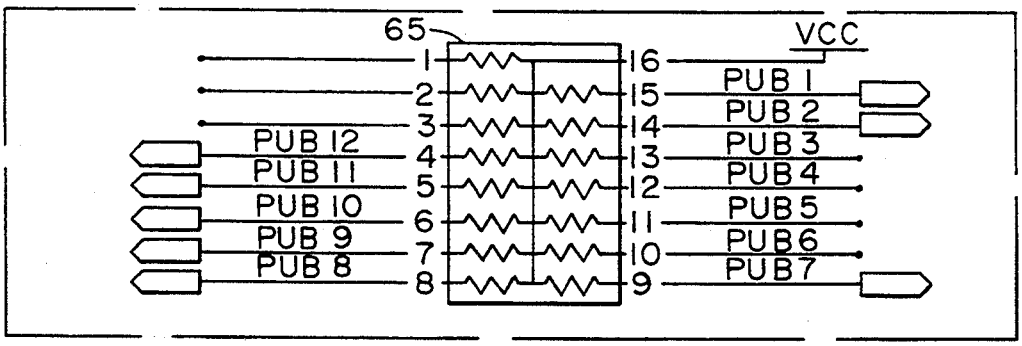
Figure 4A:
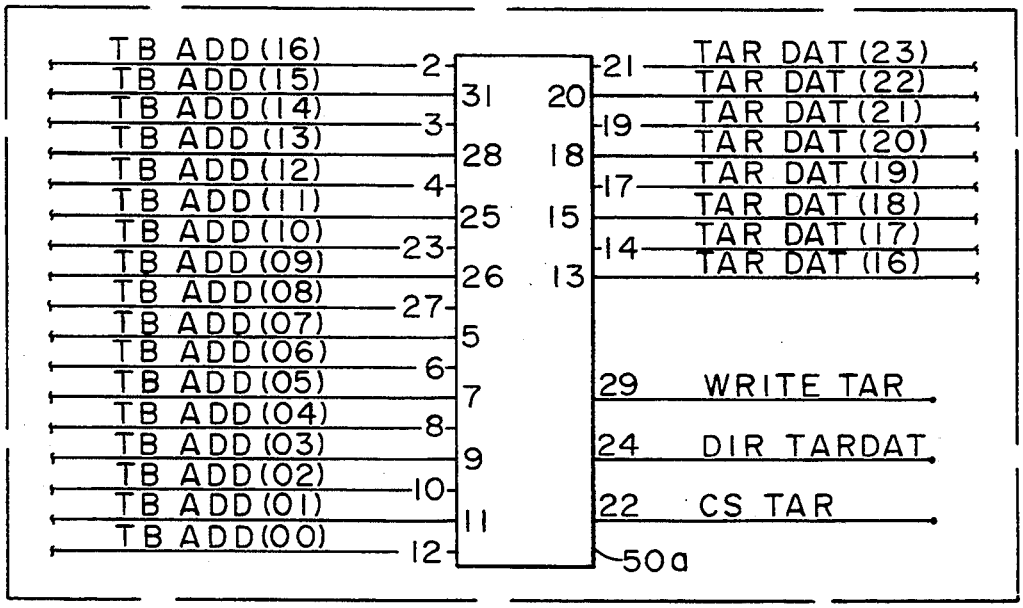
FIGS. 4A thru 4F are circuit diagrams of selected portions of FIG. 4 marked in dotted lines on FIG. 4 which show data flow within those portions.
Figure 4B:
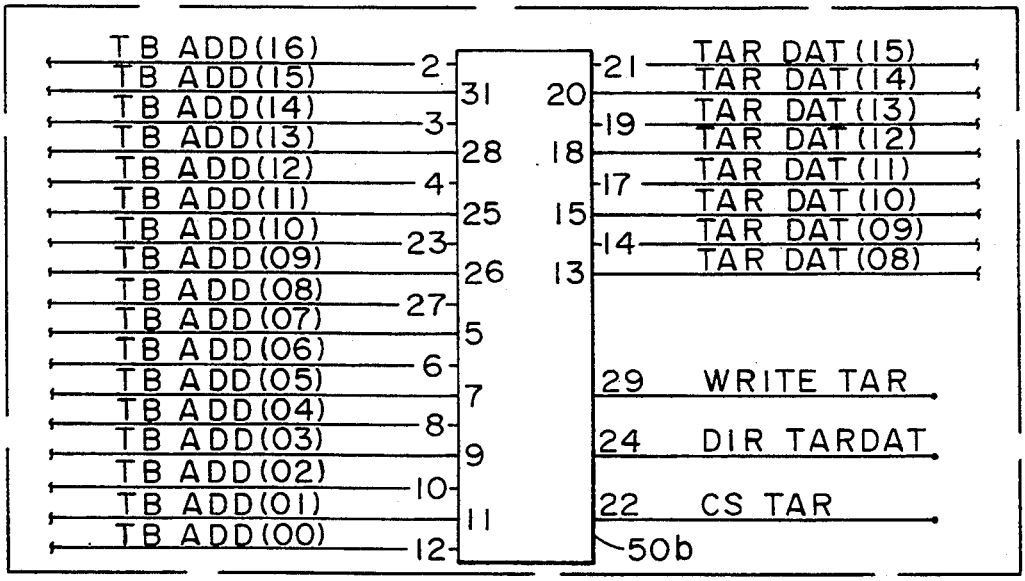
Figure 4C:
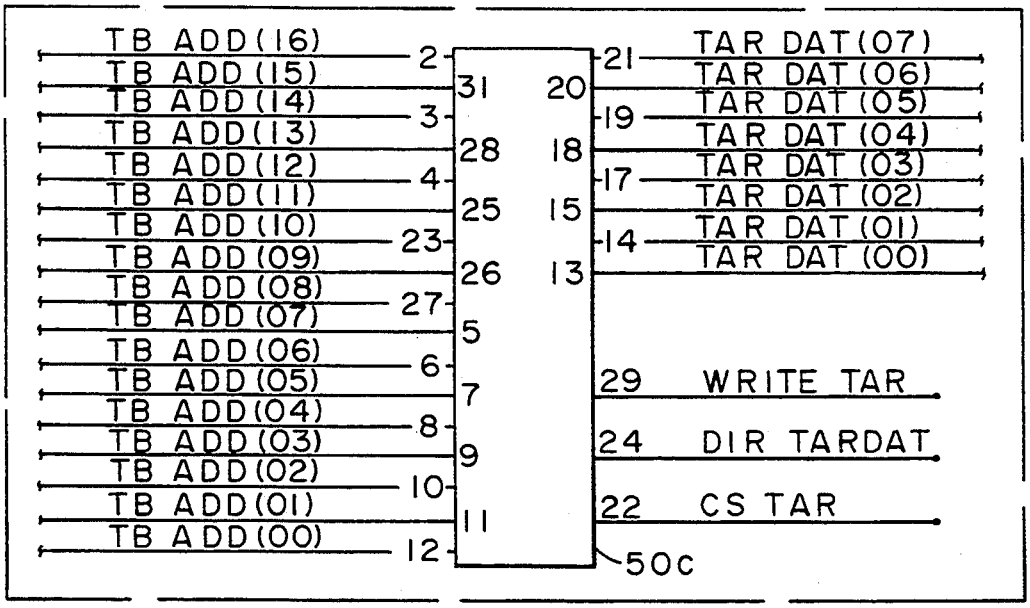
Figure 4D:
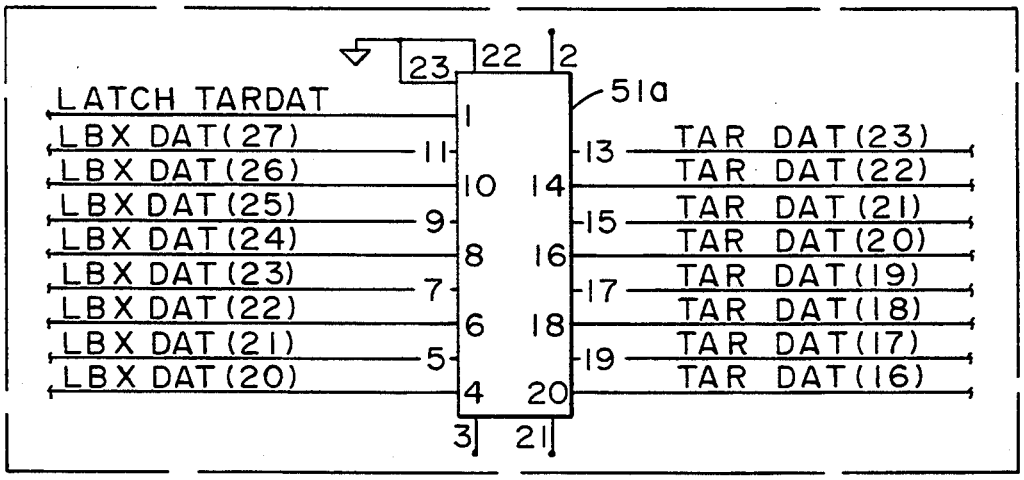
Figure 4E:
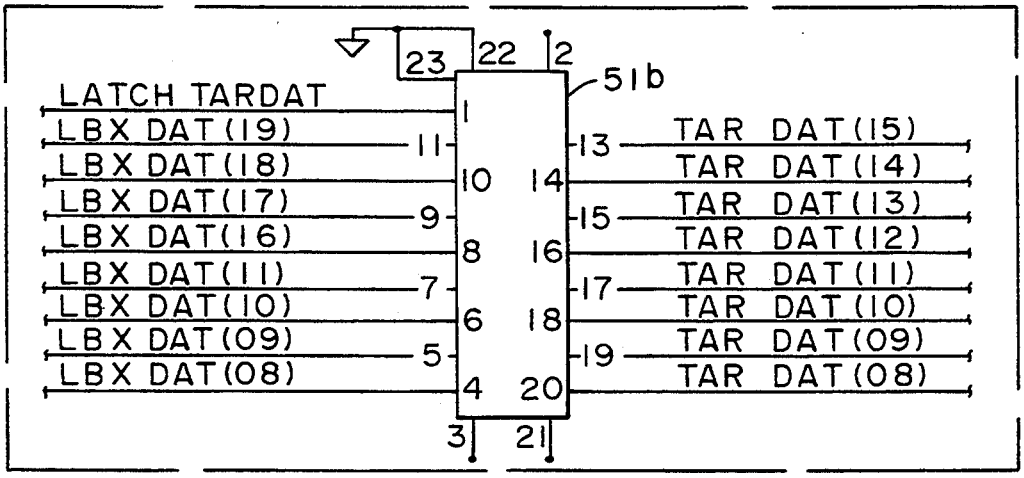
Figure 4F:
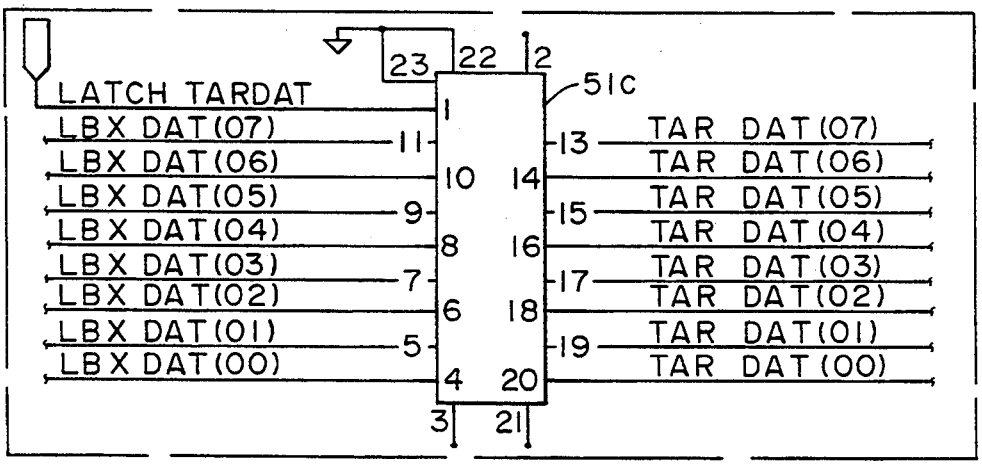
Figure 5A:
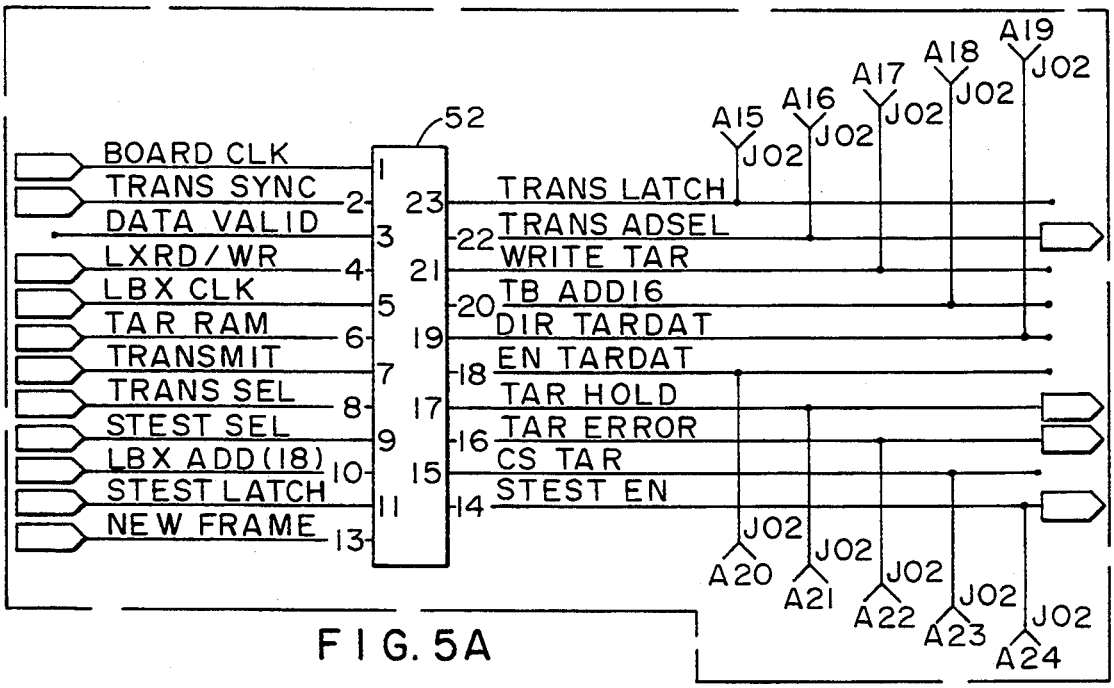
FIGS. 5A thru 5D are circuit diagrams of selected portions of FIG. 5 marked in dotted lines on FIG. 5 which show data flow within those portions.
Figure 5H:
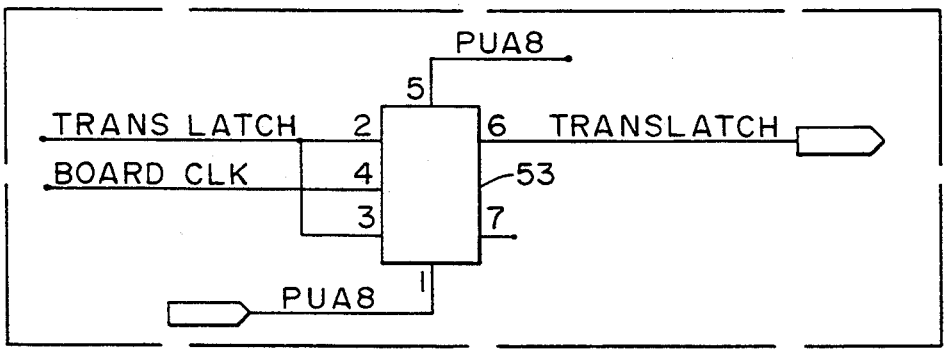
Figure 5C:
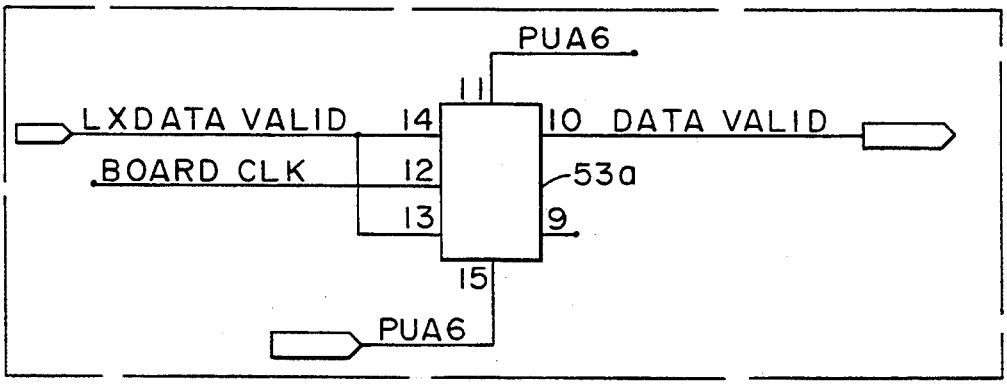
Figure 5D:
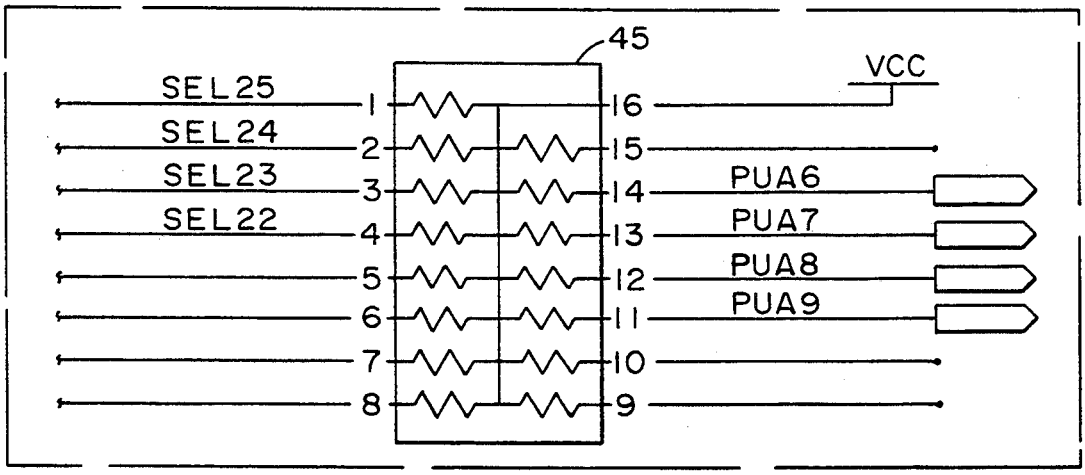
Figure 6A:
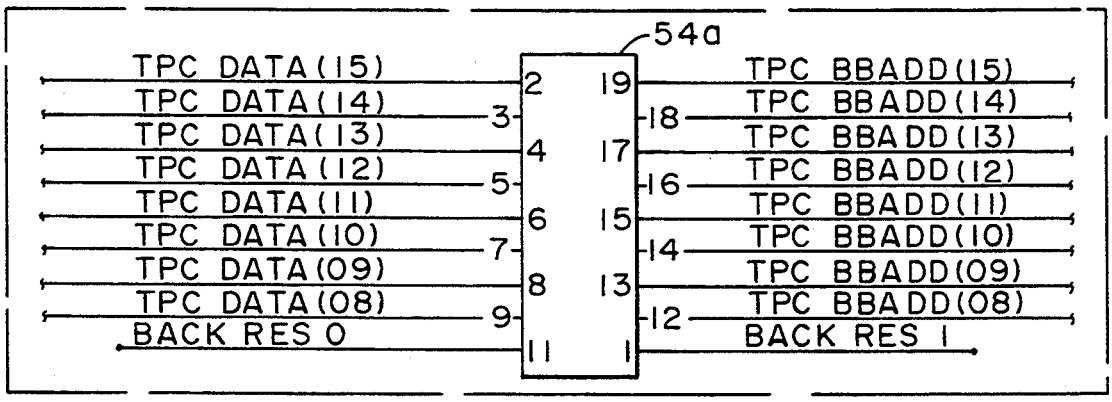
FIGS. 6A thru 6L are circuit diagrams of selected portions of FIG. 6 marked in dotted lines on FIG. 6 which show data flow within those portions.
Figure 6B:
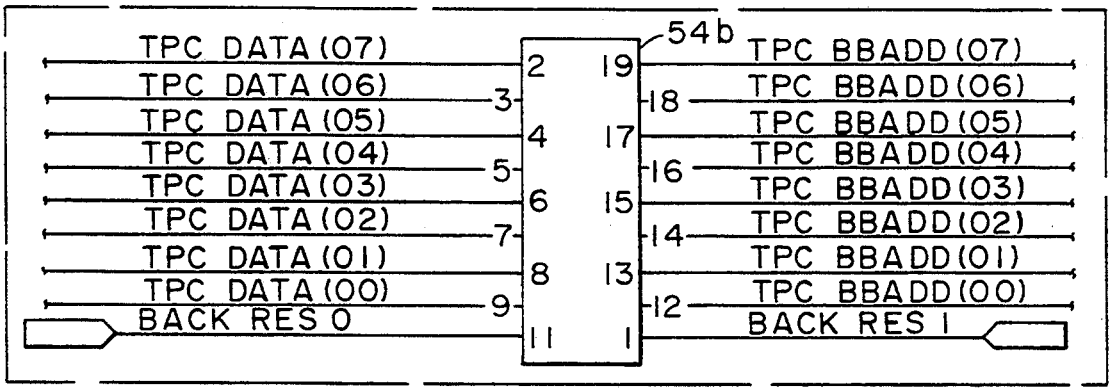
Figure 6C:
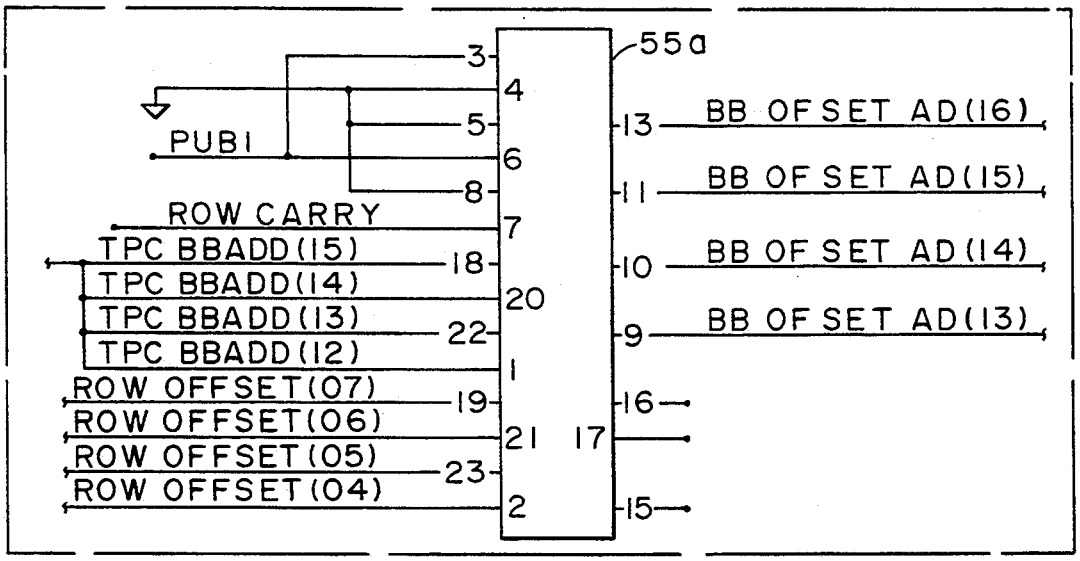
Figure 6D:
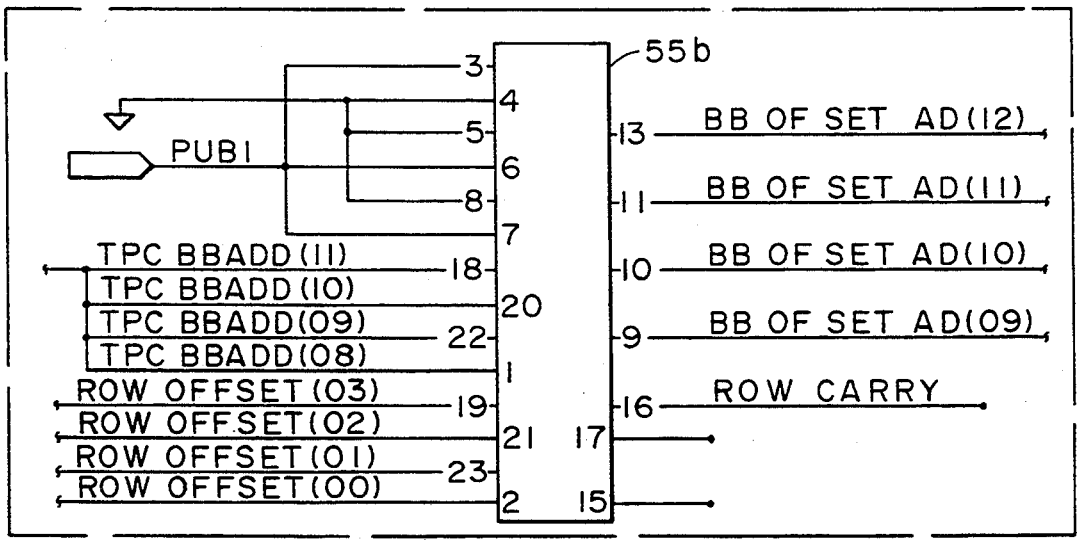
Figure 6E:
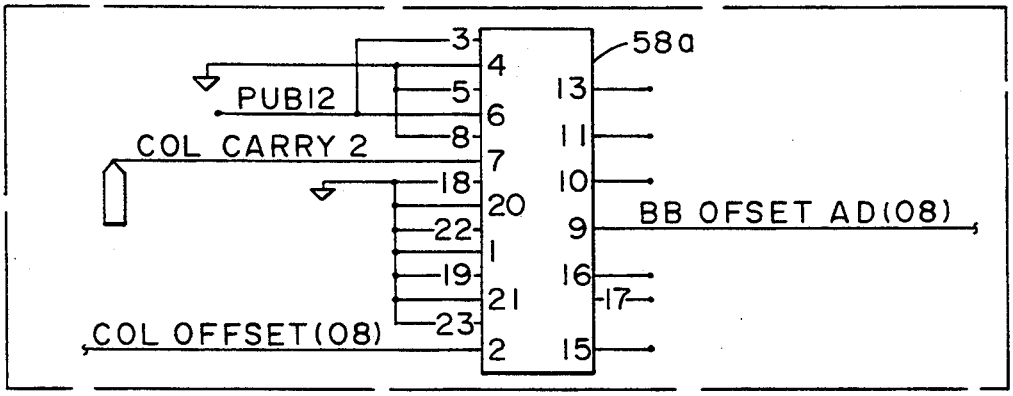
Figure 6F:
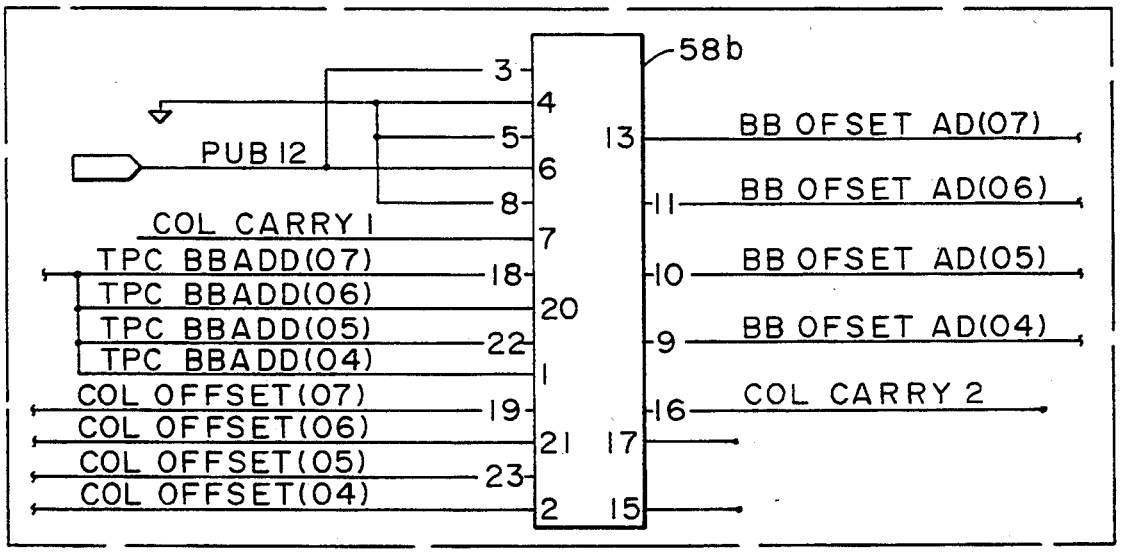
Figure 6G:
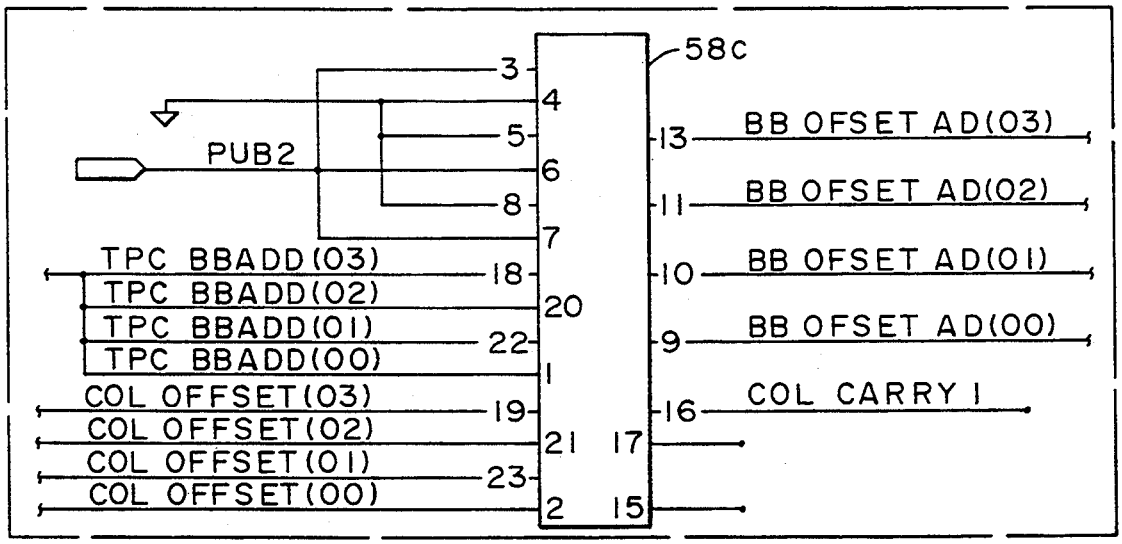
Figure 6H:
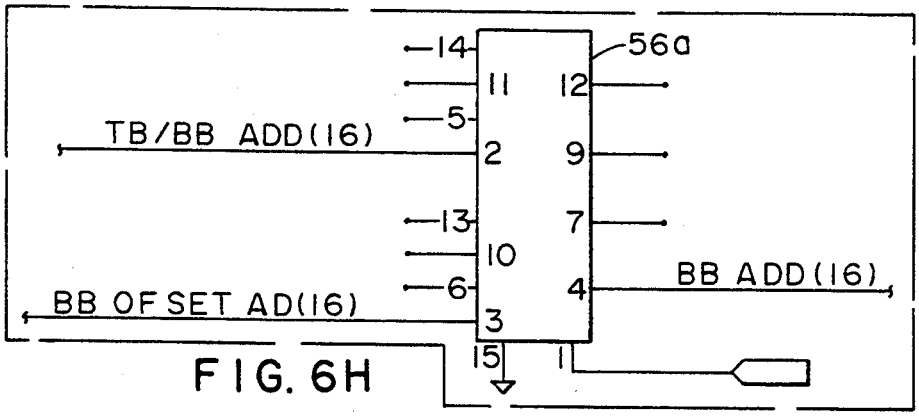
Figure 6I:
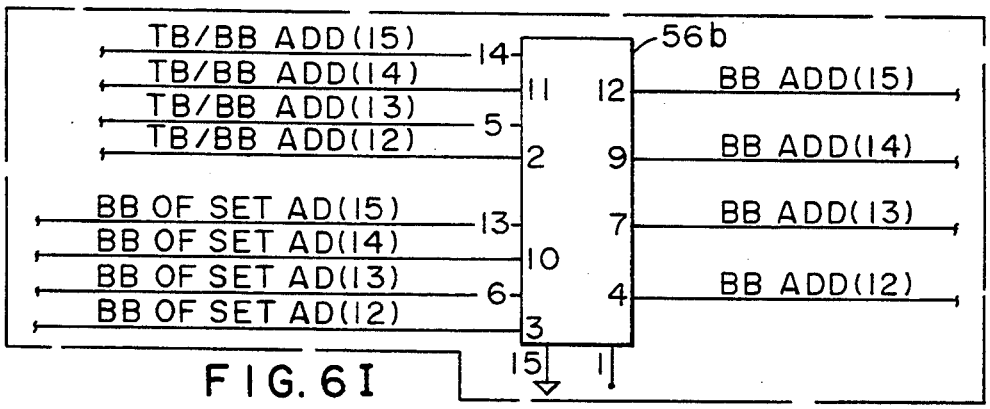
Figure 6J:
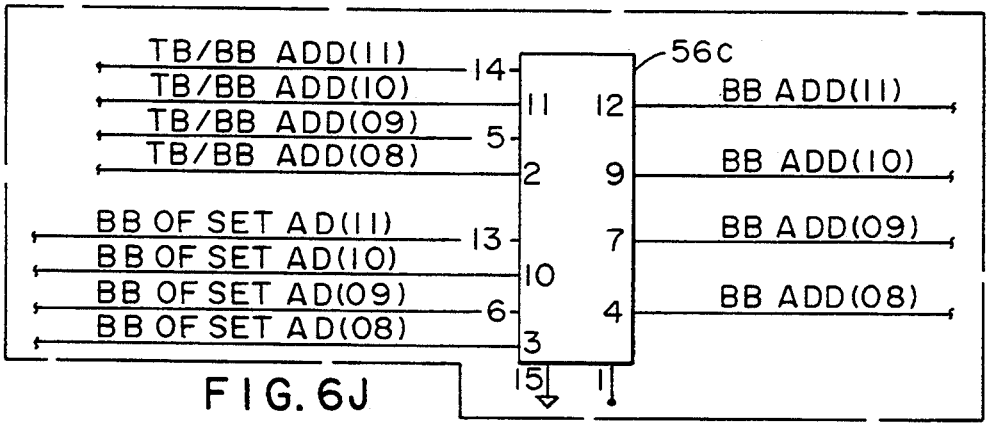
Figure 6K:
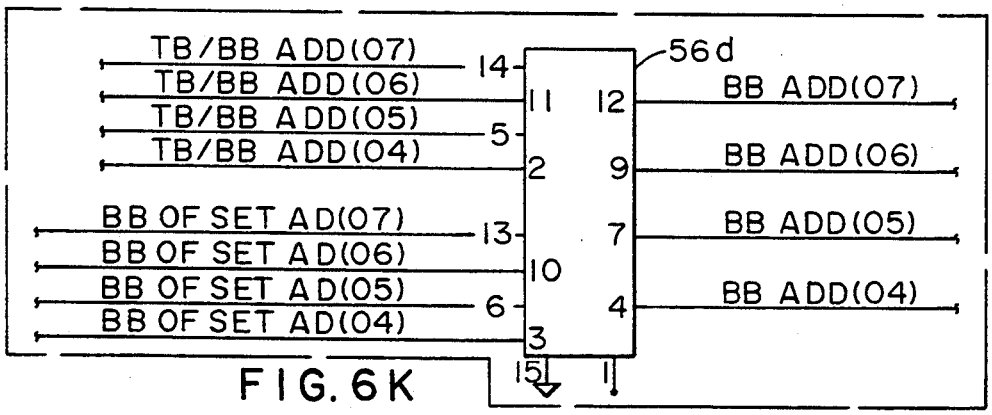
Figure 6L:
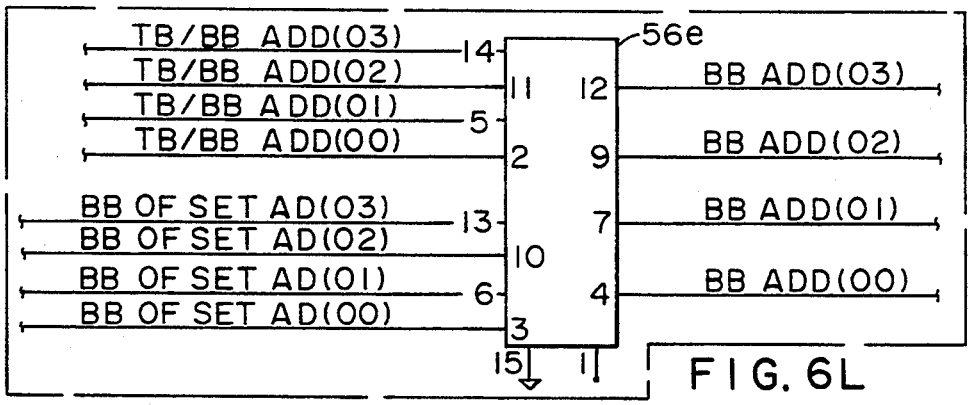
Figure 7A:
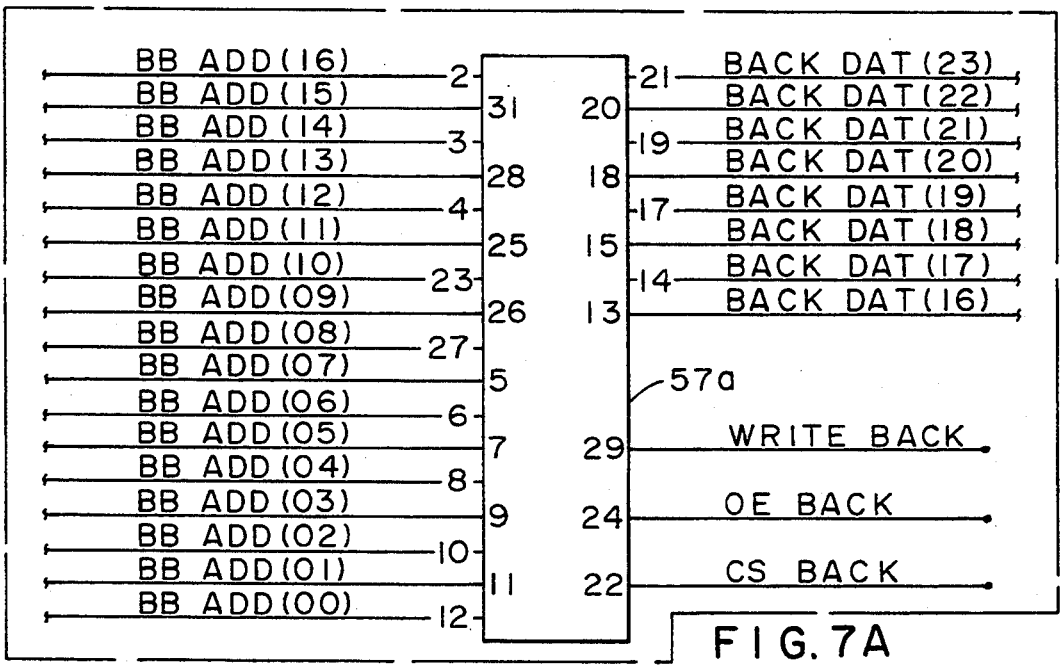
FIGS. 7A thru 7F are circuit diagrams of selected portions of FIG. 7 marked in dotted lines on FIG. 7 which show data flow within those portions.
Figure 7B:
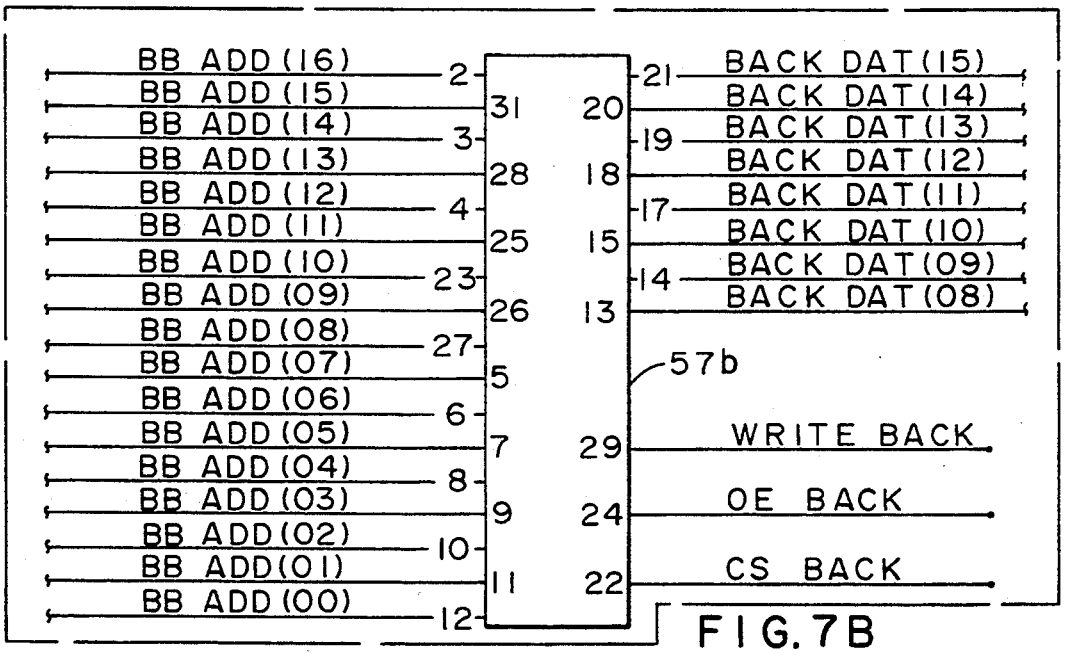
Figure 7C:
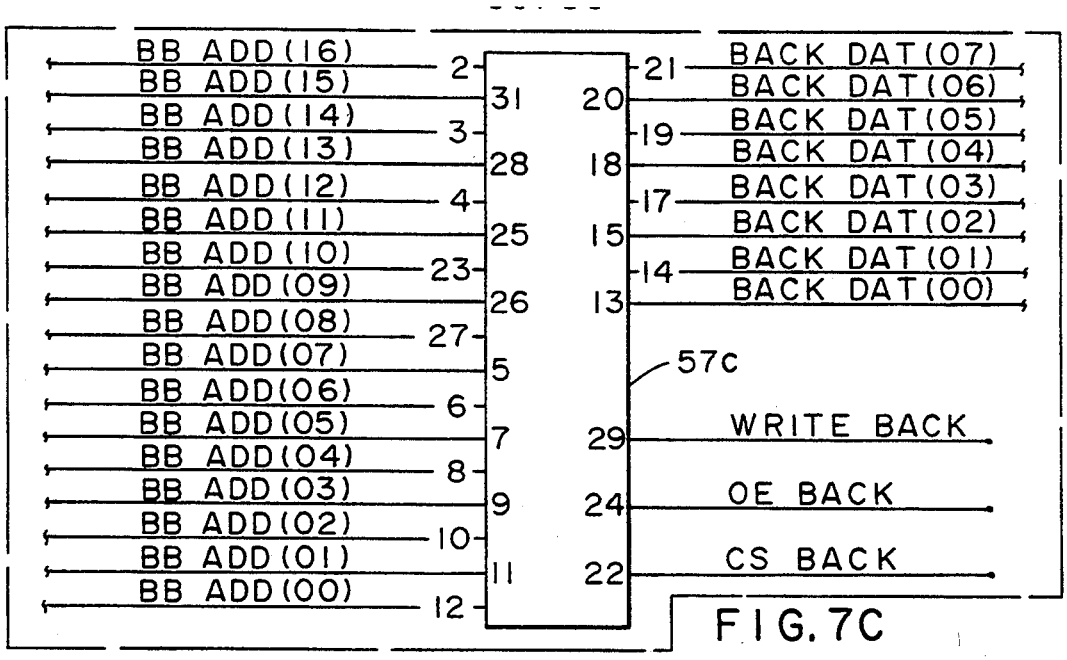
Figure 7D:
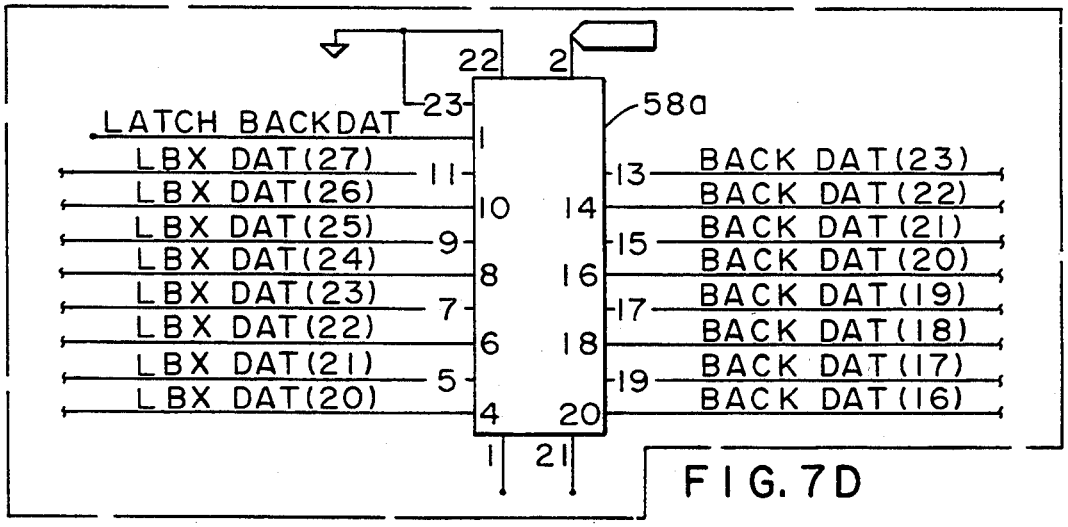
Figure 7E:
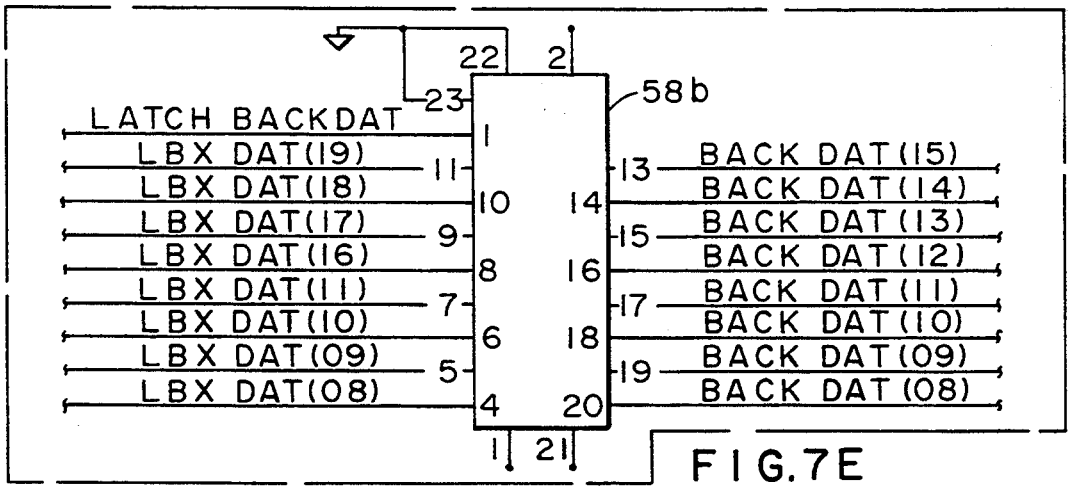
Figure 7F:
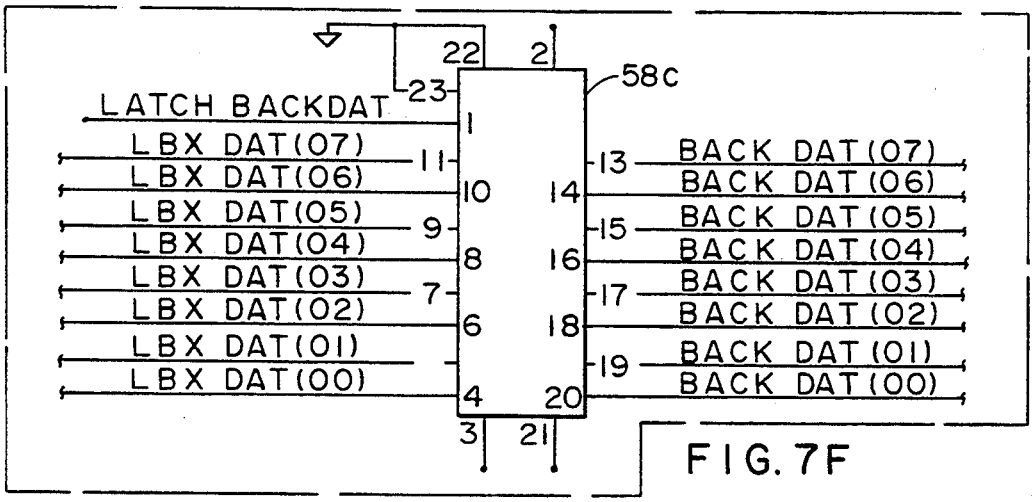
Figure 8A:
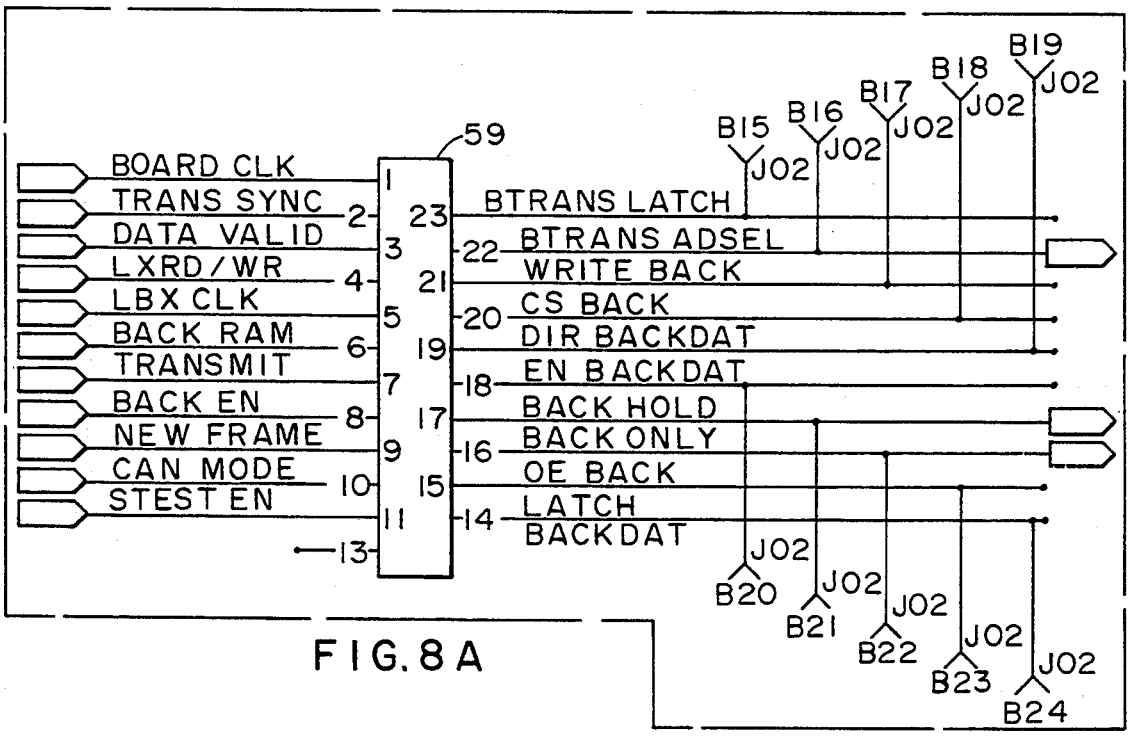
FIG. 8A is the circuit diagram of FIG. 8 on which data flow is shown.
Figure 9A:
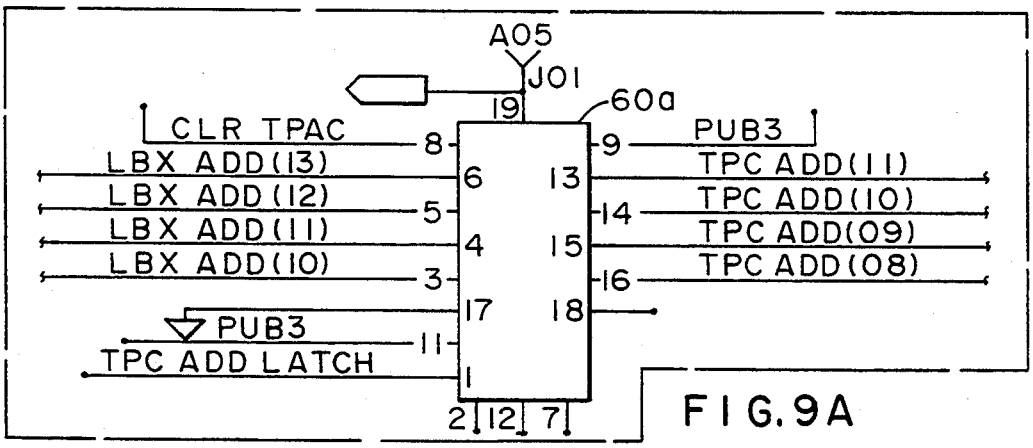
FIGS. 9A thru 9I are circuit diagrams of selected portions of FIG. 9 marked in dotted lines on FIG. 9 which show data flow within those portions.
Figure 9B:
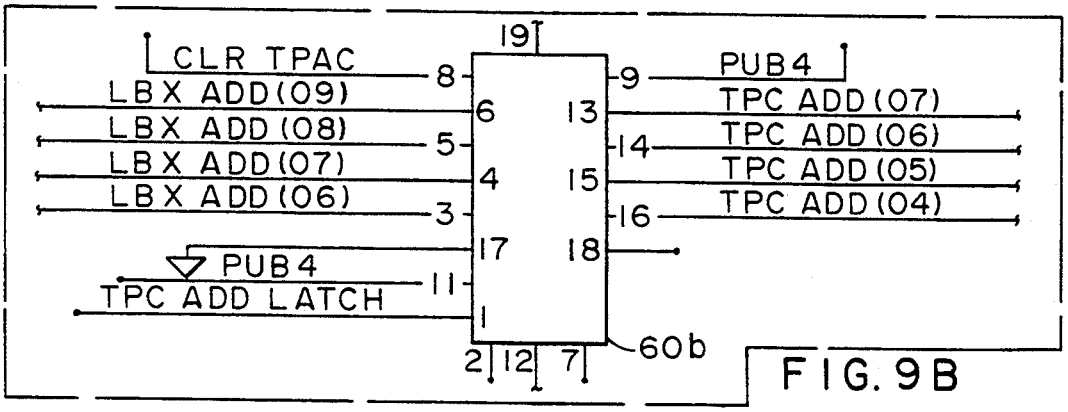
Figure 9C:
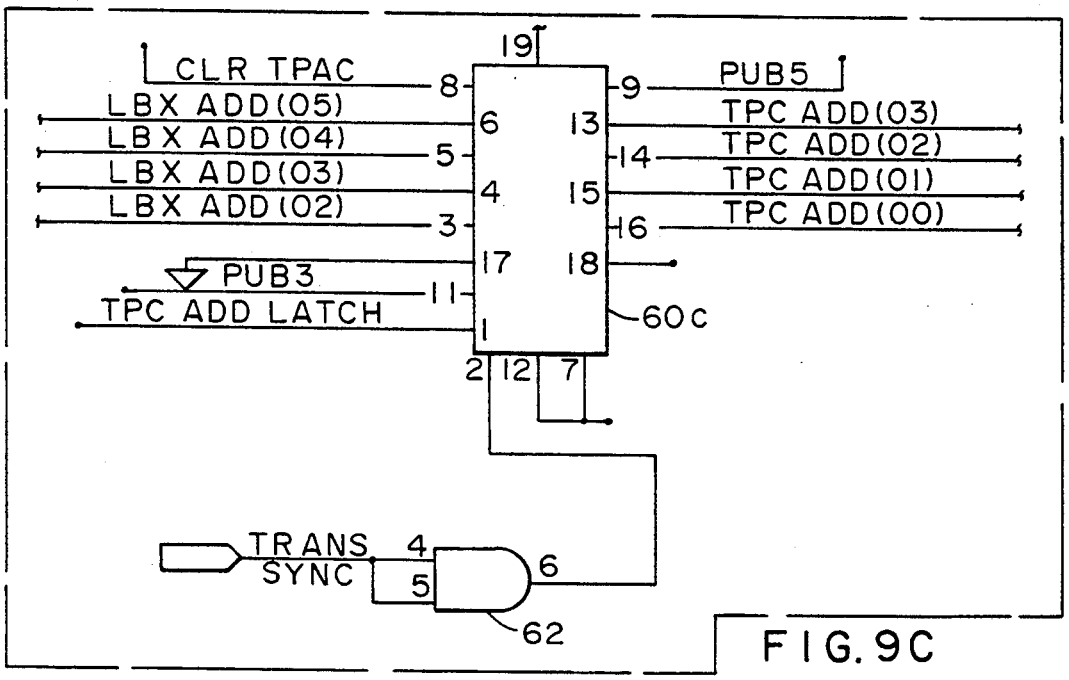
Figure 9D:
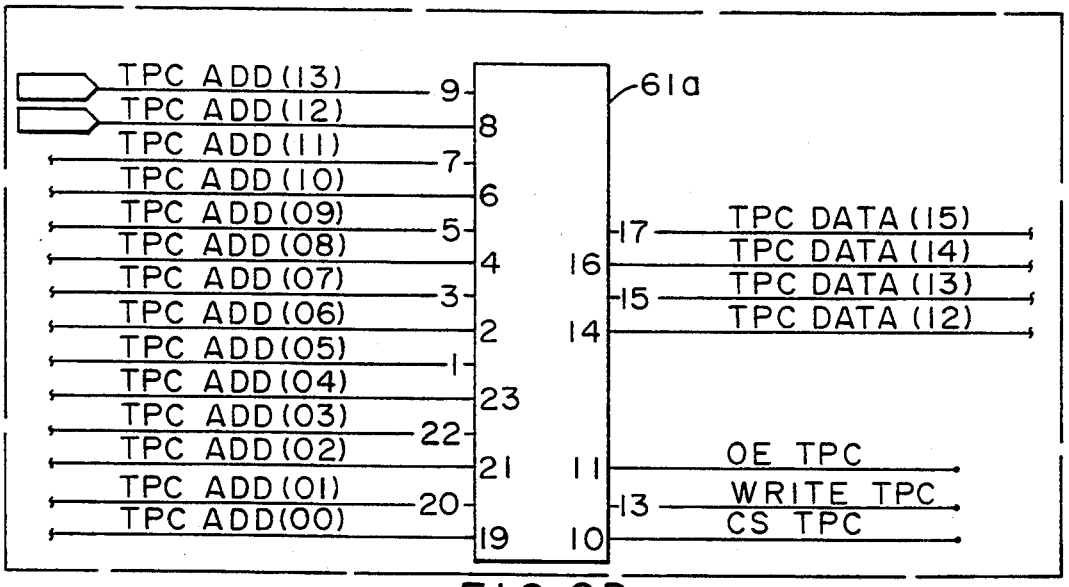
Figure 9E:
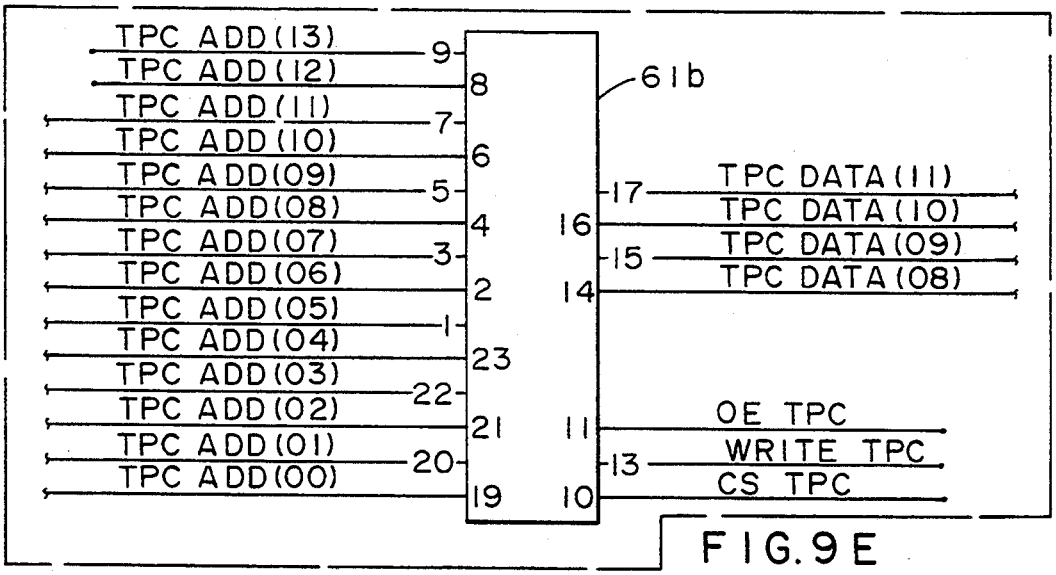
Figure 9F:
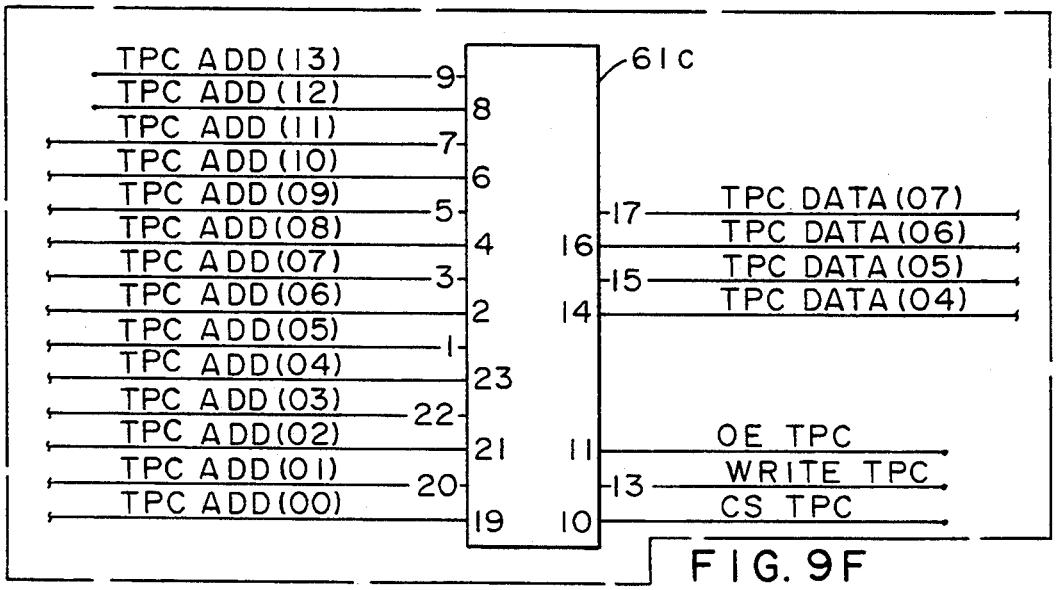
Figure 9G:
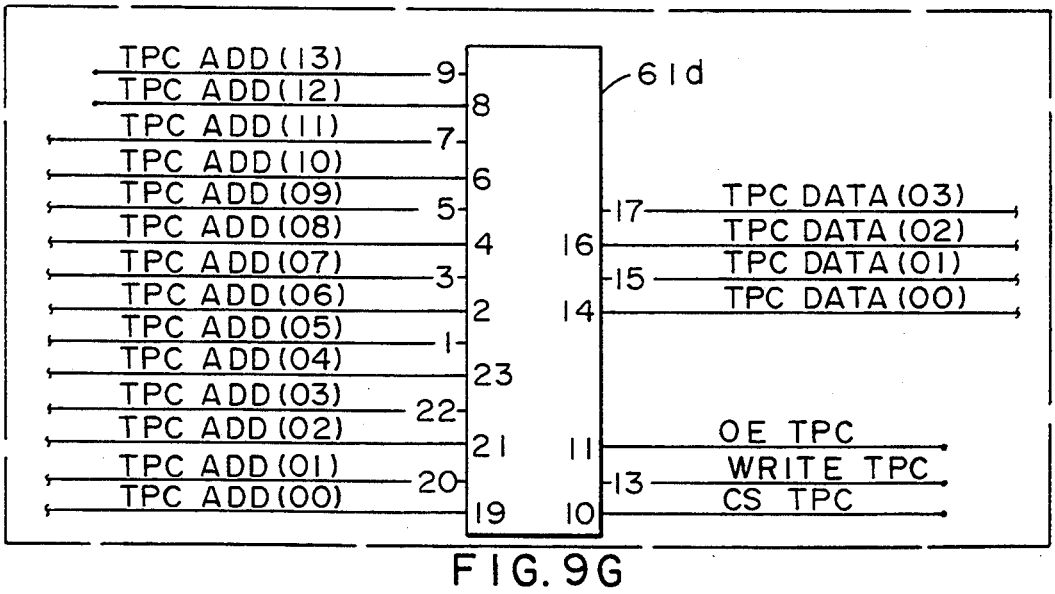
Figure 9H:
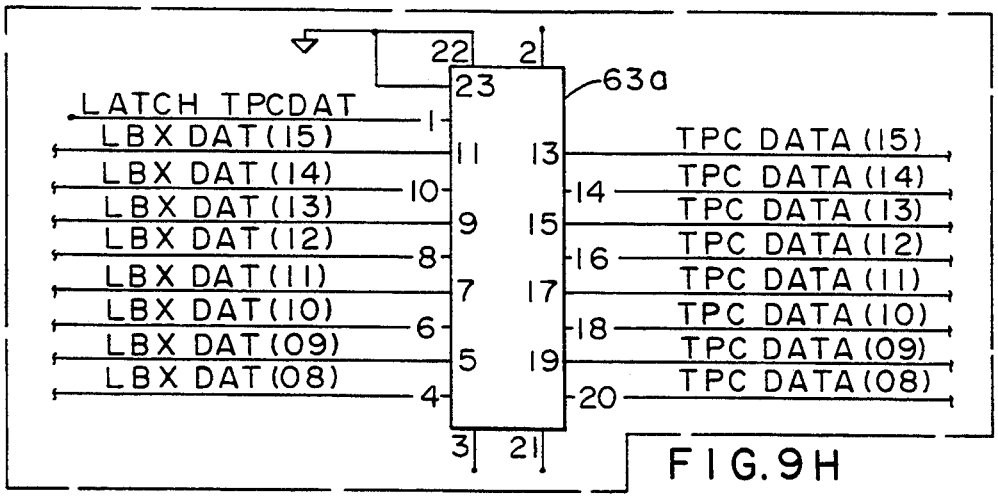
Figure 9I:
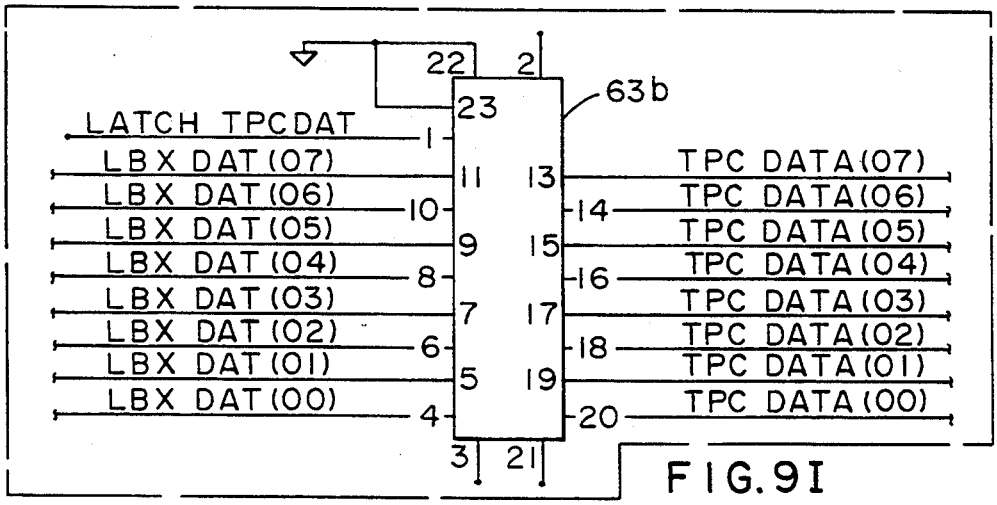
Figure 10A:
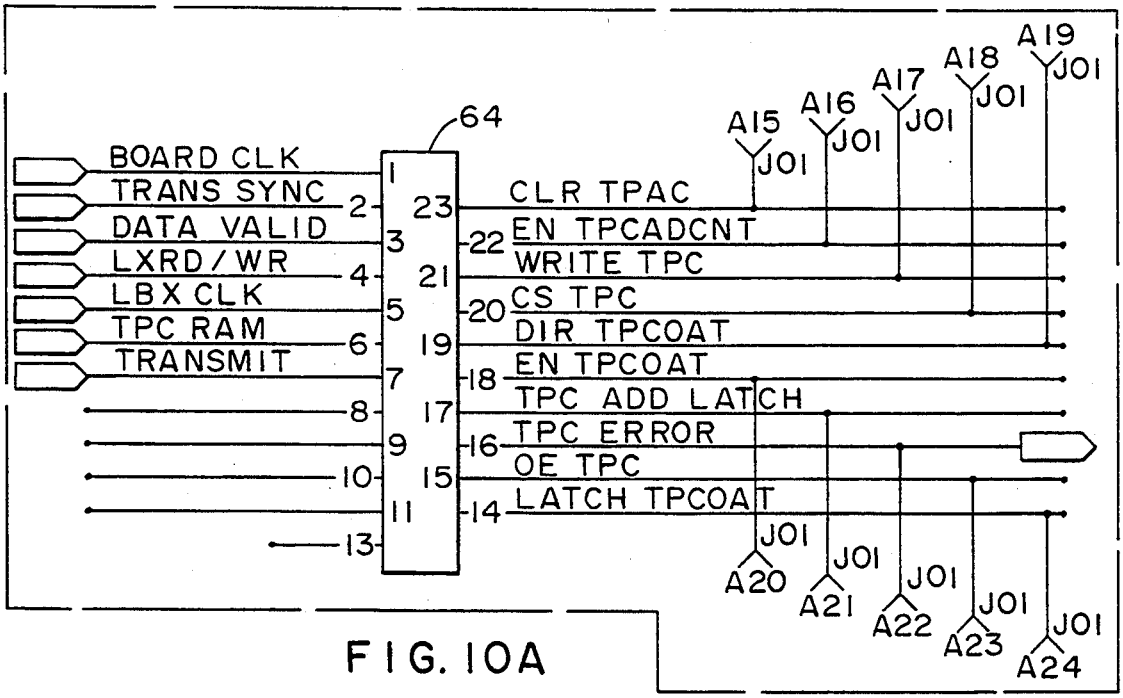
Figure 11A:
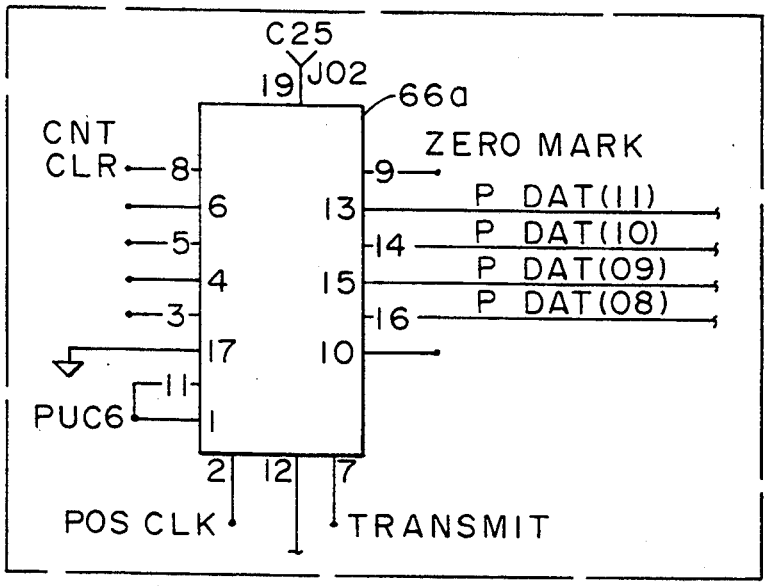
Figure 11B:
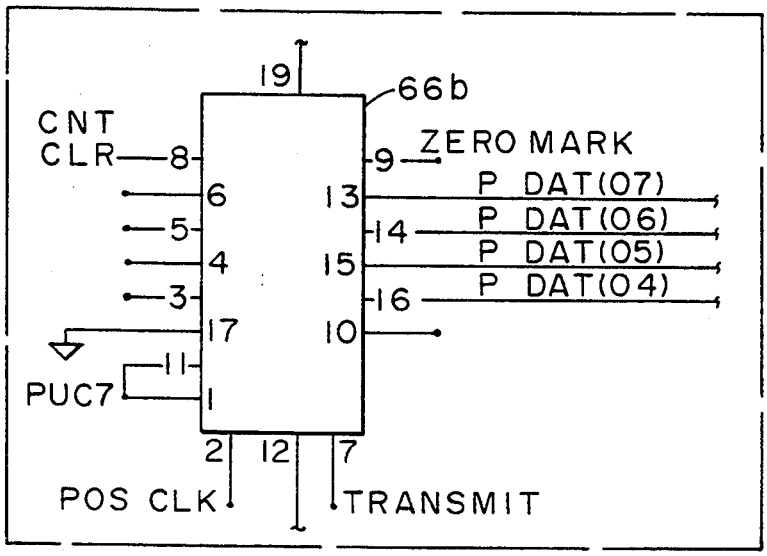
Figure 11C:
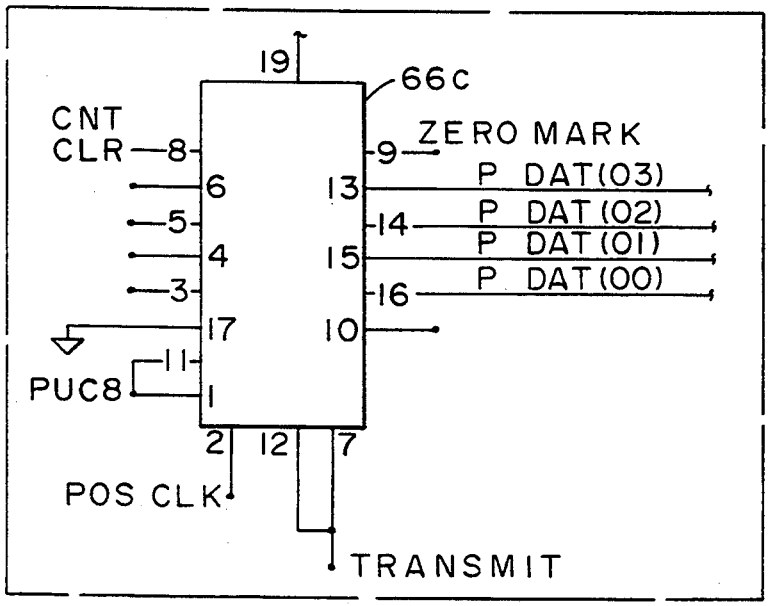
Figure 11D:
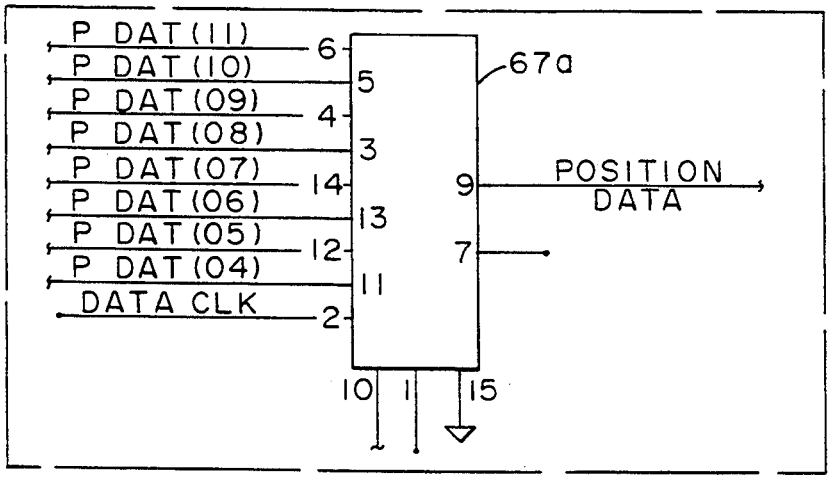
Figure 11E:
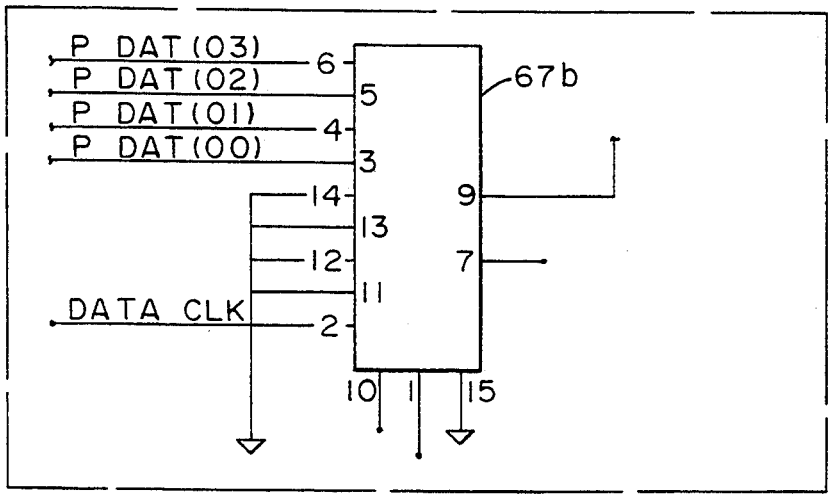
Figure 11F:
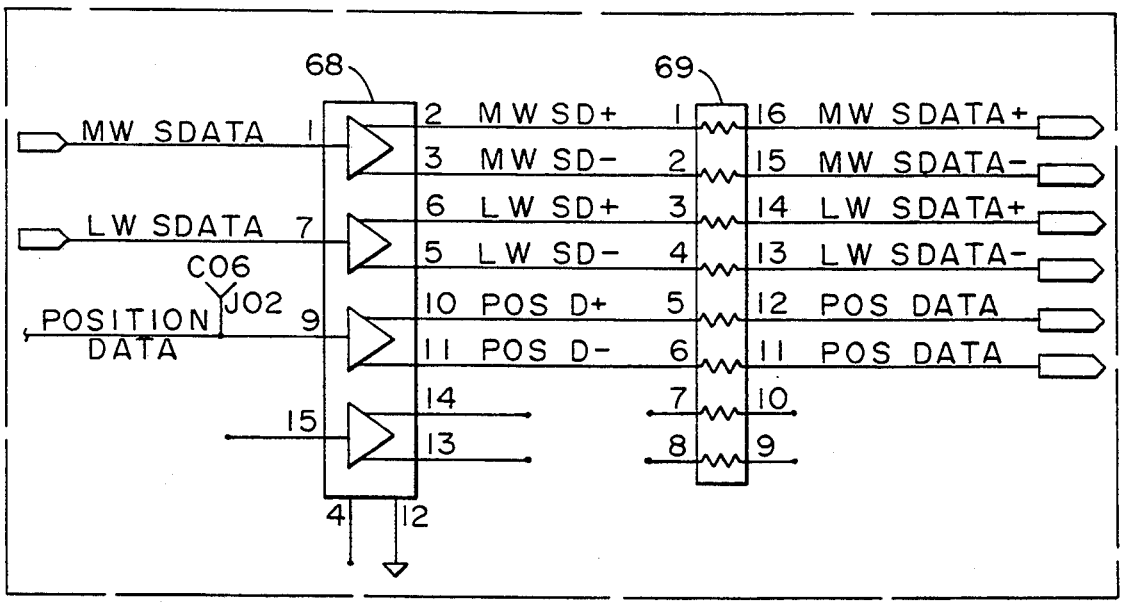
Figure 12A:
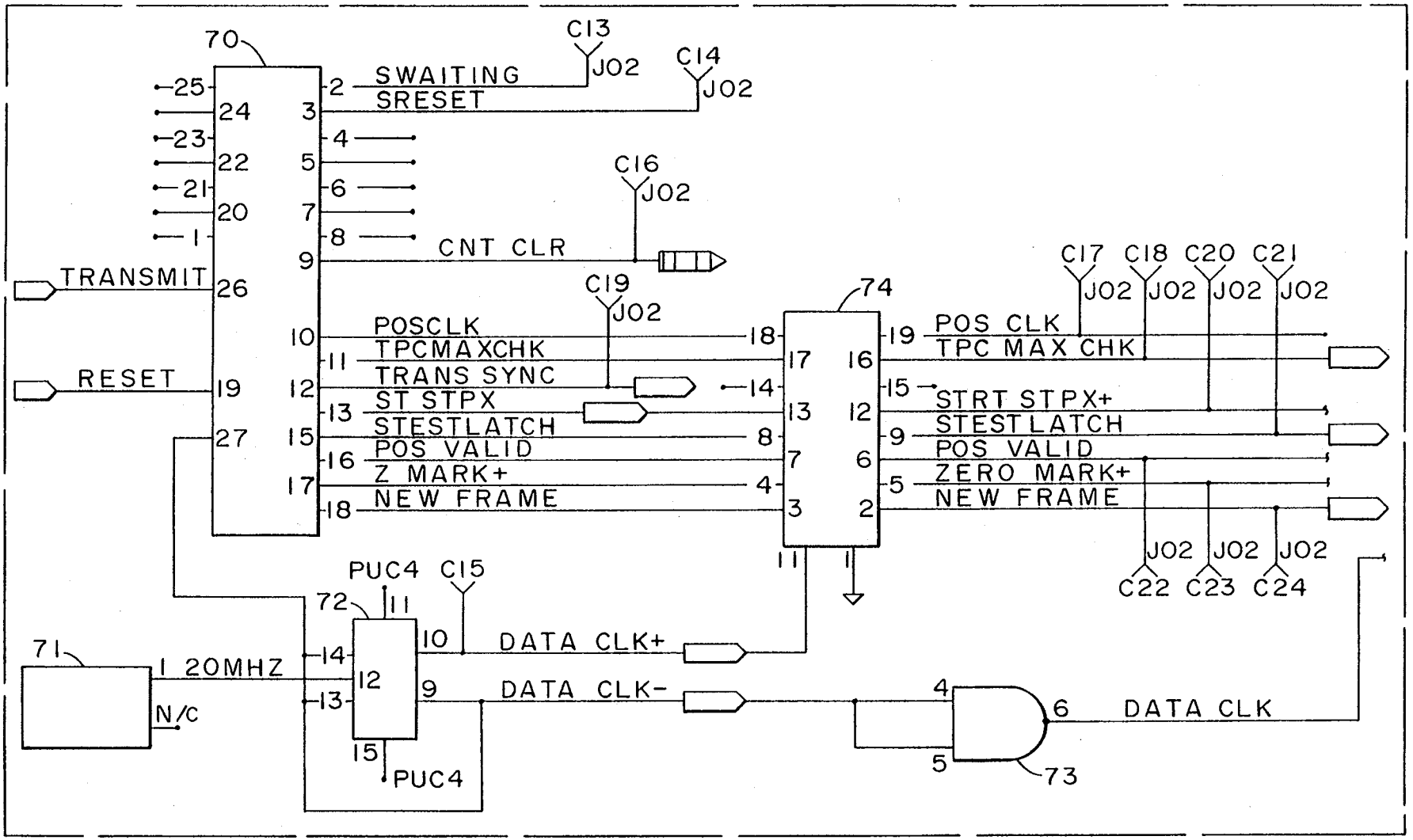
Figure 12B:
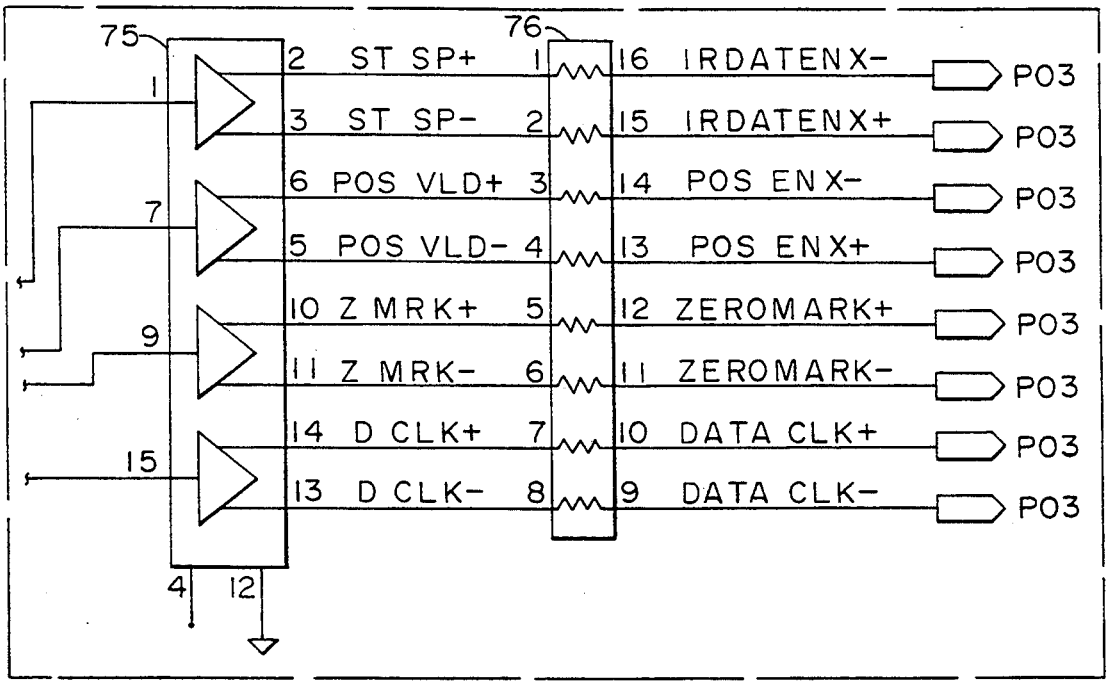
Figure 13A:
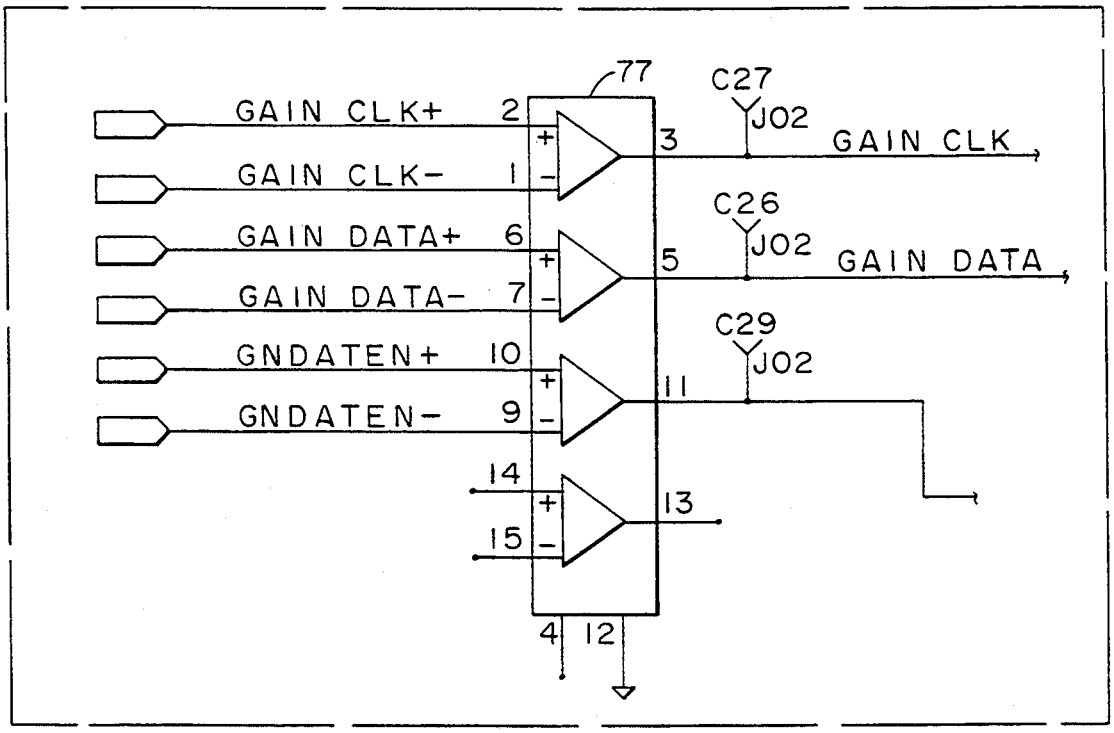
Figure 13B:
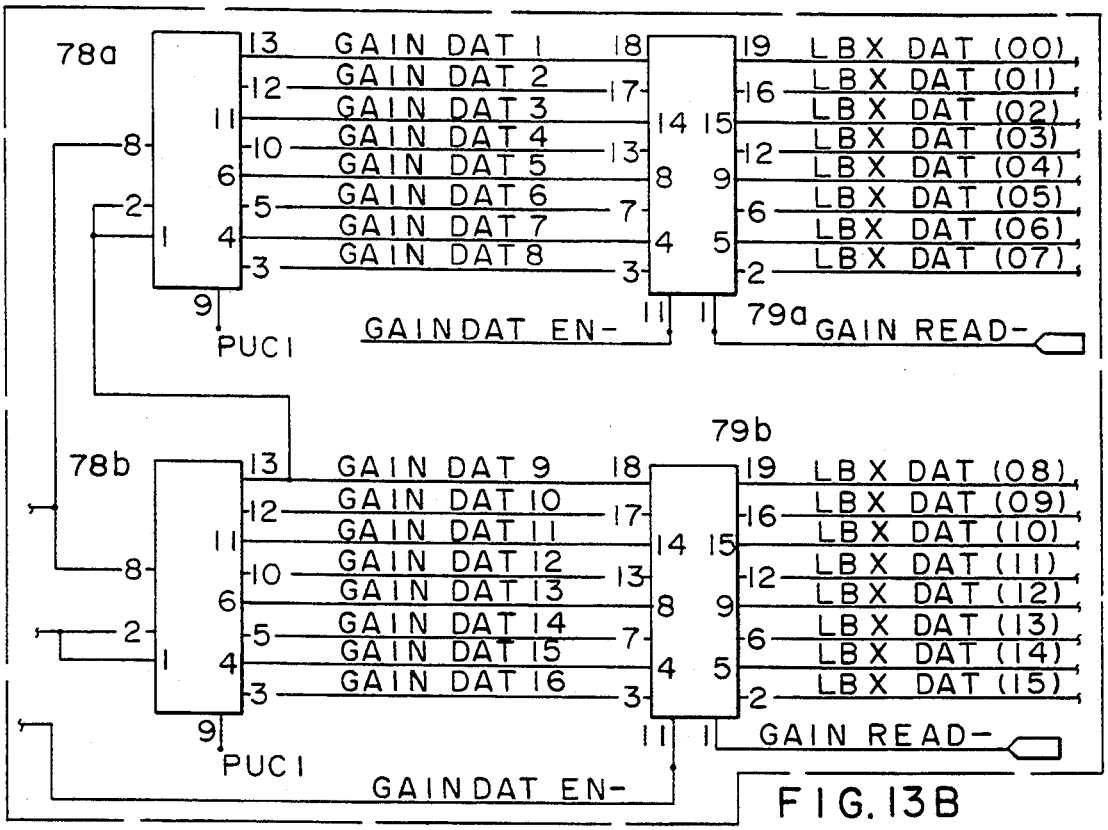
Figure 15A:
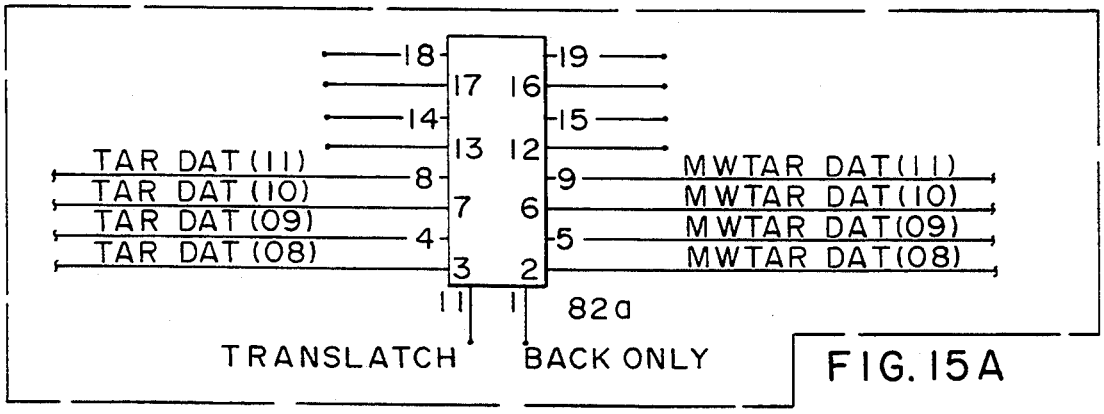
Figure 15B:
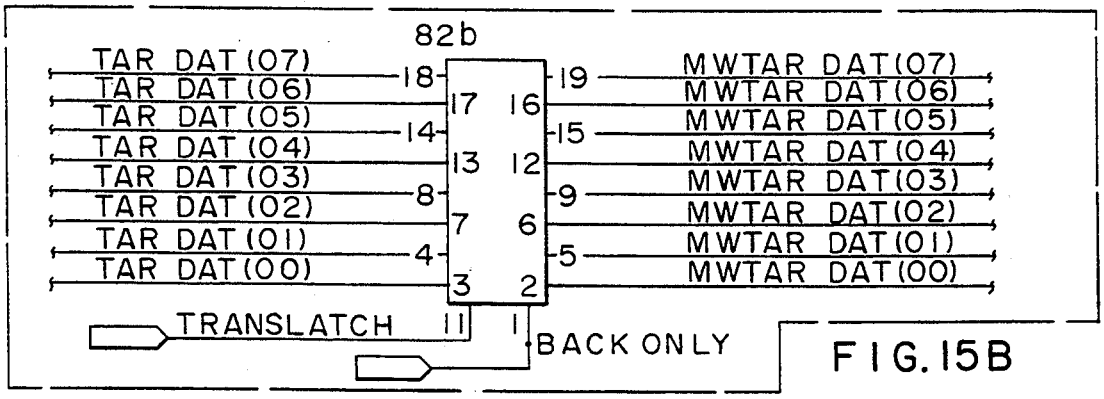
Figure 14A:
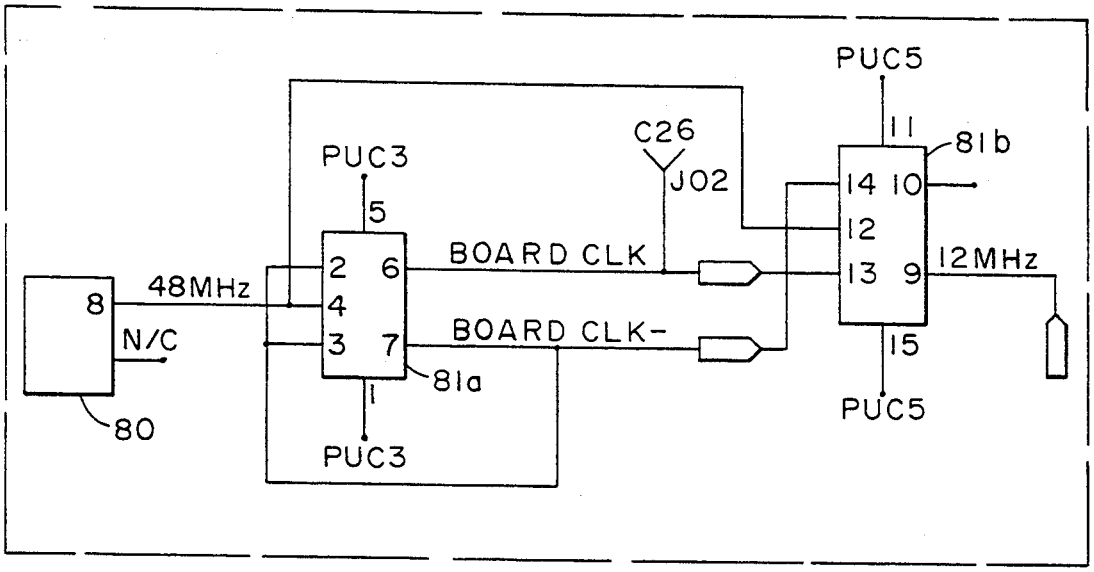
FIG. 14A is the circuit diagram of FIG. 14 on which data flow is shown.
Figure 18A:
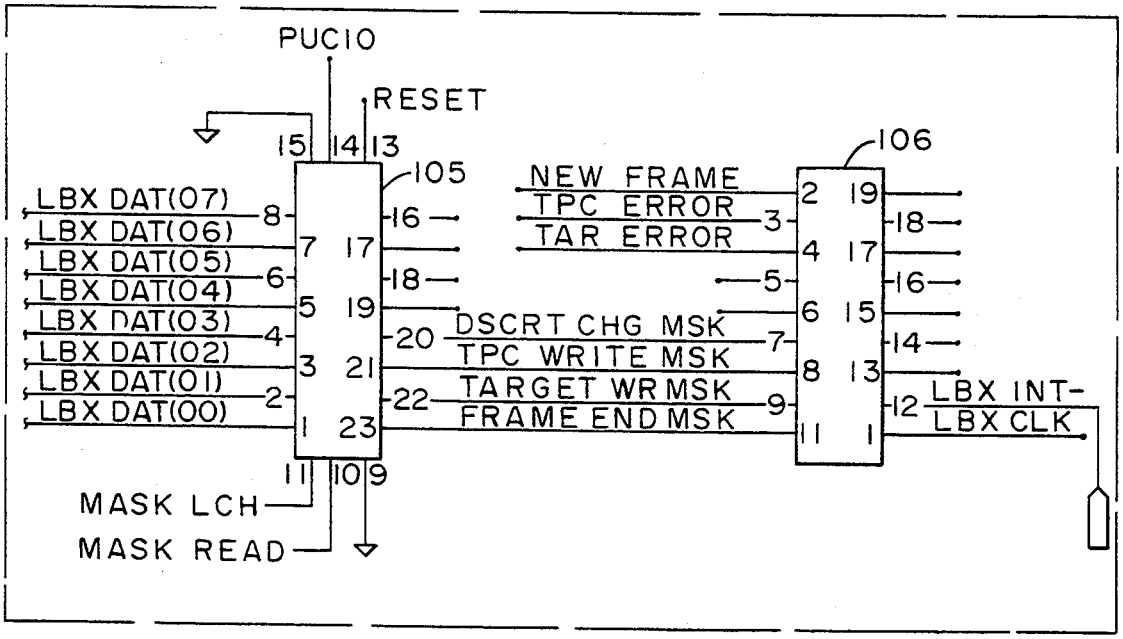
FIG. 18A is the circuit diagram of FIG. 18 on which data flow is shown.
Figure 15C:
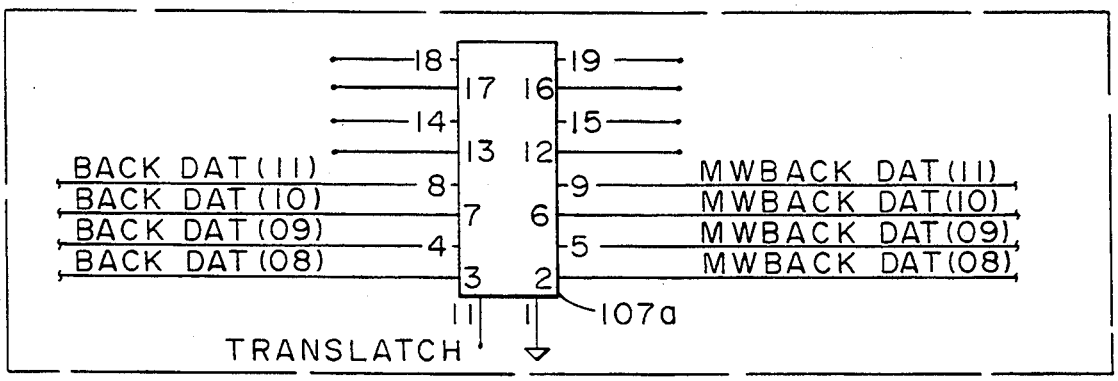
Figure 15D:
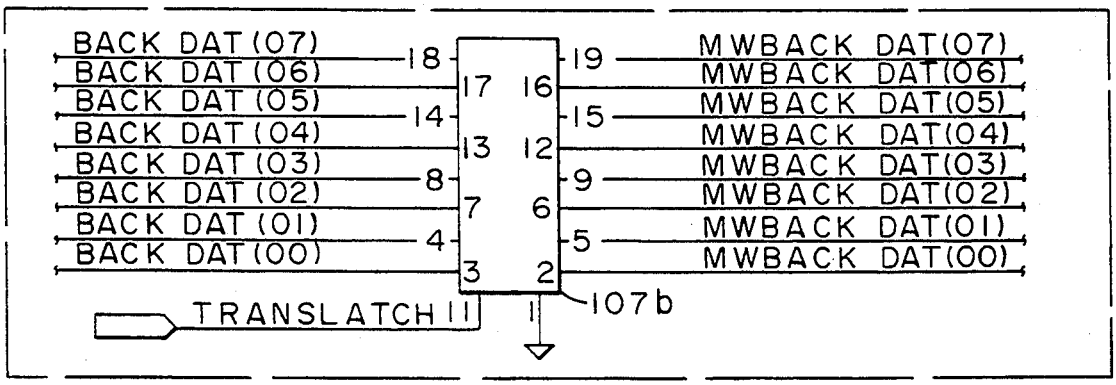
Figure 15E:
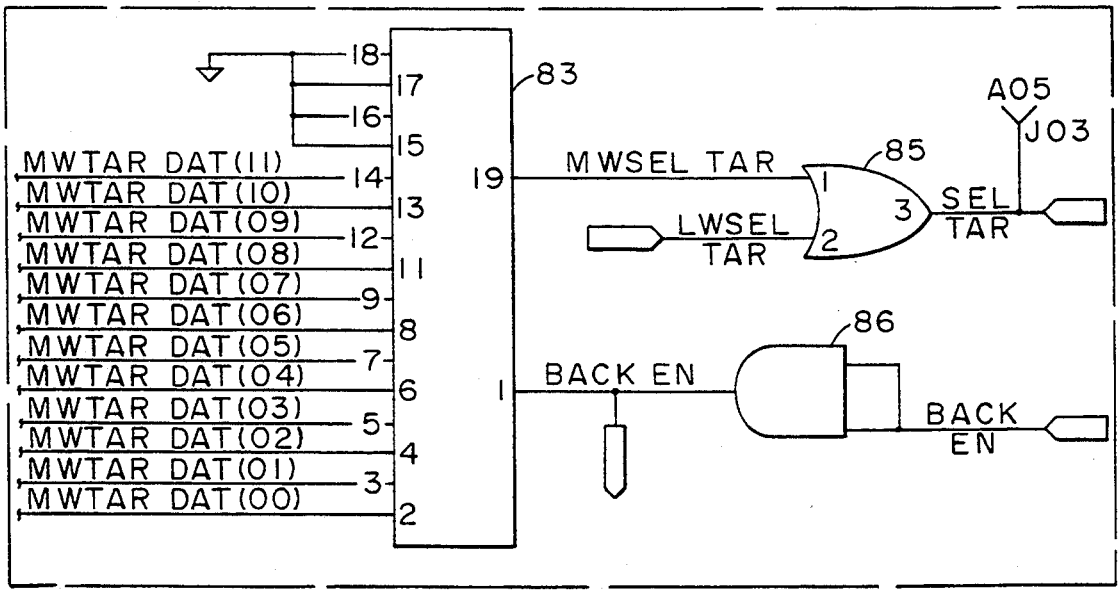
Figure 15F:
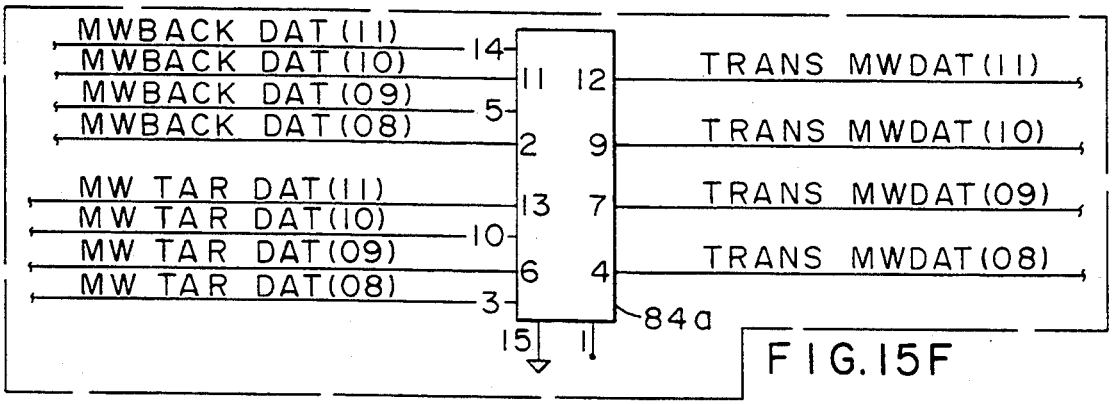
Figure 15G:
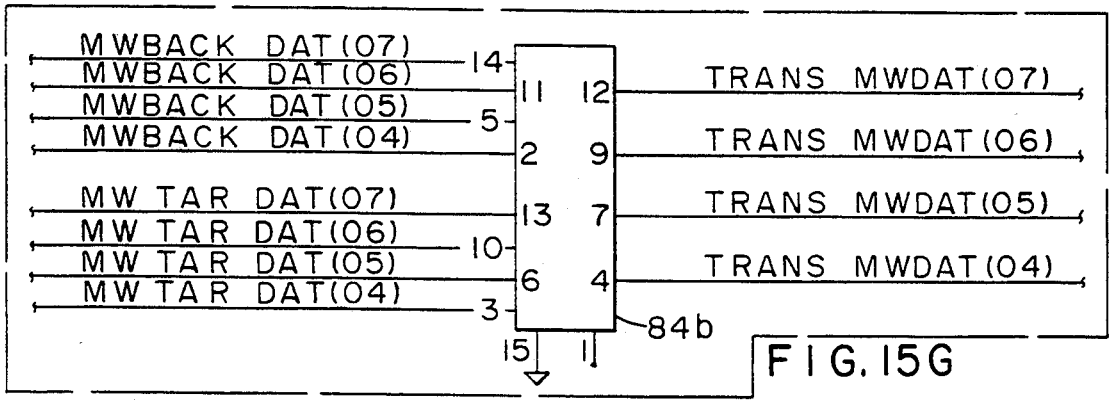
Figure 15H:
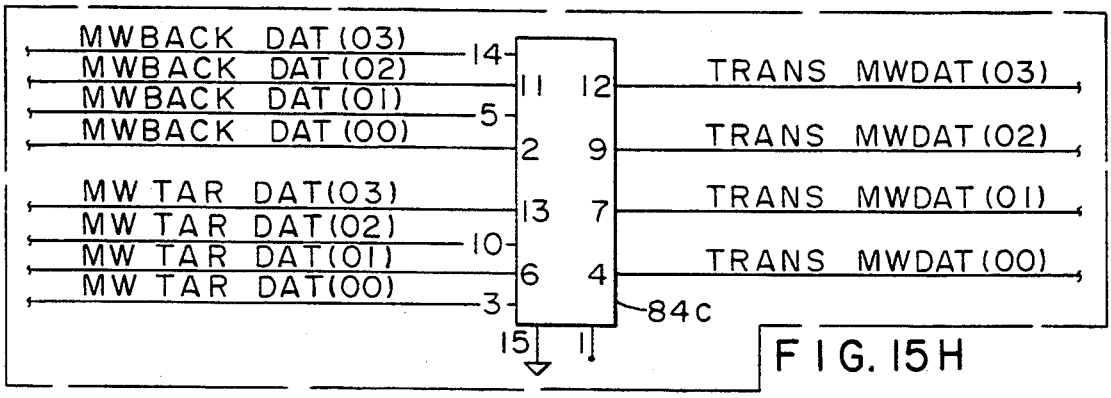
Figure 15I:
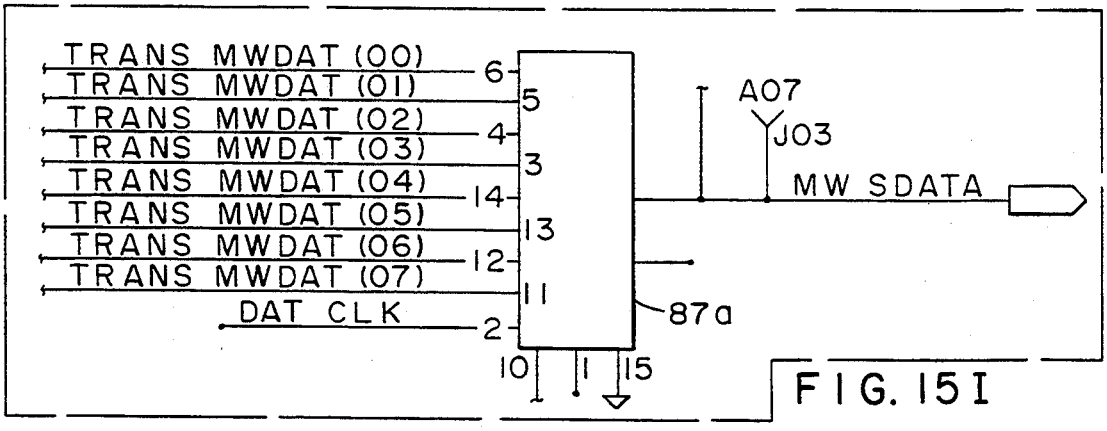
Figure 15J:
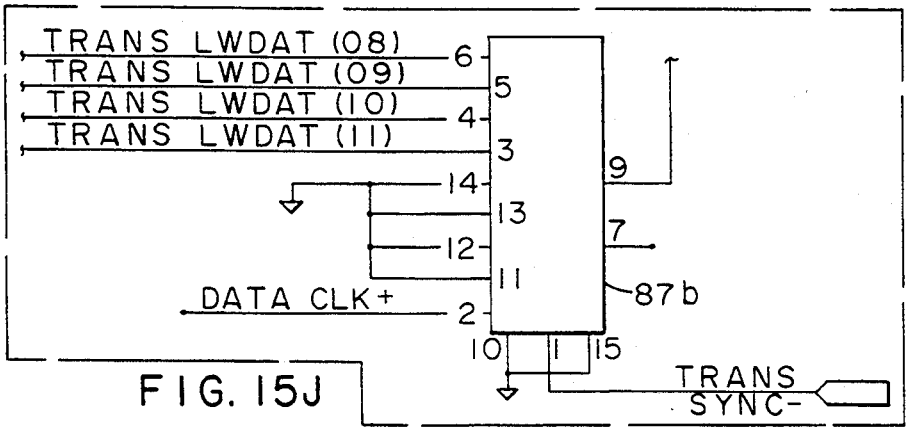
Figure 15K:
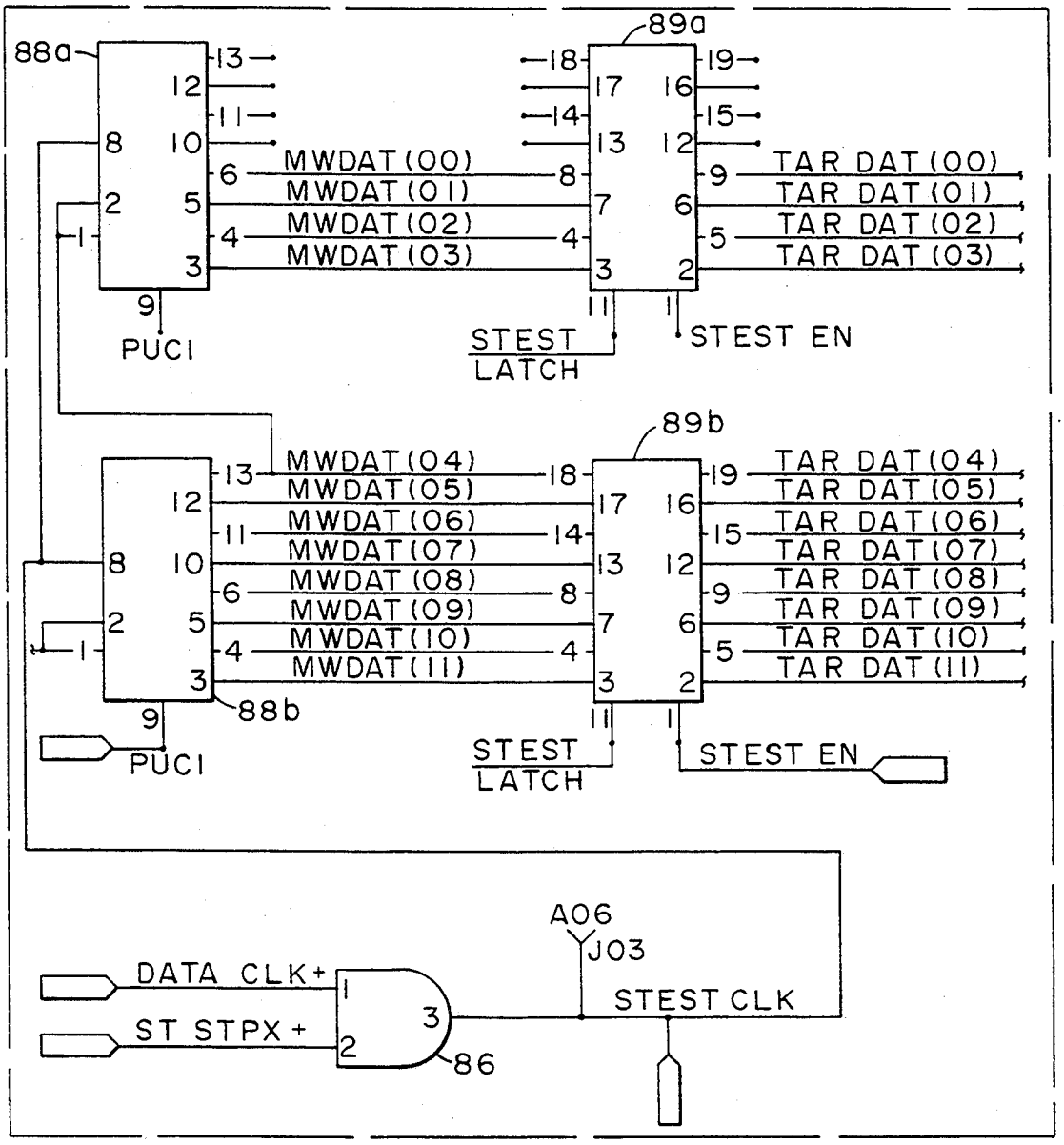
Figure 16A:
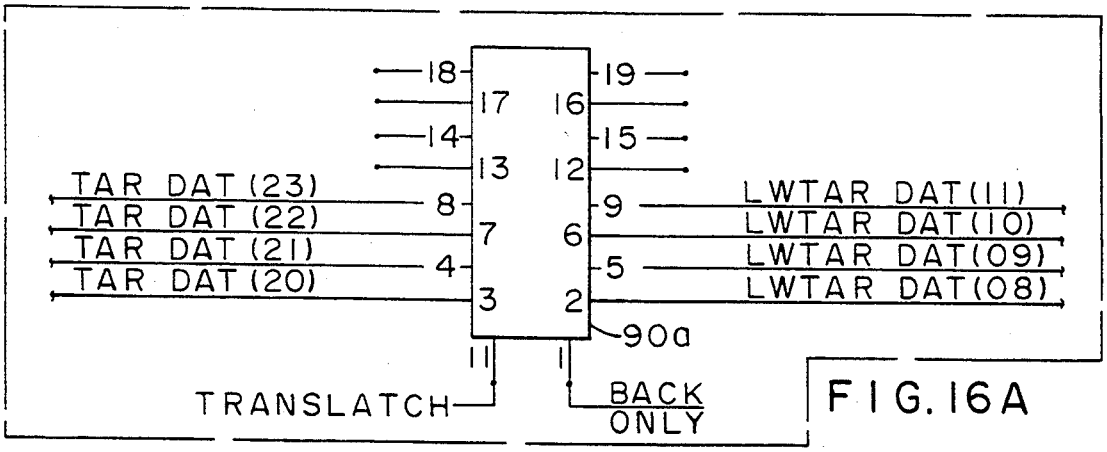
Figure 16B:
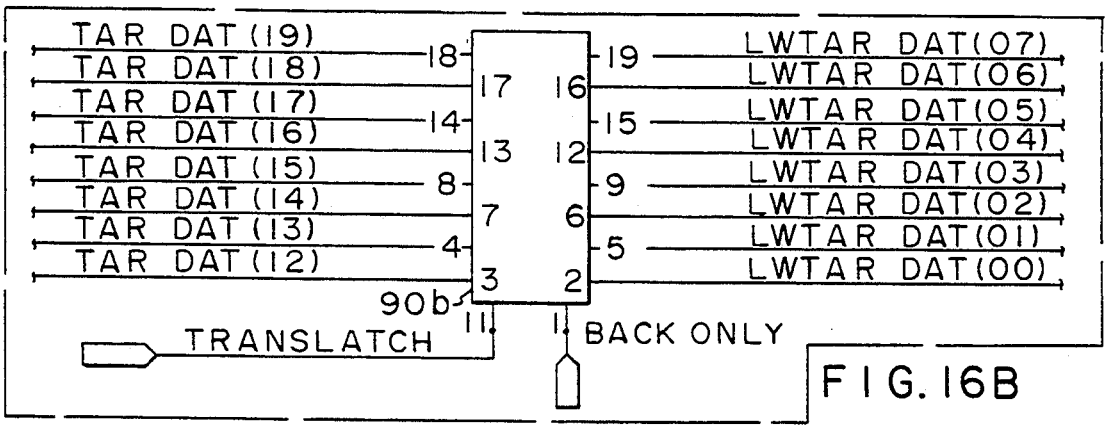
Figure 16C:
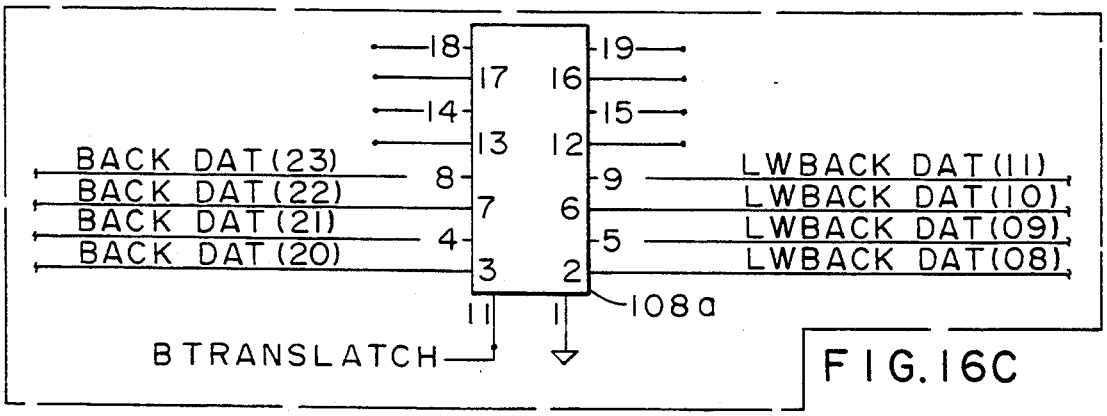
Figure 16D:
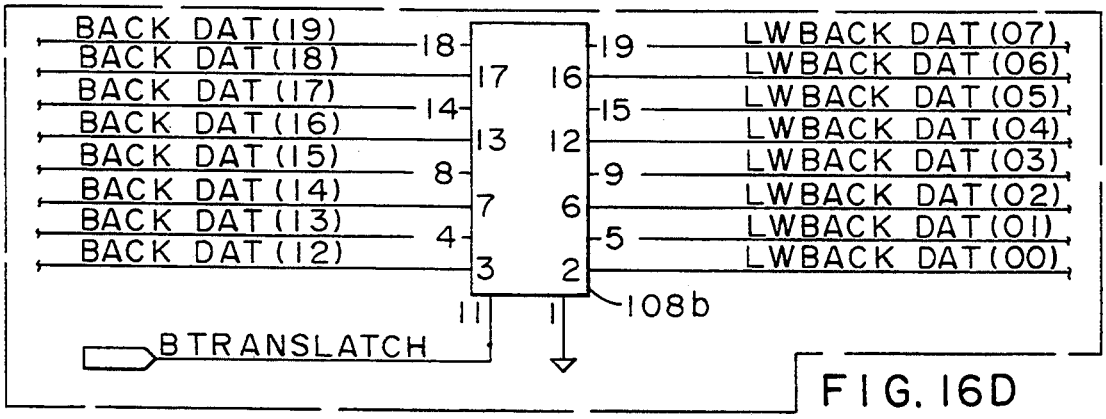
Figure 16E:
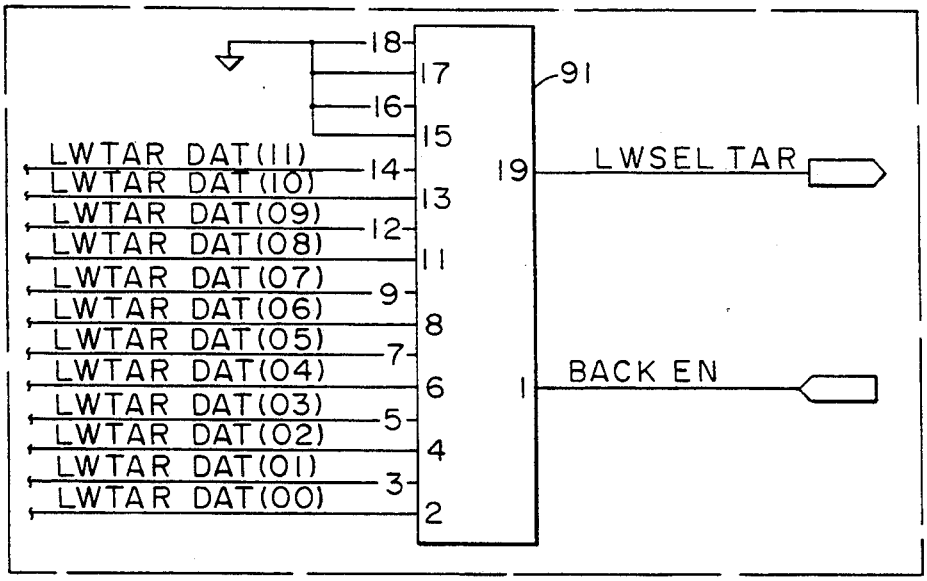
Figure 16F:
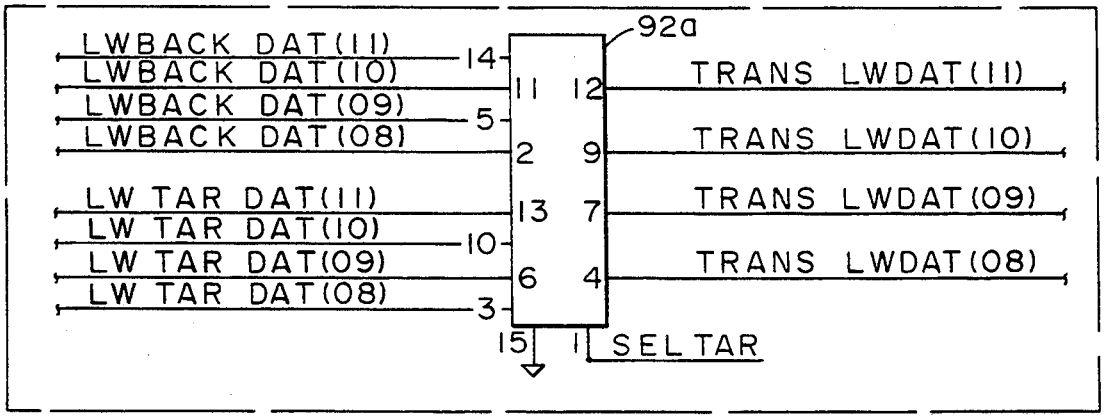
Figure 16G:
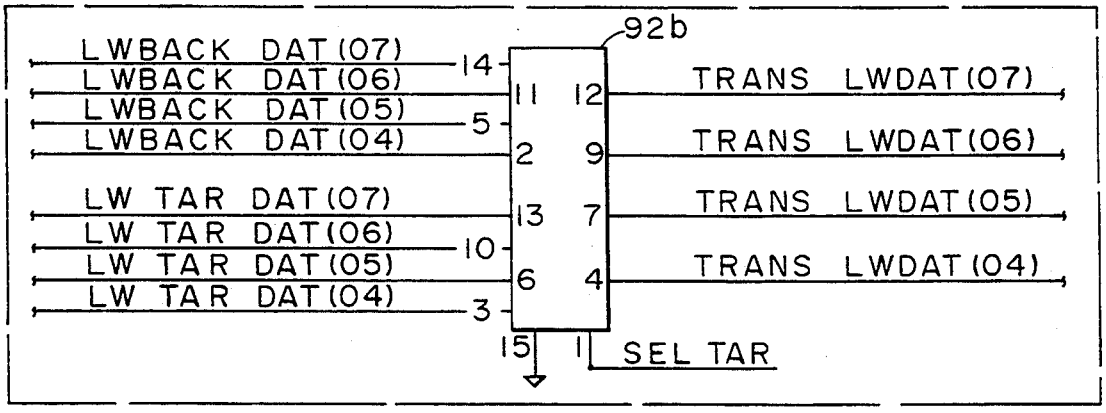
Figure 16H:
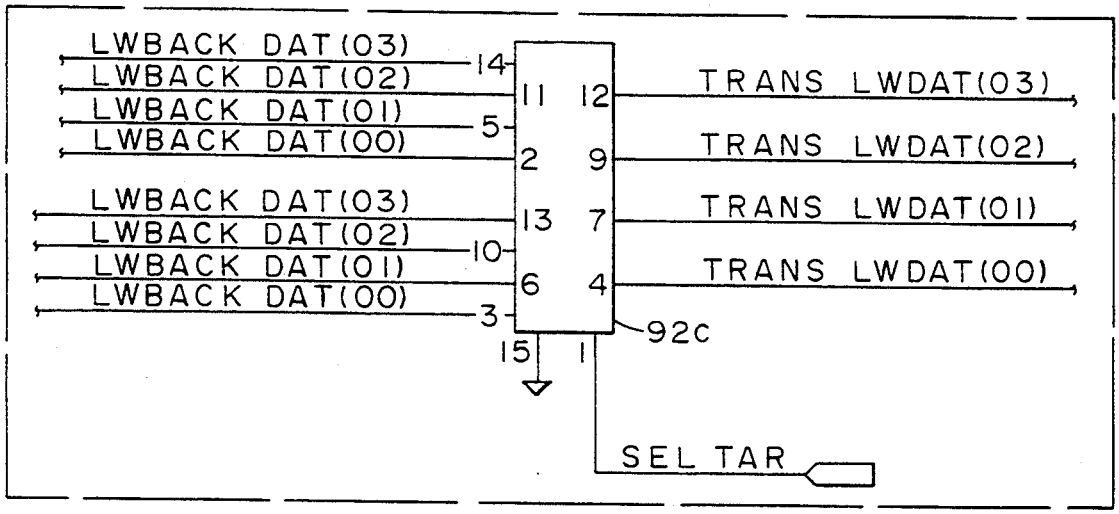
Figure 16I:
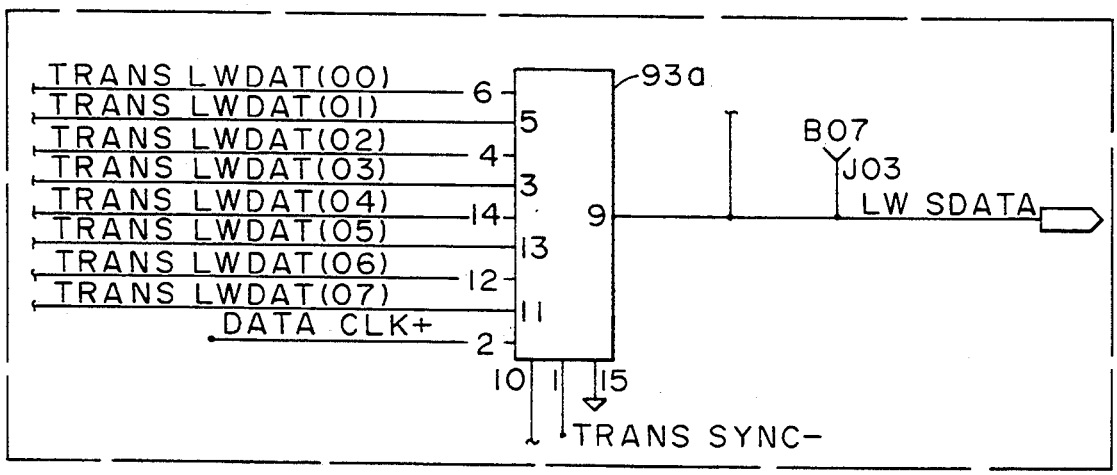
Figure 16J:
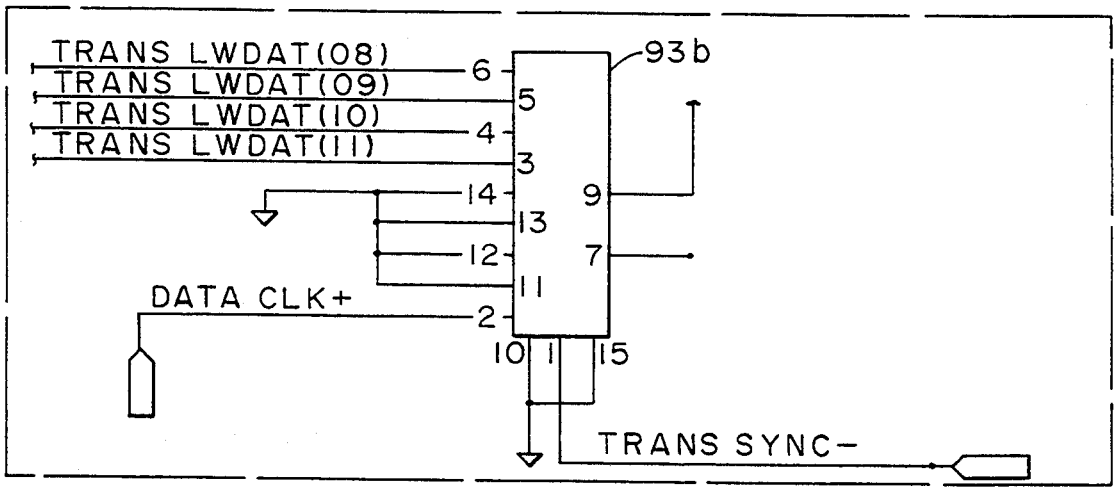
Figure 16K:
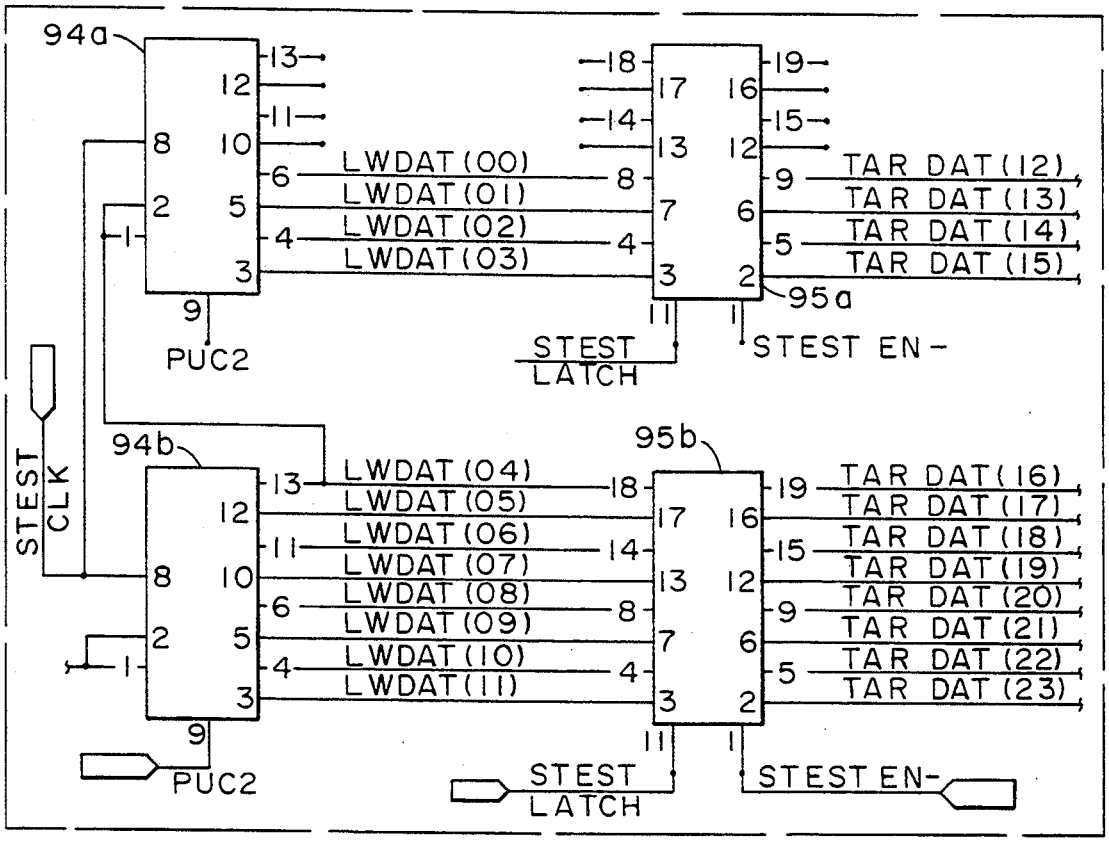
Figure 17A:
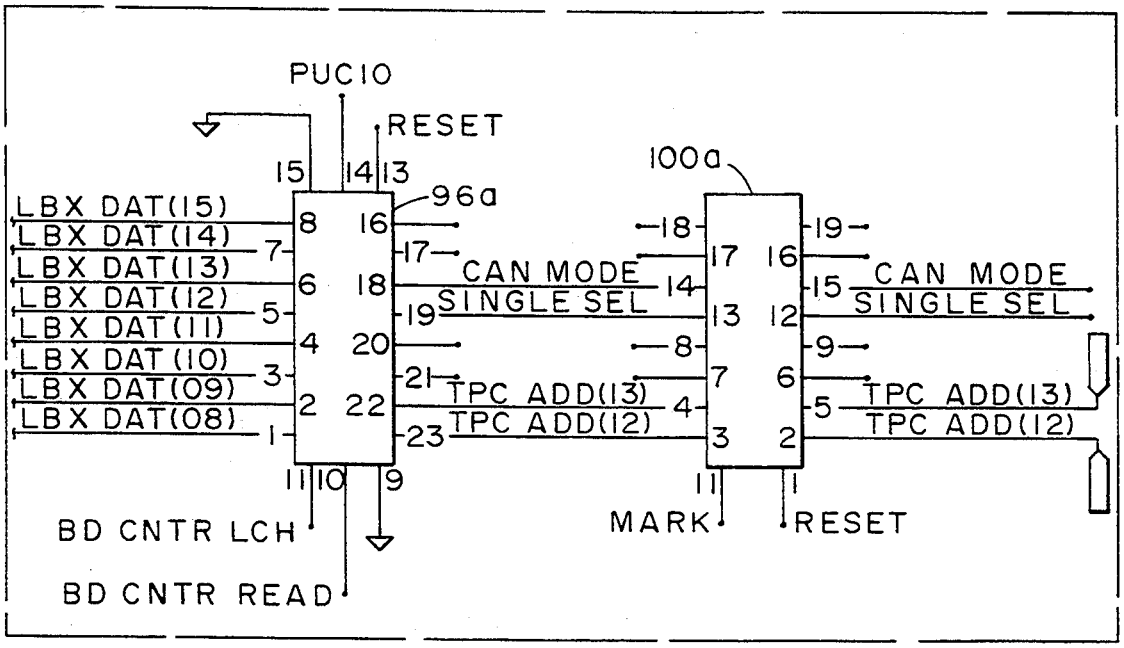
FIGS. 17A thru 17K are circuit diagrams of selected portions of FIG. 17 marked in dotted lines on FIG. 17 which show data flow within those portions.
Figure 17B:
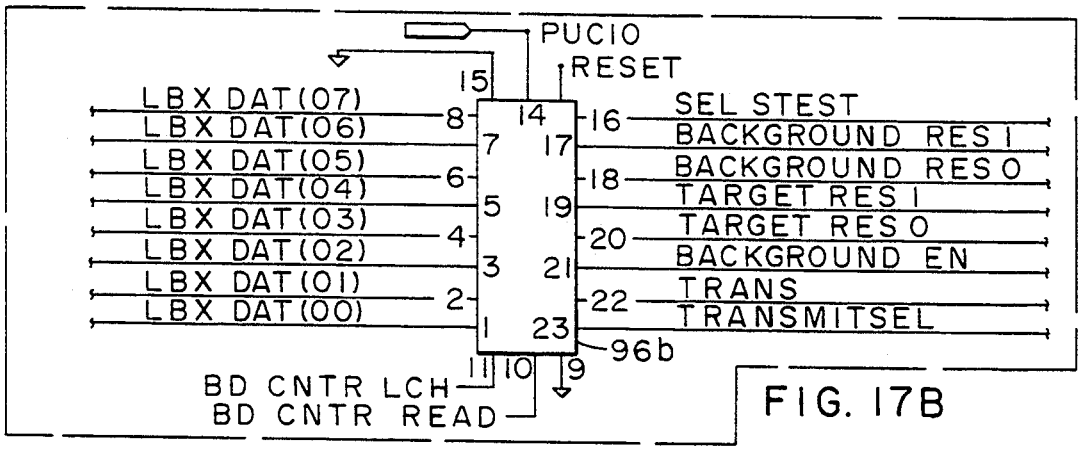
Figure 17C:
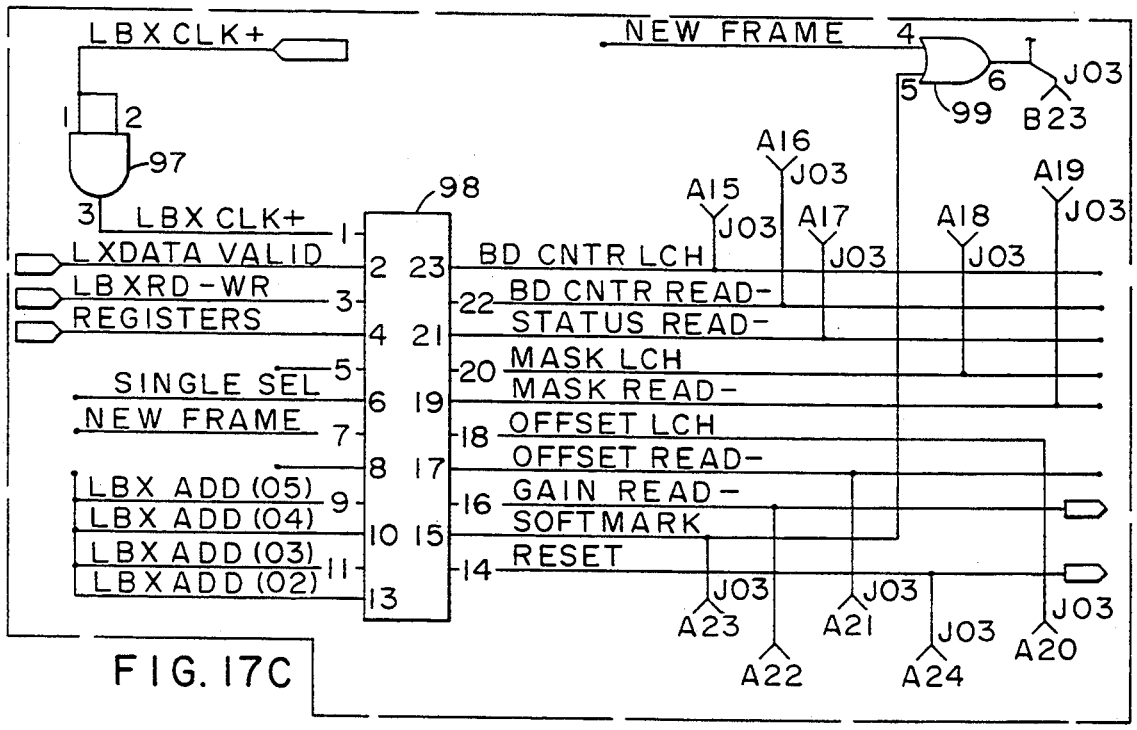
Figure 17D:
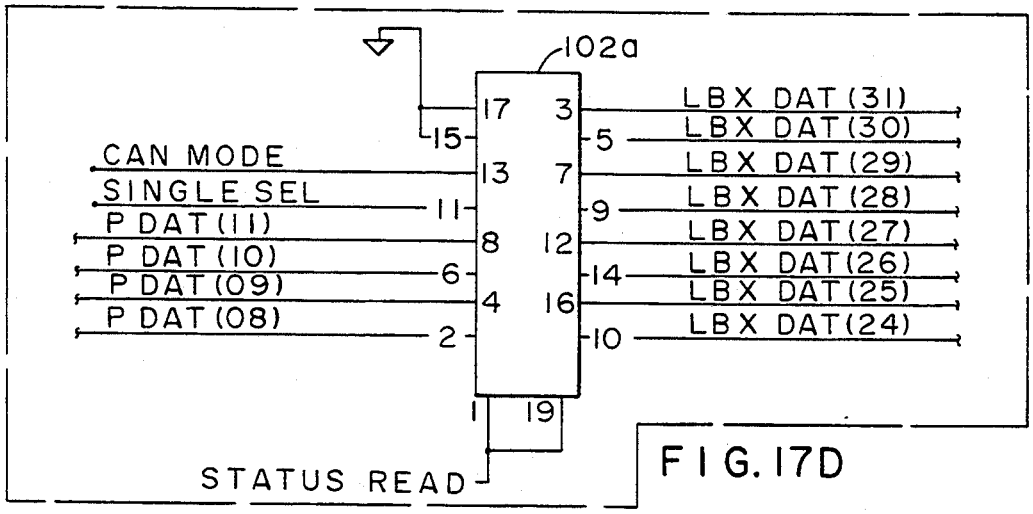
Figure 17E:
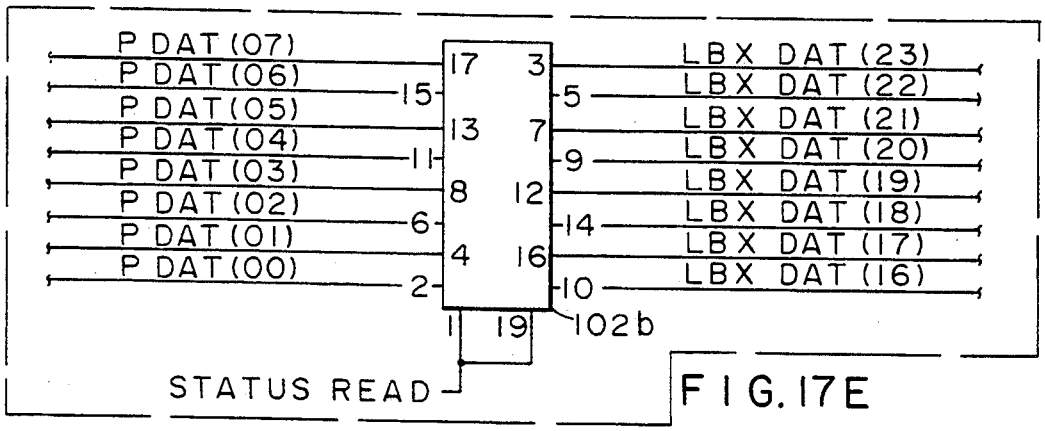
Figure 17F:
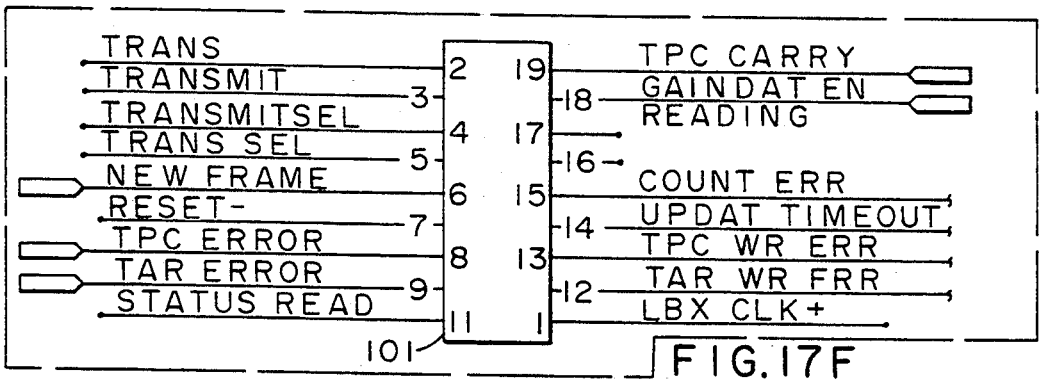
Figure 17G:
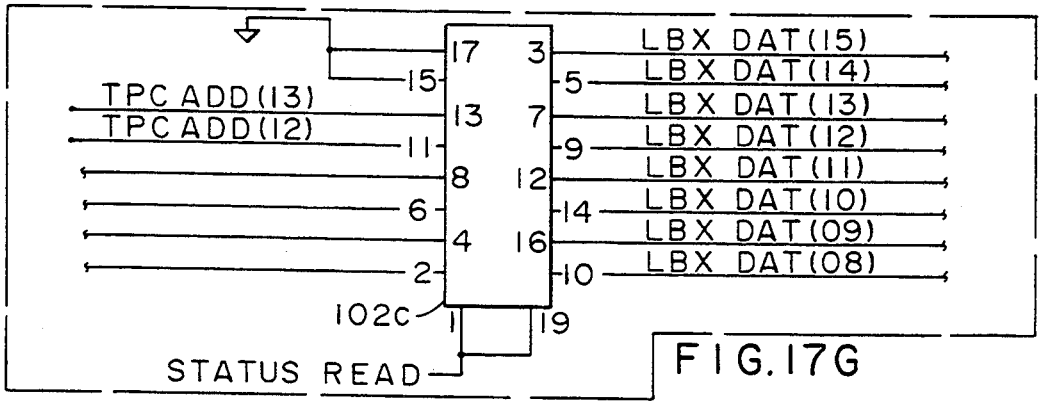
Figure 17H:
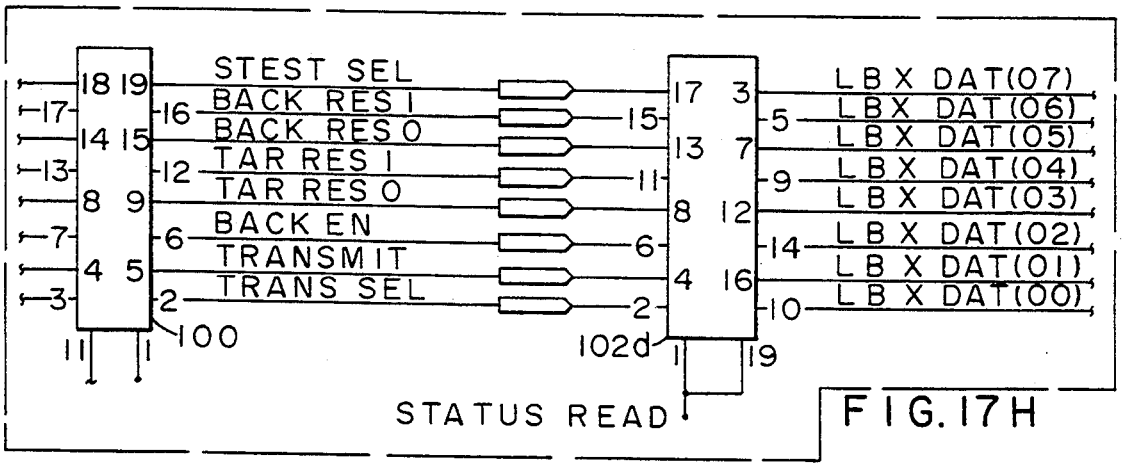
Figure 17I:
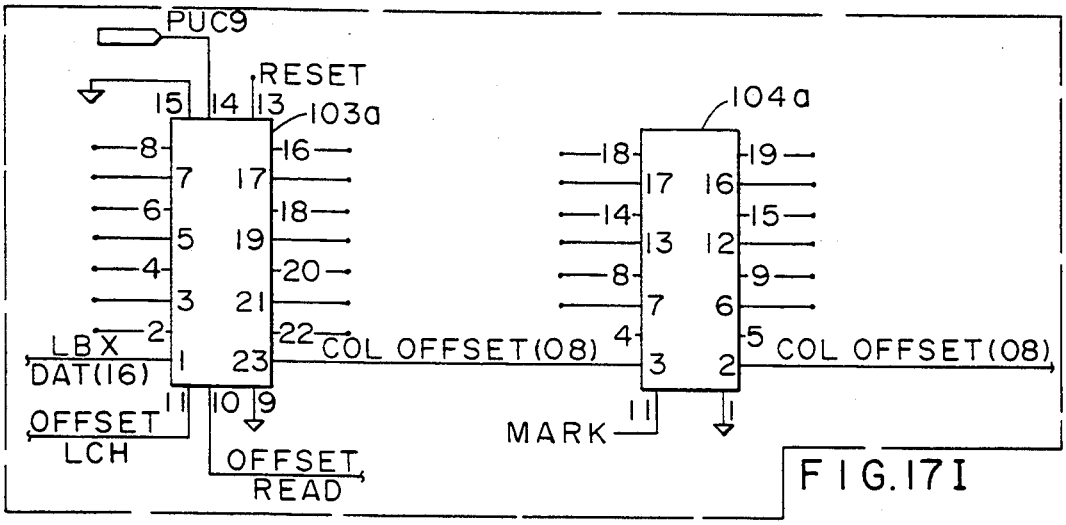
Figure 17J:
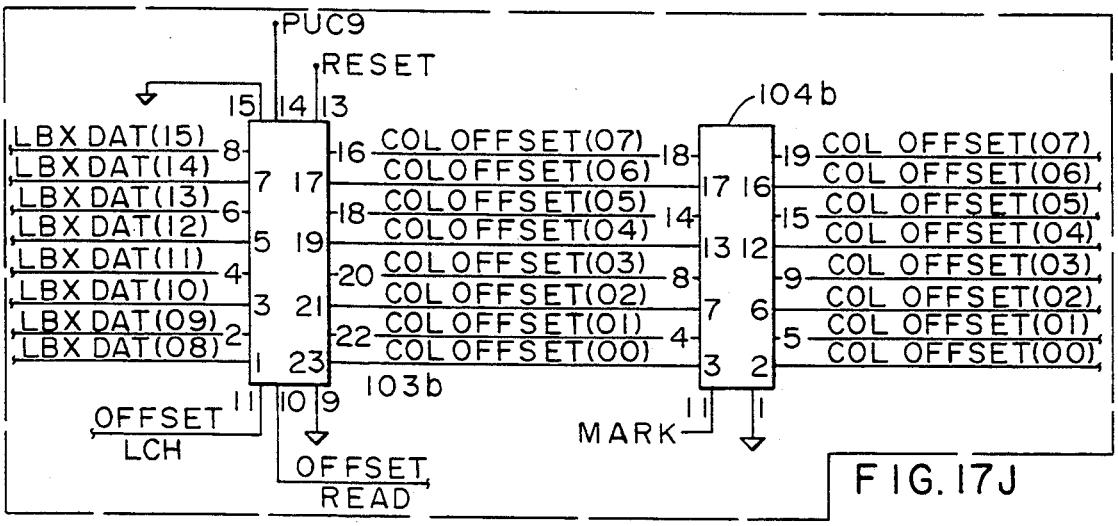
Figure 17K:
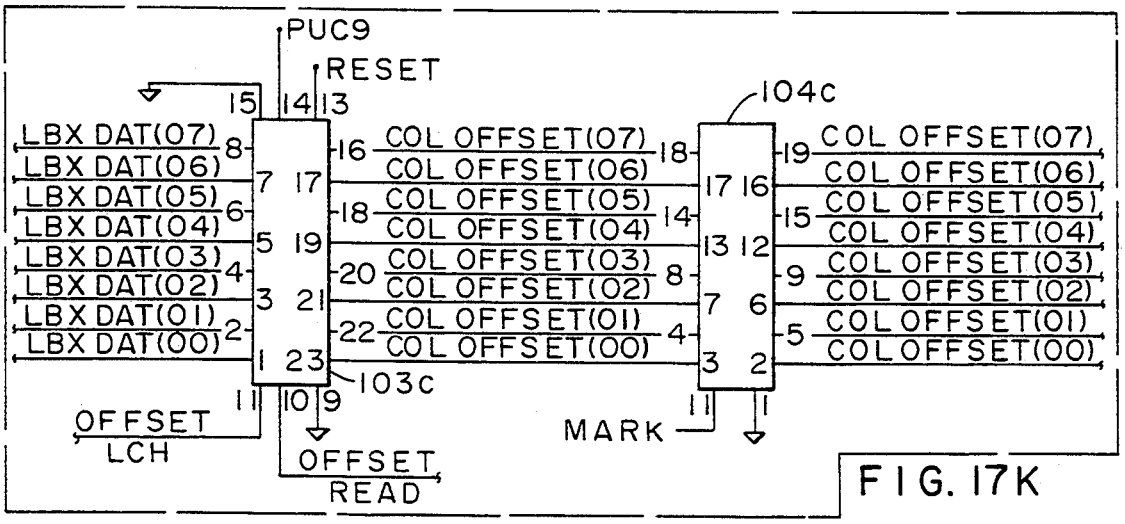

In FIGS. 2 thru 18 I have shown present preferred wiring diagrams for the various parts of my system. The data flow through the components is shown in subfigures identified by corresponding number/letter combinations. FIG. 2 illustrates the preferred circuit for my interface box 1; fountain decoder 2 in FIG. 1. The components in address counter 3, target address mux 4 and resolution control 5 are shown in FIG. 3 where these three major assemblies are indicated by dotted lines. The target buffer RAM 8 and associated transceivers 7 are in FIG. 4. FIG. 5 is the target RAM control. The resolution control 9, background offset 10 and background address MUX are in FIG. 6. FIG. 7 contains the background buffer RAM 12 and associated transceiver combination 13. FIG. 8 is the background buffer control 14. FIG. 9 includes the transmit pattern control RAM 16, associated counter 15 and transceiver group 17. FIG. 10 is the transmit pattern control 18. FIG. 11 is the position data generator 21. The circuit of FIG. 12 an be used for clock 28 and board timing 20. FIG. 13 is the gain data register 22. FIG. 14 is clock 23. The circuit of FIG. 15 can be used as the latch and format unit 19 for medium wave target formats whereas FIG. 16 is a comparable latch and format unit for long wave target patterns. FIG. 17 contains the board control register 27, status/error register 26, offset register 24 and register controller 33. FIG. 18 is the interrupt mask register controller 25.

I prefer to use components set forth in the following table. Where more than one of a particular component is used the reference number in the figures is the numeral listed in the table followed by a letter a, b, c, d or e so that each component has a distinct reference. To conserve space, those letters are omitted from the table.

| Ref. No. | Description | Source | Part Number |
|---|---|---|---|
| 77 | receiver | AMD | AM26LS32/BEA |
| 68, 75 | driver | AMD | AM26LS31/BEA |
| 61 | ram | AMD | CY7Cl66-45DC |
| 53, 72, 81 | dual JK flip flop | TI | 54F109DMQB |
| 44 | oct buffer | TI | 54F244DMQB |
| 46 | out bus trans | TI | 54F245DMQB |
| 62, 73, 86, 97 | quad nand gate | TI | 54ALS00J |
| 85, 99 | quad 2in or | TI | 54ALS32J |
| 48, 56, 84, 92 | quad 2:1 mux | TI | 54ALS157J |
| 78, 88, 94 | ser/par shift reg | TI | 54ALS164J |
| 67, 87, 93 | par/ser shift reg | TI | 54ALS165J |
| 82, 90, 100 | oct D flip flop | TI | 54ALS273J |
| 43, 102 | oct buffer | TI | 54ALS244J |
| 74, 79, 107, 108, 89, 95, 104 | oct D latch | TI | 54ALS374J |
| 47, 60, 66 | 4bit counter | TI | 54AlS561J |
| 105, 96, 103 | oct read back latch | TI | 54ALS996JT |
| 83, 91 | comparator | TI | 74ALS526N |
| 51, 63 | out transceiver | TI | 74AS646N |
| 55 | arithmetic logic unit | TI | SN74AS881ANT |
| 40 | Dip switch ledger | GRAYHILL | 76SB08 |
| 50, 57 | ram | AMD | IDT8M824S45C |
| 71 | Oscillator | VECTRON | CO-238B @ 20.0 MHz |
| 80 | Oscillator | VECTRON | CO-238B 48 MHZ |
| 41 | pal | AMD | PAL16L8 10C |
| 42, 52, 59, 64, 98 | pal | AMD | PALC22V10B-25WC |
| 49, 54, 101 106 | pal | ALTERA | EP310-DC-2 |
| 70 | sequencer | AMD | AM29CPL151-DC |
| 45, 65 | Resistor pull up | * | 898-1-R1K |
| 69, 76 | Resistor series | * | 898-3-R33 |

*Available from numerous sources.
AMD = Advanced Micro Devices
TI = Texas Instruments To operate my system one connects it to an SBC in a multibus II chassis. Then one connects the output drivers 30 to the device being tested. For a missile, this connection would be to the processing unit of the missile. Target and background data are loaded by the SBC. The background data is taken from buffer memory 12 into latch format device 19. There selected target information from target memory 6 is overlayed onto the background and converted to serial data. The combined signal is then output through output drivers 30 to the processor of the missile or other device under test. Gain data is received once per frame from the processor. As the combined target and background information is released, timing signals and position data are also sent to the device under test. This combined information simulates the data which the device would receive from its sensors when the device is in service. Hence, the operator can monitor the device being tested to assure that it is functioning properly.

It should be distinctly understood that my invention is not limited to the embodiments here shown, but may be variously embodied within the scope of the following claims.

I claim:

1. An improved system for simulating targets on selected backgrounds for testing missiles and other target driven devices having at least one processor which receives target background information and responds thereto, the system being of the type having means for selecting targets, background and the positions of selected targets on selected backgrounds and inputting such selections into at least one processor of at least one of a missile and other target driven devices wherein the improvement comprises:

a background memory which can output at least one selected background;

a target memory which can output at lease one selected target wherein the target memory is comprised of first and second target buffers to allow the first target buffer to receive target data for the target driven device while the other target buffer contains target data for the same target driven device; and means connected to the background memory and the target memory for overlaying selected targets on selected backgrounds and outputting background and related targets to the at least one processor,

2. The improved system of claim 1 wherein the two buffers contain alternating target frames to allow setting up of a next frame while any selected frame is being transmitted.

3. The improved system of claim 1 also comprising at least one offset register for specifying coordinates connected to the background memory.

4. The improved system of claim 1 also comprising at least one resolution control connected to one of the target memory and the buffer memory.

5. The system of claim 1 also comprising a status register to allow a user of the system to read the status of the system.

6. The system of claim 1 also comprising a transmit pattern control memory for selecting and simulating data retrieval patterns followed by the device being tested.

7. The improved system of claim 1 also comprising a board control register for controlling at least one of transmit functions and self-test functions of the system.

8. The improved system to claim 1 also comprising an interrupt mask register for selecting interrupt conditions.

9. The improved system to claim 1 also comprising a reset system timing generator for resetting control registers.

10. The improved system of claim 1 also comprising a gain register for storing gain data from a target driven device being tested and for providing a gain data.

11. An improved method for generating target and background information to be input into target driven devices being tested of the type wherein an operator selects Larger and background information for input into the device being tested wherein the improvement comprising:

providing a background memory from which selected backgrounds can be output;

providing a target memory comprised of first and second target buffers from which selected targets can be output;

selecting a background and outputting the selected background from the background memory;

selecting a target comprised of a series of frames;

storing the frames in the first and second target buffer;

outputting selected frames from the target memory;

overlapping the selected frames from the target memory on the selected background to create a target simulation; and inputting the target simulation into the device being tested.

12. The improved method of claim 11 wherein the selected target is comprised of a series of frames also comprising the step of updating each frame while a previous frame is being overlayed into the target simulation.

* * * * *

UNITED STATES PATENT AND TRADEMARK OFFICE

CERTIFICATE OF CORRECTION

PATENT NO : 5,415,548
DATED : May 16, 1995
INVENTOR(S) : Robert A. Adams

It is certified that error appears in the above-identified patent and that said Letters Patent is hereby corrected as shown below:

Please insert the following at the beginning of the specification, after the title --This invention was made with Government support under N00019-88-C-0151 awarded by the Department of the Navy. The Government has certain rights in this invention.--

Signed and Sealed this

Thirteenth Day of January, 1998

Bruce Lehman

*Attest:*

BRUCE LEHMAN

*Attesting Officer*

*Commissioner of Patents and Trademarks*